US007173600B2

(12) United States Patent
Kodate et al.

(10) Patent No.: US 7,173,600 B2
(45) Date of Patent: Feb. 6, 2007

(54) IMAGE DISPLAY DEVICE, PIXEL DRIVE METHOD, AND SCAN LINE DRIVE CIRCUIT

(75) Inventors: Manabu Kodate, Kangawan-ken (JP); Eisuke Kanzaki, Kangawan-ken (JP)

(73) Assignee: International Business Machines Corporation, Armonk, NY (US)

( * ) Notice: Subject to any disclaimer, the term of this patent is extended or adjusted under 35 U.S.C. 154(b) by 601 days.

(21) Appl. No.: 10/605,633

(22) Filed: Oct. 15, 2003

(65) Prior Publication Data

US 2005/0083319 A1 Apr. 21, 2005

(51) Int. Cl.
*G09G 3/36* (2006.01)
*G09G 5/00* (2006.01)

(52) U.S. Cl. ..... 345/103; 345/92

(58) Field of Classification Search ..... 345/204, 345/87–103; 349/33, 48
See application file for complete search history.

(56) References Cited

U.S. PATENT DOCUMENTS 5,430,460 A * 7/1995 Takabatake et al. ..... 345/96
6,943,500 B2 * 9/2005 LeChevalier ..... 315/169.3
6,982,690 B2 * 1/2006 Lee et al. ..... 345/87

FOREIGN PATENT DOCUMENTS

EP 1 058 233 A2 12/2000
EP 1 061 498 A2 12/2000
JP 05-188395 7/1993
JP 05-265045 10/1993
JP 05-303114 11/1993
JP 05-314734 12/1993
JP 06-138851 5/1994
JP 06-148680 5/1994
JP 08-248385 9/1996
JP 11-002837 1/1999
JP 2001-027751 1/2001
JP 2001-027893 1/2001
JP 2001-042842 2/2001

* cited by examiner

*Primary Examiner*—Dennis-Doon Chow
(74) *Attorney, Agent, or Firm*—Joseph P. Abate

(57) ABSTRACT

To supply selection signals to multiplexed pixels efficiently. For a period from time t0 to time t2, first, during a period from time t0 to time t1, a pixel electrode A11 is driven by selecting scan lines Gn+1 and Gn+2, and next, during a period from time t1 to time t2, a pixel electrode B11 is driven by selecting only the scan line Gn+1. Moreover, during the period from time t1 to time t2, scan lines Gn+3 and Gn+4 are also selected, and thus a pixel electrode A12 is driven. After time t2, at least one of the scan lines Gn+3 and Gn+4 is not selected before the pixel electrode A12 is driven by selecting both of the scan lines Gn+3 and Gn+4 during a period from time t4 to time t5. Accordingly, the pixel electrode A12 can be preliminarily charged during the period from time t1 to time t2 and can maintain a potential preliminarily applied thereto until the pixel electrode A12 is driven during the period from time t4 to time t5.

4 Claims, 42 Drawing Sheets

FIG.10

| Slot | A | B |
|---|---|---|
| g(n+1) | +A | +B |
| g(n+2) | −A | − |
| g(n+3) | + | +PA |
| g(n+4) | − | −PA |

FIG.19

| Slot | A | B | C |
|---|---|---|---|
| g(n+1) | +A | +B | +C |
| g(n+2) | - | -B | - |
| g(n+3) | +A/PA | + | + |
| g(n+4) | -NoPulse | -NoPulse | -NoPulse |
| g(n+5) | +PA | + | + |

FIG.27

| Slot | A (D) | B (E) | C (F) |
|---|---|---|---|
| g(n+1) | +A | -B | -C |
| g(n+2) | - | +B/PD | + |
| g(n+3) | +A | - | - |
| g(n+4) | - | +PD | + |

FIG.34

| Slot | A | B |
|---|---|---|
| g(n+1) | +A | +B |
| g(n+2) | +A | + |
| g(n+3) | -NoPulse | -NoPulse |
| g(n+4) | -NoPulse | -NoPulse |
| g(n+5) | +PA | + |
| g(n+6) | +PA | + |

IMAGE DISPLAY DEVICE, PIXEL DRIVE METHOD, AND SCAN LINE DRIVE CIRCUIT

BACKGROUND OF INVENTION

The present invention relates to an image display device, a pixel drive method and a scan line drive circuit, and more particularly, to a technology of contributing to higher definition of a liquid crystal display device.

As is commonly known, in a display device driven by an active matrix drive system, as the number of display pixels has been increased, the number of drive ICs has been increased, which may cause a cost increase. In addition, as definition of a screen has been enhanced, a pixel interval has been narrowed, thus making it difficult to connect a pixel and a drive IC to each other. Accordingly, in order to solve these problems simultaneously, a display device has been proposed, which adopts a multiplexed pixel structure, in which a pitch of connection terminals is increased as well as the number of drive ICs is decreased by applying potentials to two or more adjacent pixels from one data line by time division. For example, such a display device is disclosed in Japanese Patent Laid-Open Nos. Hei 5 (1993)-303114 and Hei 8 (1996)-248385.

PROBLEMS TO BE SOLVED BY THE INVENTION

In the display device having the multiplexed pixel structure as described above, it is necessary to supply plural types of selection signals to pixels in one row in accordance with a multiplexing degree of the pixels during one horizontal scan period. Therefore, pixels are usually selected by a combination of scan lines of other systems in accordance with the multiplexing degree of the pixels. However, a selection logic for supplying such plural types of selection signals has not been established. In order to select a plurality of scan lines, it is sufficient if selection pulses composed of a plurality of shift clocks are made to sequentially propagate to buffers connected to input ends of the scan lines. However, since only the selection pulses cannot constitute logic, it is necessary to provide plural systems of output control lines controlling ON/OFF of the buffers. However, a relation between the number of systems of the output control lines and the number of shift clocks of the selection pulses has not been obvious, or what kind of output control signals can efficiently control ON/OFF of the buffers has not been obvious, either.

Moreover, in such a display device, since charges have been applied to two or more pixels by time division for a time while a charge has been applied to one pixel heretofore, a charge time is shortened. Accordingly, as long as a selection element is not enlarged, accuracy of the applied potential is lowered, which has been a problem. A method called "precharge" for compensating such shortage of a charge amount has been generally known. The term "precharge" means that, at timing before writing data to a pixel, data of the same polarity is written to the pixel in advance, thus realizing a desired charge amount even if a charge amount when the data is written to the pixel is small.

The precharge method as described above can be also applied to a display device having pixels that are not multiplexed when a write time cannot be sufficiently secured due to a high resolution. In such a display device, in which the pixels are not multiplexed and normally driven, the timing of performing the precharge can be uniquely determined to the time of selecting a pixel proximate to a pixel to be precharged and of the same polarity. However, if the scan lines of the other systems are shared among the adjacent rows in the display device having the multiplexed pixel structure, then it is made difficult to uniquely determine the timing of precharge by timing of inverse drive and combinational logic.

SUMMARY OF INVENTION

The present invention was made based on the technical subjects as described above. An object of the present invention is to provide an image display device capable of efficiently supplying the selection signals to the multiplexed pixels, and the like. Another object of the present invention is to provide an image display device capable of readily determining the timing of precharge, drive waveform and method of the pixel, and the like.

MEANS FOR SOLVING THE PROBLEMS

In order to attain the objects described above, an image display device of the present invention has features as below. The image display device to which the present invention is applied includes: a plurality of signal lines for supplying display signals; a first group of pixel electrodes sequentially selected during a first horizontal scan period, the first group of pixel electrodes being connected to a specified signal line; a second group of pixel electrodes sequentially selected during a second horizontal scan period after the first horizontal scan period, the second group of pixel electrodes being connected to the specified signal line; a first group of scan lines for supplying scan signals for driving the first group of pixel electrodes during the first horizontal scan period; and a second group of scan lines for supplying scan signals for driving the second group of pixel electrodes during the second horizontal scan period. Moreover, this image display device is characterized in that a specified group of scan lines among the second group of scan lines is selected during the first horizontal scan period to drive a specified pixel electrode among the second group of pixel electrodes, and any one scan line in the specified group of scan lines is not selected for a period from the selection of the specified group during the first horizontal scan period to the drive of the specified pixel electrode during the second horizontal scan period.

In such a constitution, any one scan line in the specified group of scan lines is not selected for the period from the selection of the specified group during the first horizontal scan period to the drive of the specified pixel electrode during the second horizontal scan period. Therefore, during this period, the specified pixel electrode driven by selecting the specified group of scan lines is not charged. Accordingly, the drive of the specified pixel electrode during the first horizontal scan period can be defined as the precharge.

Note that, in this case, it is desirable that the specified pixel electrode be driven in the same polarity during the first and second horizontal scan periods. Moreover, the specified group of scan lines and the first group of scan lines may share at least one scan line. Thus, the number of scan lines to be selected simultaneously can be decreased.

Moreover, in this case, it is desirable that the respective signal lines supply display signals of the same polarity during the same horizontal scan period, and that signal lines adjacent to each other supply display signals of different polarities during the same horizontal scan period. Thus, each multiplexed pixel (pixel sequentially selected during the same horizontal scan period) can be driven while a polarity thereof being inverted.

Furthermore, the present invention can be also grasped as an invention of an image display device as below. Specifically, the image display device to which the present invention is applied includes: m pieces of pixel electrodes sequentially driven at first to m-th timings (m: natural number of 2 or more) during a first horizontal scan period, the m pieces of pixel electrodes being connected to a specified signal line; other m pieces of pixel electrodes sequentially driven at the first to m-th timings during a second horizontal scan period after the first horizontal scan period, the other m pieces of pixel electrodes being connected to the specified signal line; and a group of scan lines selected for driving the other m pieces of pixel electrodes during the second horizontal scan period, characterized in that a specified group of scan lines selected at n-th timing (n: natural number from 1 to m) among the group of scan lines during the second horizontal scan period is also selected during the first horizontal scan period.

As described above, the scan lines selected at the n-th timing during the second horizontal scan period is also selected during the first horizontal scan period, thus making it possible to precharge a pixel driven for the n-th time during the second horizontal scan period.

In this case, selection timing for the specified group of scan lines during the first horizontal scan period may be timing other than the n-th timing during the first horizontal scan period. Moreover, the specified group of scan lines may include scan lines for supplying scan signals for driving and controlling the m pieces of pixel electrodes driven during the first horizontal scan period. Moreover, it is suitable that at least one scan line among the specified group of scan lines not be selected from the first timing to (n−1)-th timing during the second horizontal scan period. Thus, a pixel electrode driven by selecting the specified group of scan lines is not driven for a period from the first timing to the (n−1)-th timing, and is driven at the n-th timing for the first time, during the second horizontal scan period.

Furthermore, the selection timing for the specified group of scan lines during the first horizontal scan period may be the n-th timing, and the specified group of scan lines may be different from the scan lines for supplying the scan signals for driving the m pieces of pixel electrodes at the n-th timing during the first horizontal scan period.

Moreover, the present invention can be grasped as an invention of a scan line drive circuit. Specifically, the scan line drive circuit to which the present invention is applied includes: a plurality of output terminals connectable to a plurality of scan lines; and a signal output unit for outputting signal rows composed of a plurality of signals to respective output terminals, characterized in that the signal output unit outputs the signal rows to plural groups of the output terminals simultaneously during one horizontal scan period, and shifts the output terminals one by one for each horizontal scan period to output the signal rows to other groups of output terminals. Moreover, the scan line drive circuit is characterized in that the signal output unit outputs a group of signals outputted to a specified output terminal among the groups of output terminals at first timing during a specified horizontal scan period to a specified output terminal at second timing during another horizontal scan period after the specified horizontal scan period, and outputs a signal different from the group of signals to the specified output terminal for a period from the first to second timing.

With such a configuration, the pixel electrode driven by selecting the scan line connected to the specified output terminal can be driven at the first and second timing, and can be set not to be driven for the period from the first to second timing. Specifically, it is made possible to precharge the pixel electrode at the first timing and to make the pixel electrode maintain a precharged potential until charged at the second timing.

Moreover, the present invention can be also grasped as an invention of a pixel drive method. Specifically, the pixel drive method to which the present invention is applied includes: a first step of selecting and preliminarily charging a specified pixel electrode during a first horizontal scan period; and a second step of sequentially selecting and charging groups of pixel electrodes including the specified pixel electrode during a second horizontal scan period after the first horizontal scan period, characterized in that the specified pixel electrode maintains a potential applied in the first step until selected in the second step.

Here, when the pixel electrodes are arranged in matrix, and pixel electrodes having the same pixel structure are arrayed in the same column, other groups of pixel electrodes different from the specified pixel electrodes may be sequentially selected and charged during the first horizontal scan period, and a pixel electrode among the other groups of pixel electrodes may be selected as the specified pixel electrode in the first step, the pixel electrode being arrayed in a column different from that of pixel electrodes driven at the same timing as timing when the specified pixel electrode is preliminarily charged.

Moreover, the present invention can be also grasped as an invention of an image display device as below.

Specifically, the image display device of the present invention includes: a signal line for supplying a display signal; a plurality of scan lines for supplying scan signals; and plural sets of pixel electrodes, each set being composed of pixel electrodes A and B connected to a common signal line and driven by a combination of selection for two adjacent lines among the scan lines during each horizontal scan period, characterized in that, during a first period in one horizontal scan period, the two adjacent scan lines among the scan lines are selected and one set of the pixel electrodes A and B is driven, and during a second period, one of the two scan lines is selected, the pixel electrode B of the one set of the pixel electrodes is driven, and other two scan lines shifted by two lines from the two scan lines are selected to drive pixel electrodes A and B of another set.

With such a configuration, it is made possible to precharge the pixel electrode A of the other set during the drive of the pixel electrode B.

In this case, it is suitable that the image display device include output buffers connected respectively to input ends of the respective scan lines, that three adjacent output buffers be controlled by control signals different from one another, and that a pulse signal having a time width for four horizontal scan periods be sequentially transmitted to each output buffer for each horizontal scan period.

Furthermore, in this case, it is suitable that the plurality of pixel electrodes be arranged in matrix, that the pixel electrodes A and B of the same set be located in the same row and a drive polarity thereof be inverted, and that drive polarities of the pixel electrodes A or the pixel electrodes B located on rows adjacent to each other be inverted from each other.

Moreover, the present invention can be also grasped as an invention of an image display device as below.

Specifically, the image display device to which the present invention is applied includes: a signal line for supplying a display signal; a plurality of scan lines for supplying scan signals; and plural sets of pixel electrodes, each set being composed of pixel electrodes A, B and C connected to the common signal line and driven by a combination of selection for three adjacent lines among the scan lines during each horizontal scan period, characterized in that, during one horizontal scan period, a first group of scan lines composed of at least two lines among the three adjacent scan lines is selected, and the pixel electrode A among one set of the pixel electrodes is driven, and a second group of scan lines shifted by two lines from the first group of scan lines is simultaneously selected to drive a pixel electrode A of another set.

In this case, it is suitable that output buffers be connected to input ends of the scan lines, respectively, that three adjacent output buffers be controlled by control signals different from one another, and that a signal row composed of a first pulse having a time width for three horizontal scan periods and a second pulse having a time width for one horizontal scan period be sequentially transmitted to each output buffer for each horizontal scan period, the second pulse propagating at an interval for one horizontal scan period from the first pulse.

Moreover, the present invention can be also grasped as an invention of an image display device as below.

Specifically the image display device to which the present invention is applied includes: a signal line for supplying a display signal; a plurality of scan lines for supplying scan signals; and plural sets of pixel electrodes, each set being composed of pixel electrodes A, B and C connected to a same signal line and driven by a combination of selection for three adjacent lines among the scan lines during each horizontal scan period, characterized in that, during one horizontal scan period, a first group of scan lines composed of at least two lines among the three adjacent scan lines is selected, the pixel electrode A among one set of the pixel electrodes is driven, and subsequently, in the three adjacent scan lines, a second group of scan lines different from the first group of scan lines is selected to drive the pixel electrode B of the set of pixel electrodes, and a third group of scan lines shifted by one line from the first group of scan lines is selected to drive a pixel electrode A of another set.

Furthermore, the present invention can be grasped as an invention of an image display device as below. Specifically, the image display device to which the present invention is applied includes: a signal line for supplying a display signal; a plurality of scan lines for supplying scan signals; and plural sets of pixel electrodes, each set being composed of pixel electrodes A and B connected to the common signal line and driven by a combination of selection for two adjacent lines among the scan lines during each horizontal scan period, characterized in that, during one horizontal scan period, a first group of scan lines composed of two adjacent lines among the scan lines is selected to drive one set of the pixel electrodes A and B, and simultaneously, a second group of scan lines shifted by four lines from the first group of scan lines to drive pixel electrodes A and B of another set.

In this case, it is suitable that the plurality of pixel electrodes be arranged in matrix, that the pixel electrodes A and B of the same set be located in the same row, and that a drive polarity thereof be inverted for every two rows. Furthermore, in this case, it is suitable that output buffers be connected to input ends of the scan lines, respectively, that three adjacent output buffers be controlled by control signals different from one another, and that a signal row composed of a first pulse having a time width for two horizontal scan periods and a second pulse having a time width for two horizontal scan period be sequentially transmitted to each output buffer for each horizontal scan period, the second pulse propagating at an interval for two horizontal scan periods from the first pulse.

Moreover, being grasped from another viewpoint, the present invention can be also grasped as an image display device as below. Specifically, the image display device includes: a plurality of scan lines for supplying scan signals; plural systems of output control lines; a plurality of output buffers allocated and connected to systems of the output control lines, respectively; and a control signal output unit for outputting control signals different from one another to the systems of output control lines, respectively.

With such a configuration, signal supply to the plurality of scan lines can be simultaneously controlled, and pixel electrodes driven by a combination of selection for the plurality of scan lines can be readily driven.

In this case, it is suitable that the image display device further include a pulse signal supply unit for sequentially propagating pulse signals having a specified time width to the output buffers, that each pulse signal have a time width of m times (m: natural number) one horizontal scan period, and that the output control lines be in the number of n systems (n: natural number of 2 or more) different from the number of m.

Moreover, the present invention can be also grasped as an invention of a scan line drive circuit as below. Specifically, the scan line drive circuit to which the present invention is applied includes: a plurality of output terminals connectable to a plurality of scan lines, respectively; output circuits connected to the output terminals, respectively; and a control signal generation unit for generating control signals controlling outputs of the output circuits, characterized in that n types (n: natural number of 2 or more) of the control signals are generated, and the n types of control signals are supplied to n pieces of output circuits, respectively.

It is desirable that the scan line drive circuit as described above further include: a plurality of shift registers connected to the output circuits, respectively, and connected one another in a cascaded manner; a clock signal generation unit for generating clock signals driving the plurality of shift registers; and a signal row generation unit for generating signal rows to be sequentially propagated to the plurality of shift registers. While it is suitable that each signal row have a time width of m times (m: natural number) the clock signal, m may be either larger than n or smaller than n.

Particularly, when m is larger than n, the plurality of scan lines can be selected and controlled by means of a relatively small number of control signals.

Hereinafter, description will be made in detail for the present invention based on embodiments shown in the accompanying drawings.

BRIEF DESCRIPTION OF DRAWINGS

FIG. 10 is a drive matrix of the liquid crystal display device of the first embodiment of the present invention.

FIG. 19 is a drive matrix of the liquid crystal display device of the second embodiment of the present invention.

FIG. 27 is a drive matrix of the liquid crystal display device of the third embodiment of the present invention.

FIG. 34 is a drive matrix of the liquid crystal display device of the fourth embodiment of the present invention.

DETAILED DESCRIPTION

Figure 2:
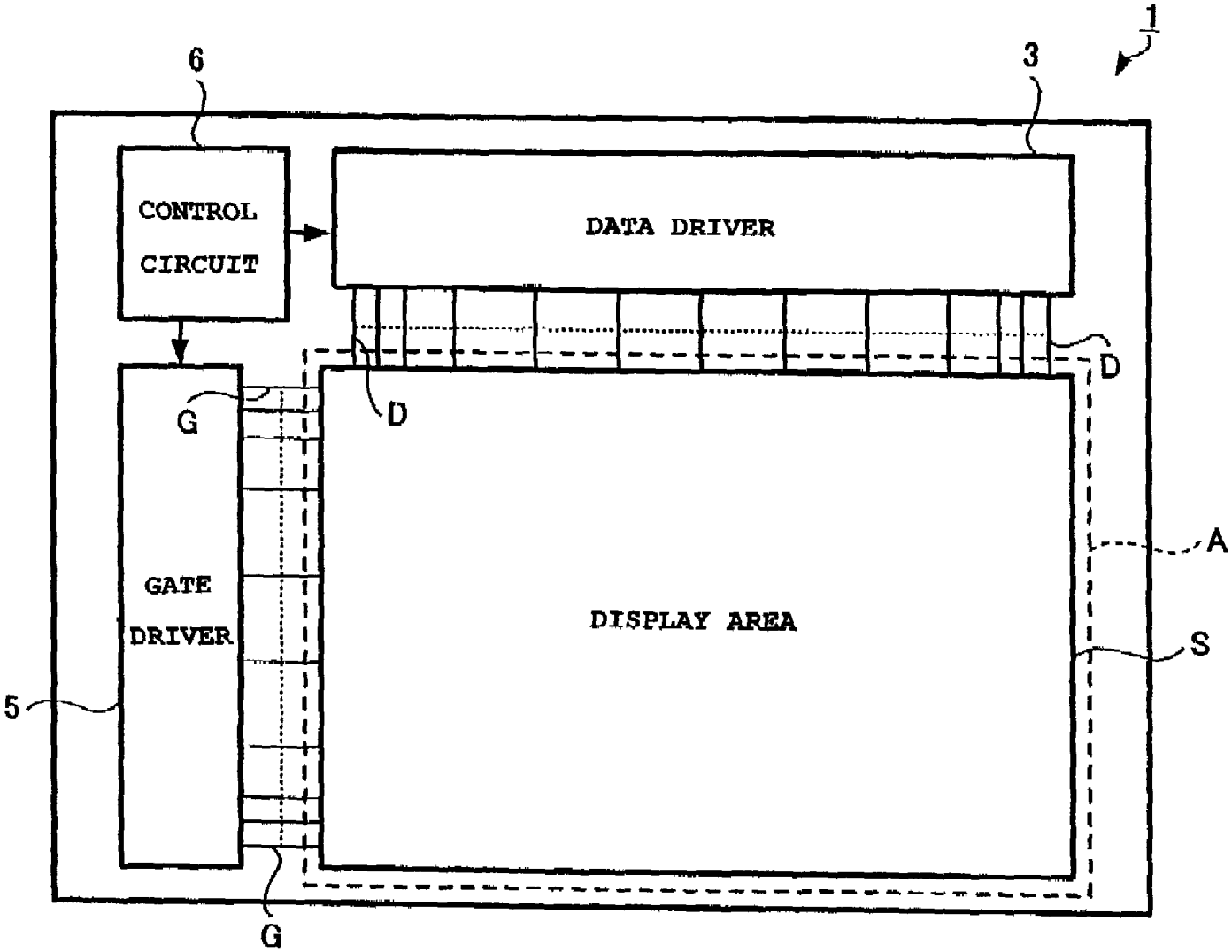
FIG. 2 is a view of an entire configuration of a liquid crystal display device to which the present invention is applied.
Figure 3:
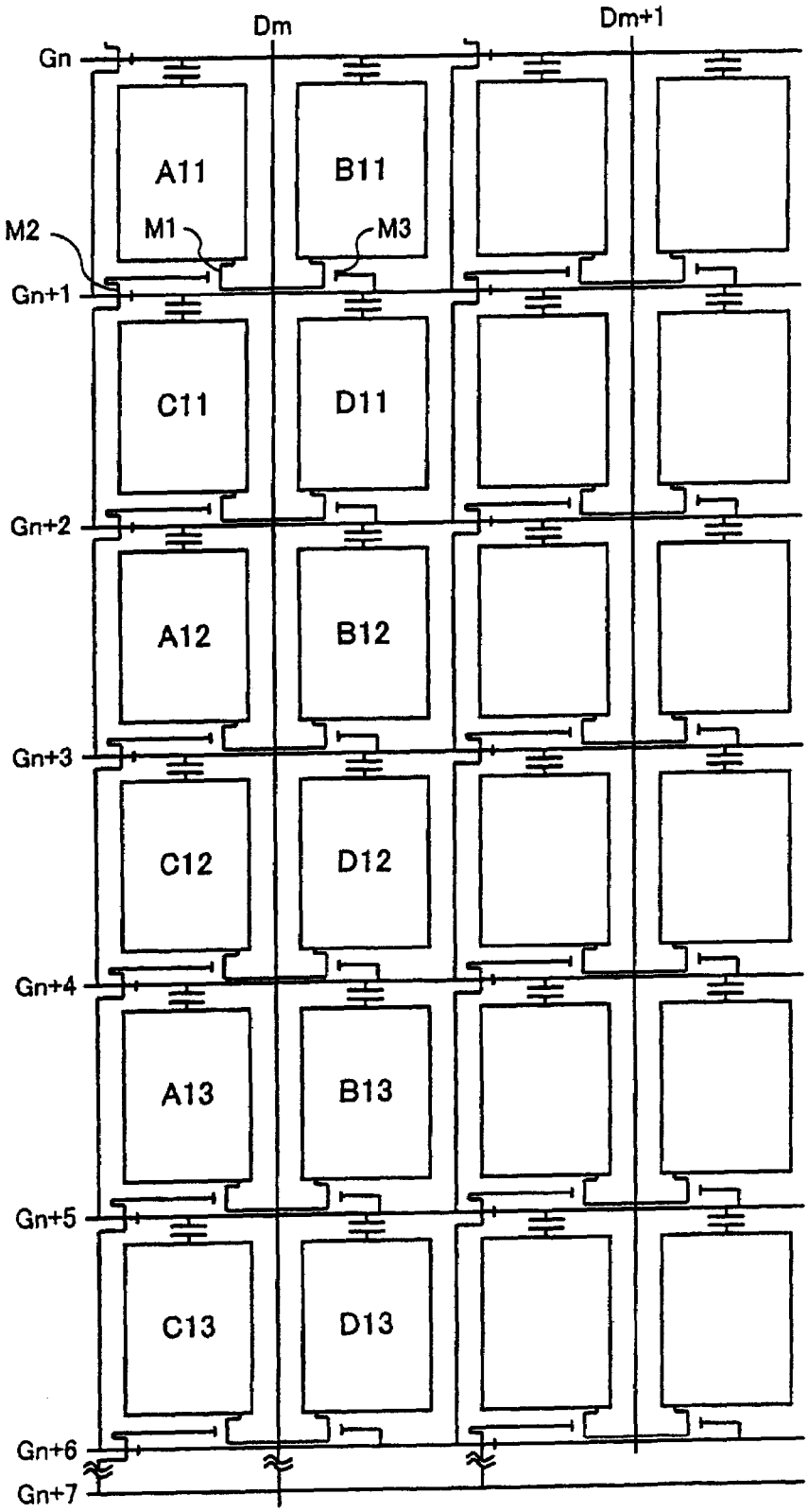
FIG. 3 is a circuit diagram showing a configuration of an array substrate of the liquid crystal display device in the first embodiment of the present invention.
Figure 4:
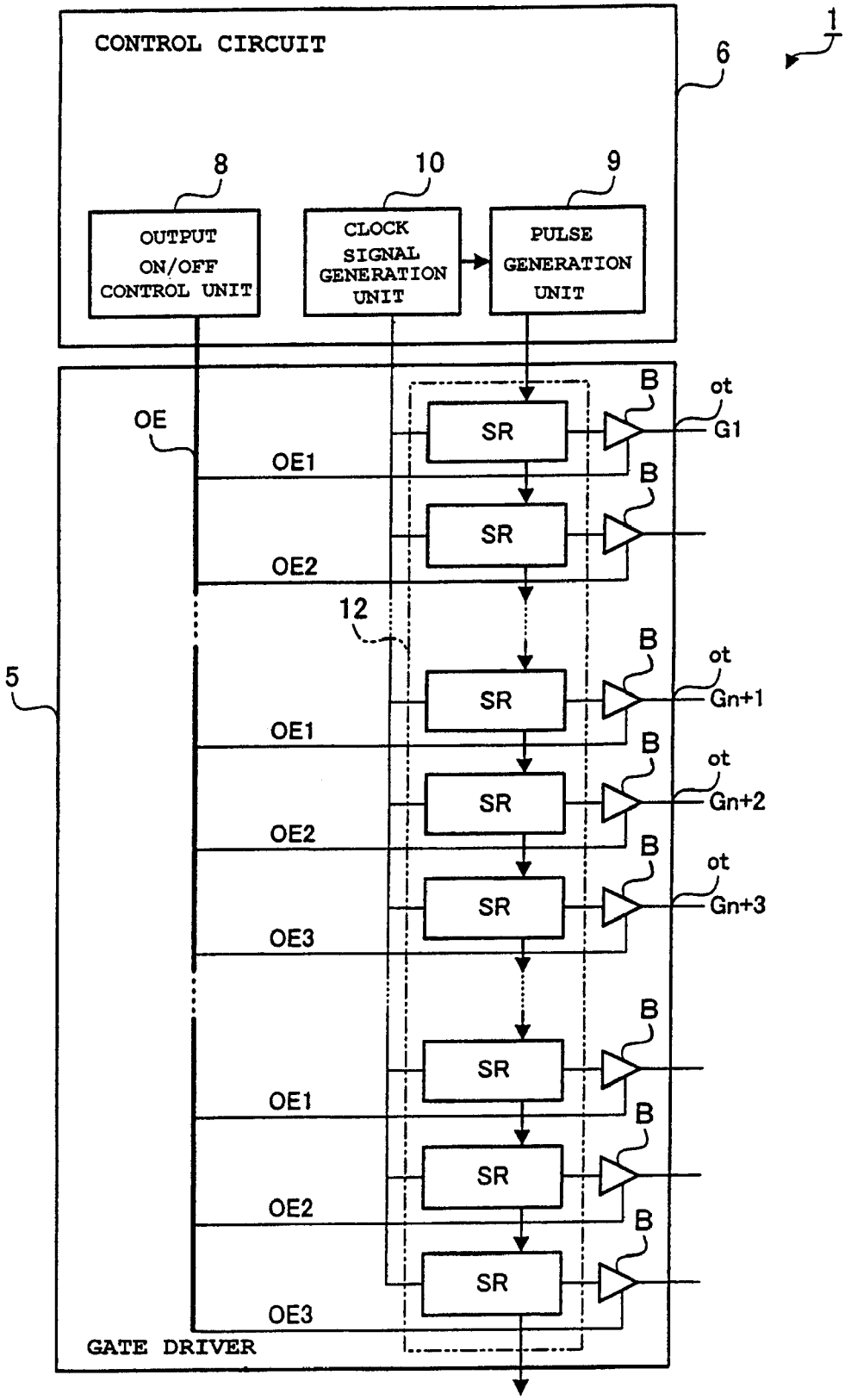
FIG. 4 is a block diagram of control circuit and a gate driver, showing principal portions of the first embodiment of the present invention.

FIG. 2 is a view showing the entire configuration of a liquid crystal display device in one embodiment of the present invention, FIG. 3 is a view showing a configuration of an array substrate, and FIG. 4 is a block diagram showing principal configuration of a gate driver and a control circuit, which are shown in FIG. 2.

The liquid crystal display device according to this first embodiment has a feature in that two adjacent pixels sandwiching one signal line share the signal line to reduce the number of signal lines by half. As a matter of course, the liquid crystal display device must include a color filter substrate facing to the array substrate, a backlight unit and other elements, and however, description thereof will be omitted since these are not characteristic portions of the present invention.

As shown in FIG. 2, a liquid crystal display device (image display device) 1 of this first embodiment includes a display area S for displaying an image on an array substrate A. Moreover, the liquid crystal display device 1 includes a data driver 3 for supplying display signals through signal lines D to pixel electrodes arranged in the display area S, a gate driver (scan line drive circuit) 5 for supplying scan signals controlling ON/OFF of thin film transistors formed in the display area S to the thin film transistors through scan lines G, and a control circuit (scan signal drive circuit) 6 for controlling the data driver 3 and the gate driver 5.

In the display area S, the pixel electrodes are arranged in matrix by the number of M'N (M and N: arbitrary positive integers), and the scan lines G and the signal lines D are provided by a specified number, which corresponds to the number of these pixel electrodes. Hereinafter, among the scan lines G connected to the same gate drivers 5, a scan line G located at the n-th position in a scan direction of a screen will be represented as a scan line Gn, and among the signal lines D connected to the same data driver 3, a signal line D located at the m-th position counting from an input end side of the scan lines G will be represented as a signal line Dm.

Moreover, as shown in FIG. 3, in the display area S of the array substrate A, for adjacent pixel electrodes A11 and B11 sandwiching the signal line Dm, three TFTs that are a first TFT M1, a second TFT M2 and a third TFT M3 are disposed as below.

First, with regard to the first TFT M1, a source electrode is connected to the signal line Dm, and a drain electrode is connected to the pixel electrode A11. Moreover, a gate electrode of the first TFT M1 is connected to a source electrode of the second TFT M2. Here, with regard to the TFT, which is a switching element with three terminals, there is an example, in a liquid crystal display device, where a side (terminal) connected to a signal line is referred to as a source electrode, and a side (terminal) connected to a pixel electrode is referred to as a drain electrode. However, there is also an opposite example. Specifically, determination has not been uniquely made as to which of the two electrodes except the gate electrode is to be referred to as a source electrode, or alternatively, a drain electrode. Accordingly, hereinafter, both of these two electrodes except the gate electrode will be referred to as source/drain electrodes.

With regard to the second TFT M2, one of source/drain electrodes is connected to the gate electrode of the first TFT M1, and the other of the source/drain electrodes is connected to a scan line Gn+2. Accordingly, the gate electrode of the first TFT M1 is connected to the scan line Gn+2 through the second TFT M2. Moreover, a gate electrode of the second TFT M2 is connected to a scan line Gn+1. Accordingly, only during a period when the two adjacent scan lines Gn+1 and Gn+2 are simultaneously set at a selection potential, the first TFT M1 is turned on, and a potential of the signal line Dm is supplied to the pixel electrode A11. This suggests that the second TFT M2 controls ON/OFF of the first TFT M1.

With regard to the third TFT M3, one of source/drain electrodes is connected to the signal line Dm, and the other of the source/drain electrodes is connected to the pixel electrode B11. Moreover, a gate electrode of the third TFT M3 is connected to the scan line Gn+1. Accordingly, when the scan line Gn+1 is at a selection potential, the third TFT M3 is turned on, and the potential of the signal line Dm is supplied to the pixel electrode B11.

While description has been made in the above for the circuit configuration of the array substrate A seen from the first TFT M1 to the third TFT M3, description will be made for the circuit configuration of the array substrate A seen from the pixel electrode A11 and the pixel electrode B11. The pixel electrode A11 and the pixel electrode B11 are supplied with display signals from the single signal line Dm. Specifically, the signal line Dm can be said to be a common signal line to the pixel electrode A11 and the pixel electrode B11. Accordingly, for the pixels arranged in M'N matrix, the number of the signal lines Dm will be M/2.

To the pixel electrode A11, the first TFT M1 and the second TFT M2 are connected. Moreover, the first TFT M1 is connected to the signal line Dm and the second TFT M2. The gate electrode of the second TFT M2 is connected to the scan line Gn+1 on a later stage than the pixel electrode A11. Moreover, the drain electrode of the second TFT M2 is connected to the scan line Gn+2 on a later stage than the scan line Gn+1. Here, in order to supply the potential of the signal line Dm to the pixel electrode A11, it is necessary to turn on the first TFT M1. Moreover, the gate electrode of the first TFT M1 is connected to one of the source/drain electrodes of the second TFT M2, the gate electrode of the second TFT M2 is connected to the scan line Gn+1 of its own, and the other of the source/drain electrodes thereof is connected to the scan line Gn+2 on the later stage. Therefore, it is necessary to turn on the second TFT M2 in order to turn on the first TFT M1. In order to turn on the second TFT M2, it is necessary that both of the scan line Gn+1 and the scan line Gn+2 be selected. Accordingly, the first TFT M1 and the second TFT M2 constitute a switching mechanism allowing passage of the scan signal when both of the scan line Gn+1 and the scan line Gn+2 are selected. In such a manner as described above, the pixel electrode A11 is driven based on the scan signal from the scan line Gn+1 and the scan signal from the scan line Gn+2 to receive the potential from the signal line Dm.

To the pixel electrode B11, the third TFT M3 is connected, of which gate electrode is connected to the scan line Gn+1. Accordingly, the pixel electrode B11 is supplied with the potential from the signal line Dm when the scan line Gn+1 of its own is selected.

Description has been made in the above for the pixel electrode A11 and the pixel electrode B11. Also with regard to other pixels (pixel electrodes) shown in FIG. 3, which are a pixel electrode C11 and a pixel electrode D11, pixel electrodes A12, B12, C12 and D12, pixel electrodes A13, B13, C13 and D13, and other pixels, a similar configuration is adopted.

Next, description will be made for configurations of the gate driver 5 and the control circuit 6 with reference to FIG. 4.

As shown in FIG. 4, the control circuit 6 is provided with an output on/off control unit 8, a pulse generation unit (signal row generation unit) 9 and a clock signal generation unit 10. As will be described later, the output on/off control unit 8 outputs output control signals to the gate driver 5 through, in total, three systems of output control lines OE composed of output control lines OE1, OE2 and OE3. The pulse generation unit 9 generates scan signals to be inputted from the gate driver 5 to the scan lines G, that is, shift pulses. In addition, the clock signal generation unit 10 outputs clock signals for driving the gate driver 5.

In the gate driver 5, a shift register unit 12 is provided, to which the output control signals, the shift pulses and the clock signals are inputted. The shift register unit 12 is formed by connecting shift registers SR to one another in a cascaded manner, the shift registers SR being provided by the same number as that of the scan lines G. Here, the shift registers SR are provided corresponding to the respective scan lines G, and are connected to output terminals Ot connectable to the scan lines G through buffers (output circuits) B. Thus, control of the buffers B enables to control the output of data in the shift registers SR to the scan lines G to be controlled.

To the buffers B, the output control lines OE are connected. The buffers B are turned on when the output control signals inputted thereto through the output control lines OE are "0". Moreover, the buffers B are turned off when the output control signals are "1". Thus, control is made for the output selection of the scan signals from the shift registers SR to the scan lines G. Note that, while the plurality of buffers B are arrayed corresponding to the scan lines G, the output control lines OE1, OE2 and OE3 are sequentially allocated and connected to every three buffers B adjacent to one another. Accordingly, the output on/off control unit 8 outputs output control signals different from one another to these output control lines OE1, OE2 and OE3, thus making it possible to individually control the three buffers B adjacent from one another.

Next, description will be made for an operation of this liquid crystal display device 1 with reference to a timing chart of scan signals shown in FIG. 1 and circuit diagrams shown in FIGS. 5 to 9.

In order to solve the shortage of the charge amount to the pixels, the liquid crystal display device 1 operates such that, before a display signal voltage to be maintained by a pixel during one horizontal scan period of the screen is written to the pixel, another display signal voltage is written thereto preliminarily. For this purpose, when a specified display signal voltage is applied to a certain pixel, the specified display signal voltage is simultaneously written to a pixel at a stage later than the concerned pixel, that is, another pixel to be charged later than the concerned pixel. Thus, when a display signal voltage is actually applied to the pixel at the later stage, the pixel is set in a state of being already charged with the specified voltage.

Hereinafter, description will be made concretely for a pixel drive method and a preliminary drive method (precharge method) before an actual pixel drive.

Figure 1:
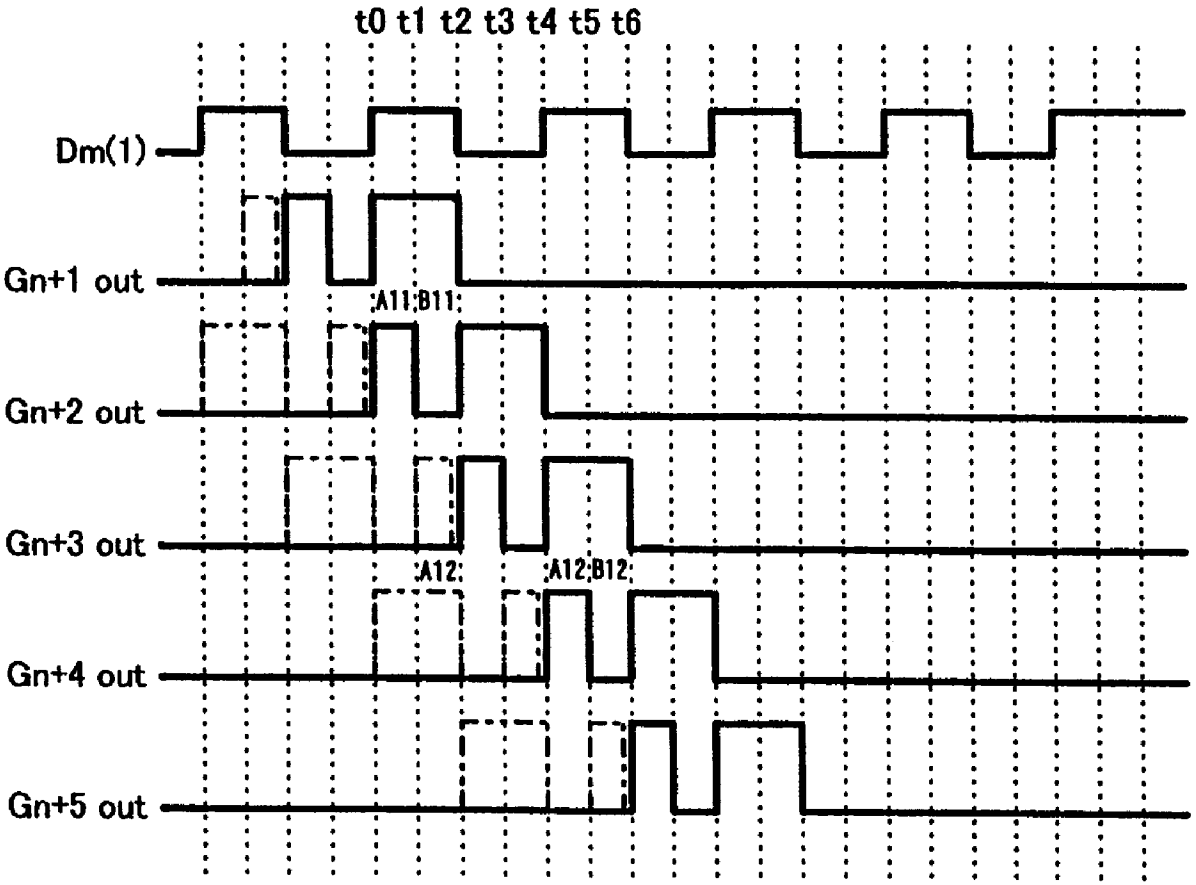
FIG. 1 is a timing chart of a display signal and scan signals, schematically showing a first embodiment of the present invention.

In FIG. 1, diagrams Gn+1 out to Gn+5 out represent waveforms of scan signals outputted to the scan lines Gn+1 to Gn+5, which are generated by shift pulses propagating to the shift registers SR. Specifically, at timing when a portion represented by each solid line or chain line in these diagrams rises, the relevant scan line G is selected, and at timing when the portion does not rise, the relevant scan line G is not selected. Note that, among the rising portions of these diagrams, the portions represented by the solid lines indicate timing when the display signal voltages to be maintained in one horizontal scan period by pixel electrodes are written thereto. Moreover, the portions represented by the chain lines indicate timing when display signal voltages are preliminarily written to the pixel electrodes in order to compensate the shortage of the display signal voltages before the display signal voltages are written thereto. Specifically, the portions represented by the chain lines indicate the timing of precharge.

Moreover, Dm(1) shown in FIG. 1 indicates a potential of a data signal supplied from the signal line Dm, which indicates timing when the data signal is changed. Here, Dm(1) shown here includes a change in polarity. As will be described later, the pixel electrode A11 is set at the same polarity as that of the pixel electrode B11 by the potential supplied from the signal line Dm, and is driven in a polarity different from that of the pixel electrodes C11 and D11.

First, description will be made for a procedure for writing, to a pixel, a display signal voltage to be maintained by the pixel.

Figure 5:
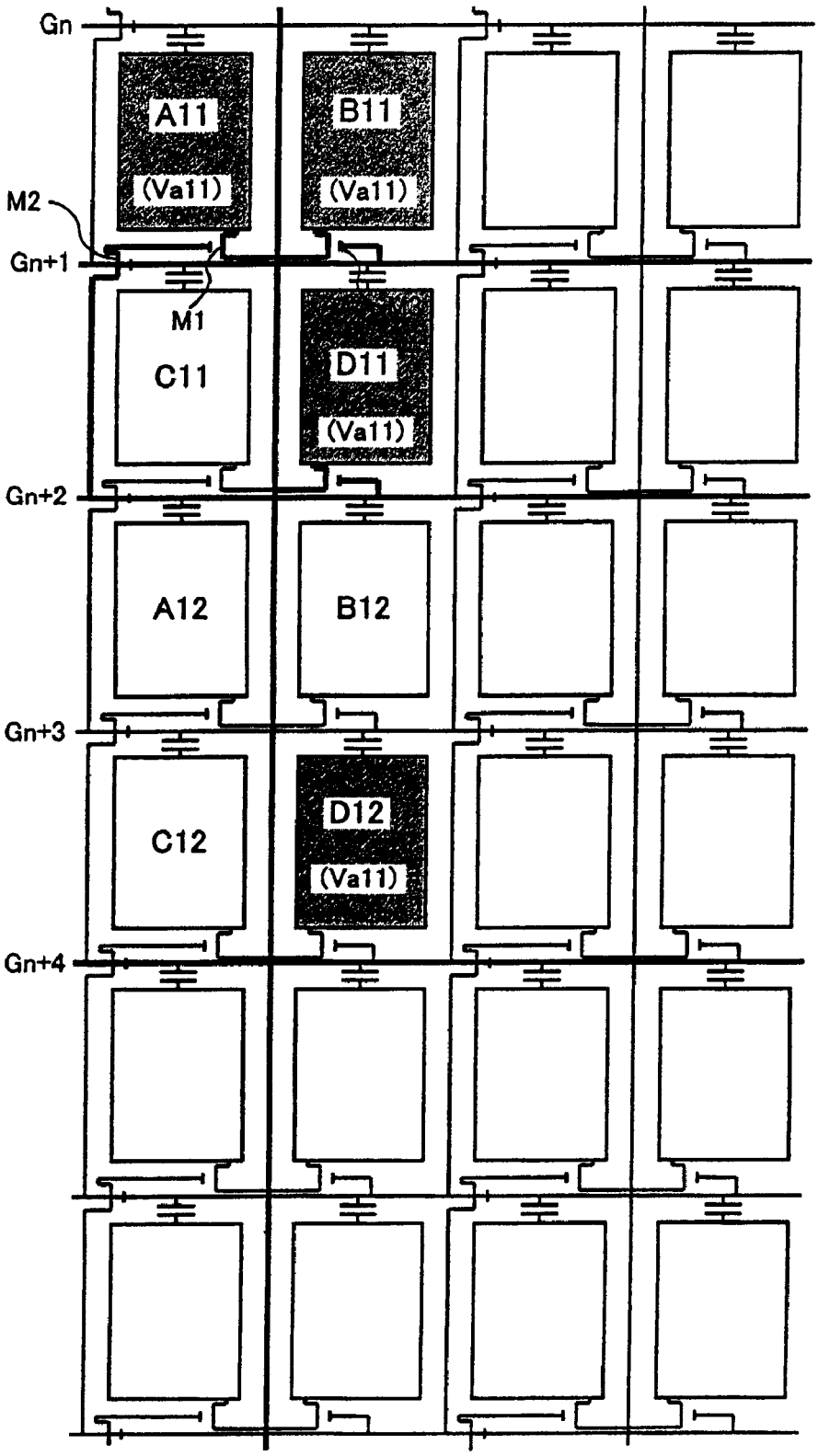
FIG. 5 is a view showing an operation of a circuit of the liquid crystal display device of the first embodiment of the present invention.

As shown in FIG. 1, when the scan signals Gn+1 out and Gn+2 out are generated, if attention is paid to portions represented by the solid lines among the scan signals Gn+1 out and Gn+2 out, that is, timing when the display signal voltages are written to the pixels, then both of the scan lines Gn+1 and Gn+2 (first group of scan lines) are selected during a period from time t0 to time t1 (first timing, first period). Therefore, as shown in FIG. 5, the first to third TFTs M1 to M3 are turned on. Thus, a potential Va11 to be applied to the pixel electrode A11 from the signal line Dm is supplied to the pixel electrodes A11, B11 and D11, and the potential Va11 of the pixel electrode A11 is determined. Note that, in FIG. 5, the selection of the scan lines Gn+1 and Gn+2 is represented by bold lines.

Figure 6:
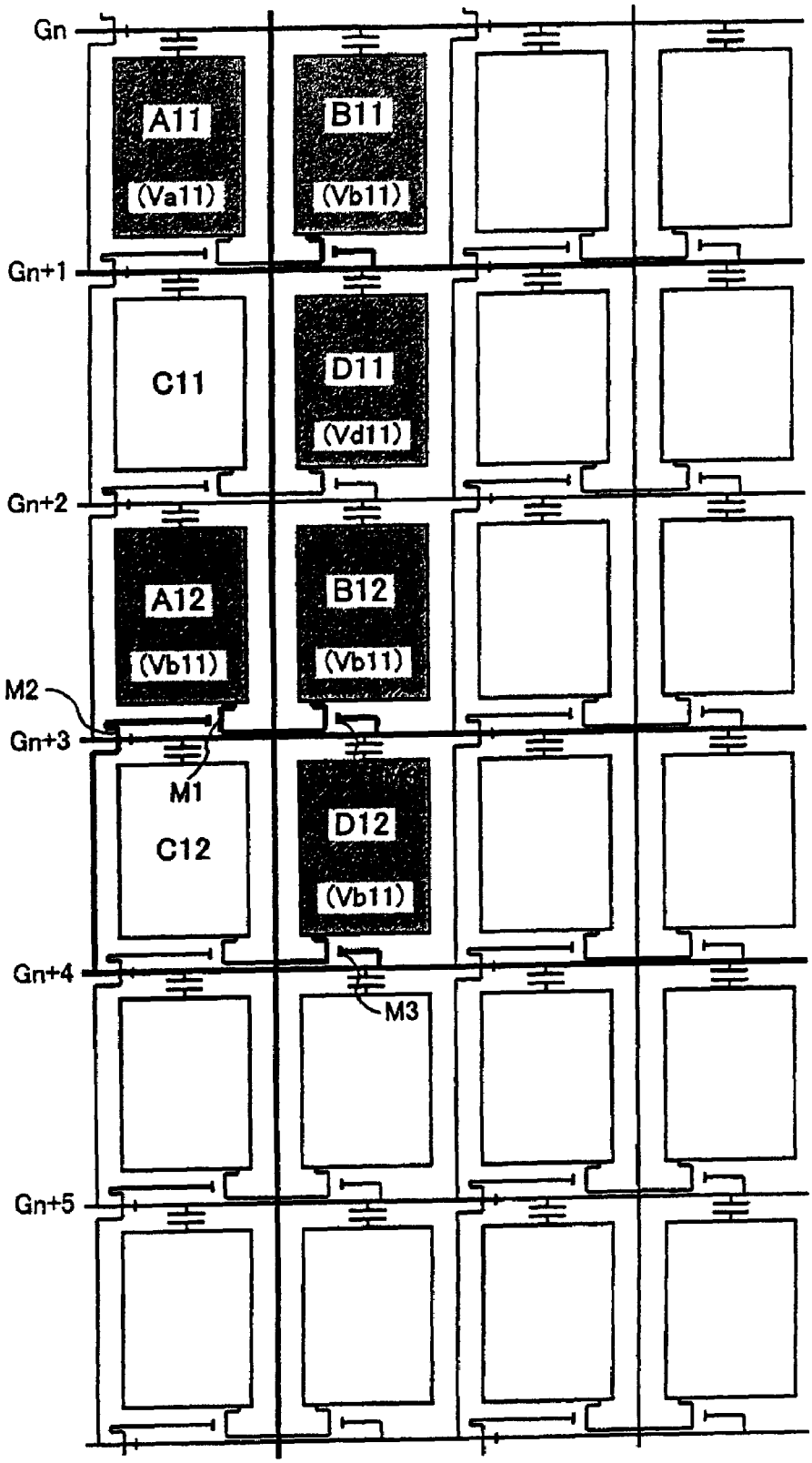
FIG. 6 is a view showing an operation of the circuit of the liquid crystal display device of the first embodiment of the present invention, showing a next step of FIG. 5.

Meanwhile, during the following period from time t1 to time t2 (second timing, second period), the scan line Gn+2 is set at the non-selection potential, and only the scan line Gn+1 is selected. Accordingly, as shown in FIG. 6, only the third TFT M3 is turned on. Here, the potential supplied from the signal line Dm is changed to a potential Vb11 to be applied to the pixel electrode B11, and thus the potential Vb11 is supplied to the pixel electrode B11 to determine the potential of the pixel electrode B11.

Note that a period from time t0 to time t2 corresponds to one horizontal scan period (first horizontal scan period). The pixel drive as described above is carried out during this period, and thus the potential of the signal line Dm can be supplied to the pixel electrodes A11 and B11 (first group of pixel electrodes) by time division.

After the scan line Gn+1 is set at a non-selection potential, as shown in FIG. 1, the polarity of the potential of the signal line Dm is inverted, and the potential is changed to a potential Vc11 to be applied to the pixel electrode C11.

Figure 7:
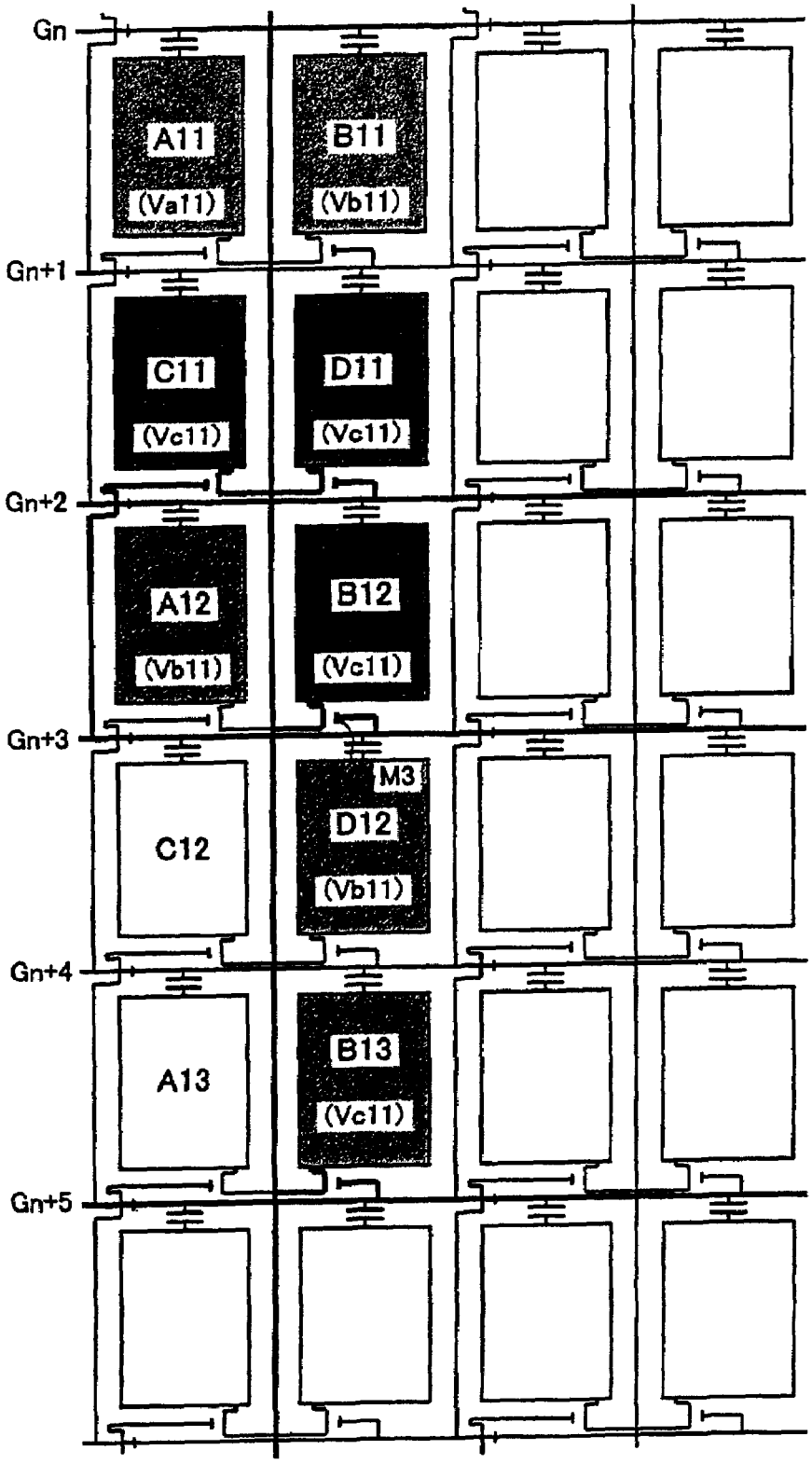
FIG. 7 is a view showing an operation of the circuit of the liquid crystal display device of the first embodiment of the present invention, showing a next step of FIG. 6.

Here, in FIG. 1, when attention is paid to the scan signals Gn+2 out and Gn+3 out, both of the scan lines Gn+2 and Gn+3 are selected during a period from time t2 to time t3 (first timing). Thus, as shown in FIG. 7, the potential Vc11 to be applied from the signal line Dm to the pixel electrode C11 is supplied to the pixel electrodes C11, D11 and B12, and the potential Vc11 of the pixel electrode C11 is determined.

Figure 8:
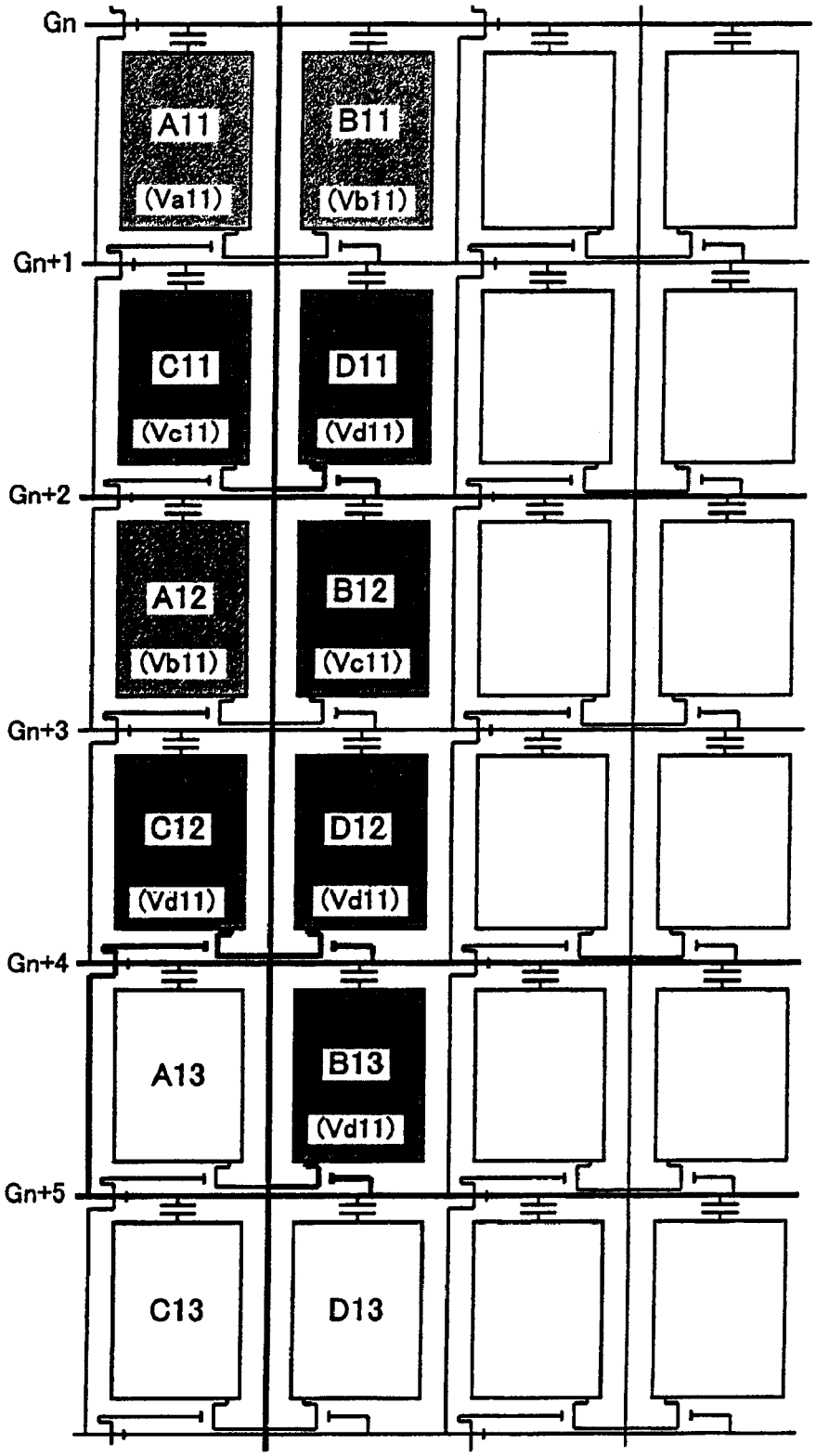
FIG. 8 is a view showing an operation of the circuit of the liquid crystal display device of the first embodiment of the present invention, showing a next step of FIG. 7.

In addition, during the following period from time t3 to time t4 (second timing), the scan line Gn+3 is set at the non-selection potential, and only the scan line Gn+2 is selected. Therefore, as shown in FIG. 8, the potential supplied from the signal line Dm is changed to a potential Vd11 to be applied to the pixel electrode D11, and thus a potential Vd11 is supplied to the pixel electrode D11 to determine the potential of the pixel electrode D11.

In this case, the potentials Va11 and Vb11 supplied to the pixel electrodes A11 and B11 are reverse in polarity to the potentials Vc11 and Vd11 supplied to the pixel electrodes C11 and D11. Accordingly, the liquid crystal display device 1 is driven as a display device of a line inversion drive, in which the polarity is inverted for every row.

Next, description will be made for the precharge method of pixels.

As described above, the precharge of pixels is carried out by supplying a display signal voltage to a pixel electrode at a stage later than that of a certain pixel electrode simultaneously when the certain pixel electrode is applied with the display signal voltage and charged. Here, the pixel electrode at a later stage is the one selected by a scan line G having a larger value of n. Hereinafter, application of a display signal voltage to be maintained by a pixel electrode to charge the pixel electrode will be simply referred to as "charge", and application of another display signal voltage to charge a pixel before application of the display signal voltage to be maintained by the pixel will be referred to as "precharge".

Here, it is desirable that a pixel electrode Y precharged simultaneously when a certain pixel electrode X is charged have relations as the following A and B to the pixel electrode X.

A: During a period from precharge to charge of the pixel electrode Y, the pixel electrode Y is not charged simultaneously while other pixel electrodes than the pixel electrodes X and Y are being charged; and B: The charged pixel electrodes Y and X have the same polarity, and selection timings (charged timings) thereof are proximate to each other.

In this first embodiment, as a precharge method meeting the above conditions A and B, for example, a mode is employed, in which the pixel electrode A12 (specified pixel electrode) at the second later stage is selected when the pixel electrode B11 shown in FIG. 3 is charged.

Figure 9:
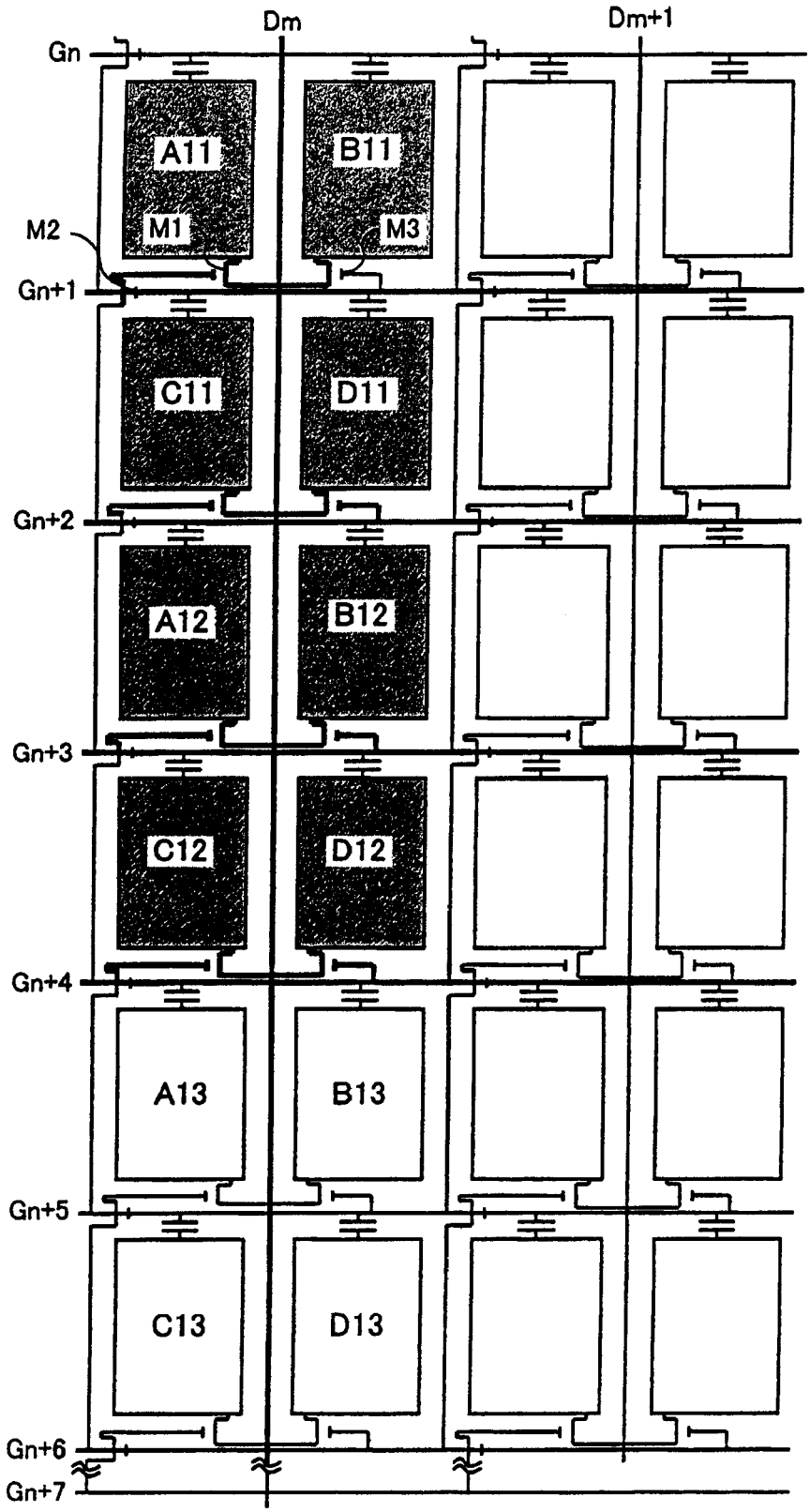
FIG. 9 is a circuit operational view for explaining selection logic of the liquid crystal display device of the first embodiment of the present invention.

Here, description will be made for the reason of not precharging the pixel electrode A12 that is proximate to the pixel electrode A11 and has the same polarity when the pixel electrode A11 is charged. Assuming that the pixel electrode A12 is precharged, then, as shown in FIG. 9, it is necessary to select the scan lines Gn+3 and Gn+4 selecting the same. In this case, the scan lines Gn+2 and Gn+3 are simultaneously selected, and thus the pixel electrode C11 is driven inversely in polarity.

Specifically, if the precharge method as described above is employed, in the case of conceiving pixel electrodes located in rows adjacent to each other and in the same column, when an upper pixel electrode is charged, a lower pixel electrode is also charged. Accordingly, when the pixel electrode C11 is charged after the pixel electrode A12 is precharged during the charge of the pixel electrode A11, the pixel electrode A12 is precharged again in polarity inverse to that of a voltage to be charged thereto, which will contradict to the above-described condition B.

Concretely, in order to precharge the pixel electrode A12 during the charge of the pixel electrode B11, as shown by the chain lines in FIG. 1, the potentials of the scan signals Gn+3 out and Gn+4 out are raised during the period from time t1 to time t2. Thus, the scan lines Gn+3 and Gn+4 selecting the pixel electrode A12 are selected, and the first and second TFTs M1 and M2 controlling the supply of the display signal to the pixel electrode A12 are turned on. Accordingly, the same display signal as the display signal supplied to the pixel electrode B11 is supplied from the signal line Dm to the pixel electrode A12, to which the potential Vb11 is applied. Therefore, the pixel electrode A12 is precharged in the same polarity as that of the pixel electrode B12.

Note that, in this case, the scan line Gn+3 is selected, and thus the third TFT M3 controlling the supply of the display signal from the signal line Dm to the pixel electrode B12 is turned on. In addition, a scan line Gn+4 is selected, and thus a third TFT M3 controlling a supply of a display signal from the signal line Dm to a pixel electrode D12 is turned on. Accordingly, the potential Vb11 is also applied to these pixel electrodes B12 and D12.

Thereafter, during the period from time t2 to time t3, as shown in FIG. 1, any of the scan lines G is not selected for the precharge. Accordingly, as shown in FIG. 7, the potential Vb11 is maintained in the pixel electrodes A12 and D12. However, as described above, the selection of the scan line Gn+3 turns on the third TFT M3 connected to the pixel electrode B12, and thus the pixel electrode B12 is set at the potential Vc11, which is the same as that of the pixel electrode C11.

Next, during the period from time t3 to time t4 while the pixel electrode D11 is being charged, as shown by chain lines in FIG. 1, potentials of scan signals Gn+4 out and Gn+5 out rise, and thus scan signal lines Gn+4 and Gn+5 are selected. Thus, first, second and third TFTs M1, M2 and M3 controlling a supply of display signals to the pixel electrodes C12, D12 and B13 are turned on. Then, as shown in FIG. 8, the display signals are supplied from the signal line Dm to the pixel electrodes C12, D12 and B13, and thus a potential Vd11 that is the same as that of the pixel electrode D11 is applied to the pixel electrodes C12, D12 and B13. Accordingly, the pixel electrode C12 can be precharged with the potential of the same polarity as that of the pixel electrode D11.

The precharge is carried out for the pixel electrodes on the later stage of the pixel electrodes to be charged by iterating the similar procedure on and after.

Note that, accompanied with such precharge, as shown in FIG. 1, the scan line Gn+4 is selected during the period from time t0 to time t1. Thus, as shown in FIG. 5, the pixel electrode D12 is driven and charged with the potential Va11. In addition, as shown in FIG. 1, the scan line Gn+5 is selected during the period from time t2 to time t3. Thus, as shown in FIG. 7, the pixel electrode B13 is driven and charged with the potential Vc11.

Moreover, such precharge method is shown in matrix in FIG. 10. In the matrix of FIG. 10, columns denoted by codes A and B indicate timing when the pixel electrodes A11, A12 . . . and B11, B12 . . . are driven, respectively. In addition, rows denoted by codes g(n+1), g(n+2) . . . represent the scan lines G(n+1), G(n+2) . . . . Moreover, items of the matrix indicate, by the presence of hatchings, as to whether or not the scan lines G(n+1), G(n+2) . . . are selected at timing when the pixel electrodes A11, A12 . . . and B11, B12 . . . are driven. For example, a hatching at row 1 column 1 of this matrix indicates that the scan line G(n+1) is selected at the timing when the pixel electrode A11 is driven.

In addition, a letter of A or B displayed in each item of the matrix indicates that any of the pixel electrodes A11, A12 . . . and B11, B12 . . . is driven by selecting one corresponding to the item from the scan lines G(n+1), G(n+2) . . . . For example, the letters "A" are displayed in row 1 column 1 and in row 2 column 1 in the matrix. Thus, indicated is that the pixel electrode A11 is driven by simultaneously selecting the scan lines G(n+1) and G(n+2) at the timing when the pixel electrodes A11, A12 . . . are driven. In addition, letters of "P" displayed in the items indicate whether or not the drive of the pixel electrodes is for the precharge.

Furthermore, a code "+" or "−" shown in each item of the matrix indicates a drive polarity of each of the pixel electrodes A11, A12 . . . or B11, B12 . . . located between each of the scan lines G(n), G(n+1) . . . corresponding to the concerned item and each of the scan lines G(n+1), G(n+2) . . . of the first lower stage of the corresponding scan line.

According to this matrix, it is understood that, when the pixel electrode B11 is driven by selecting the scan line G(n+1), the scan lines G(n+3) and G(n+4) are driven, and the pixel electrode A12 at the second lower stage is precharged.

In such precharge method, attention is paid to the scan signals Gn+3 out and Gn+4 out shown in FIG. 1. Then, during the period from time t1 to time t2 (first timing), the pixel electrode A12 (specified pixel electrode) is precharged by selecting the scan lines Gn+3 and Gn+4 (specified scan lines). Thereafter, before both of the scan lines Gn+3 and Gn+4 (second group of scan lines) are selected during the period from time t4 to time t5 (first time of the second timing) in the period during time t4 to time t6 while the pixel electrodes A12 and B12 (second group of pixel electrodes) are being sequentially driven to charge the pixel electrode A12, at least any one of the scan lines Gn+3 and Gn+4 is not selected during the drive of other pixel electrodes. Specifically, signals different from those during the charge are outputted to the scan lines Gn+3 and Gn+1. Accordingly, the pixel electrode A12 is not precharged again until being charged during the period from time t4 to time t5 after being precharged during the period from time t1 to time t2, in which the above-described condition B is met by carrying out the precharge as described above. The same is also established for other pixel electrodes arrayed in the same rows as those of the pixel electrodes C12 and A13.

Next, description will be made for a control method of the gate driver 5, which is capable of charging and precharging the pixel electrode as described above.

Figure 11:
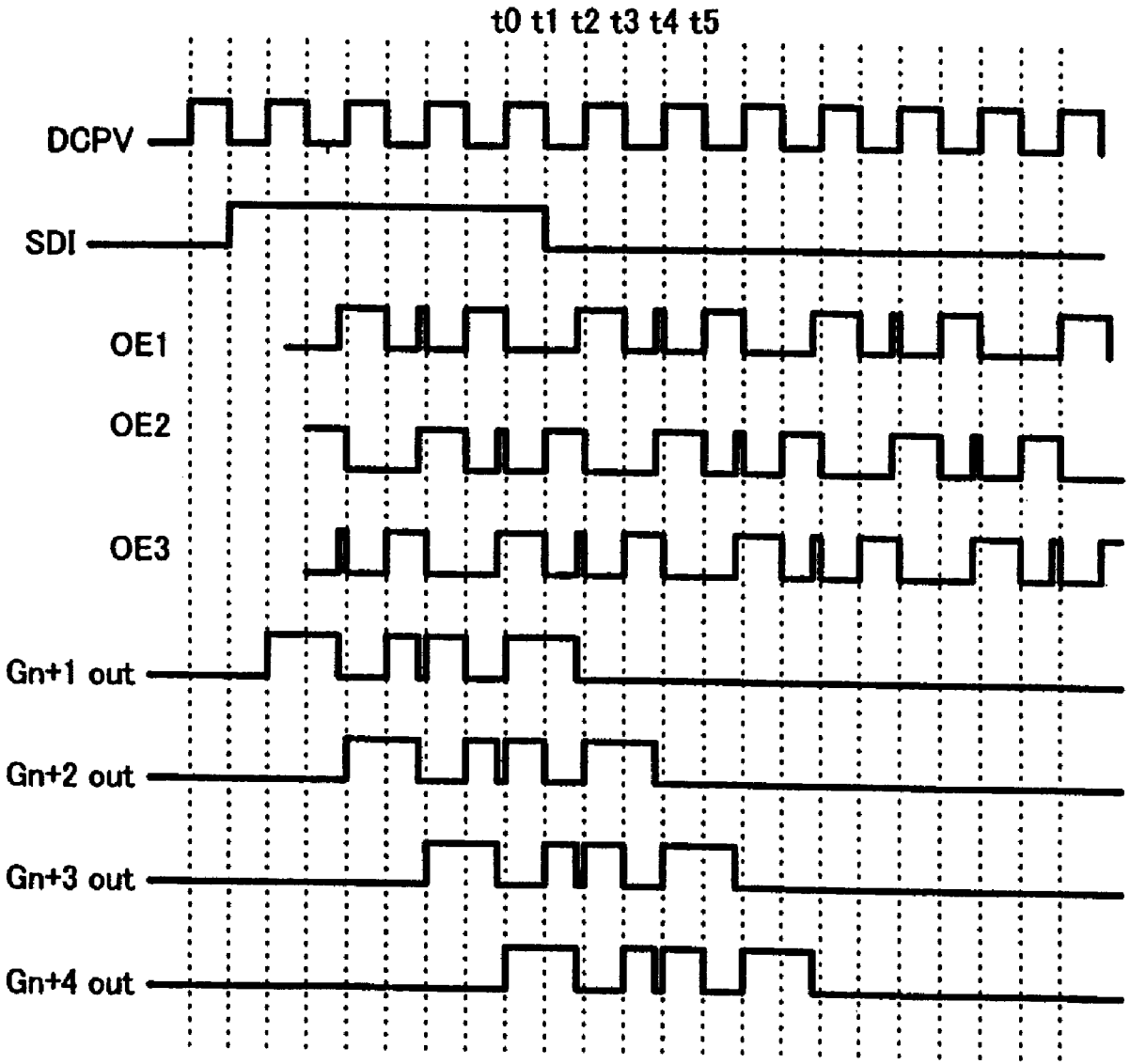
FIG. 11 is a timing chart of a clock signal, a shift pulse and scan signals of the first embodiment of the present invention.

FIG. 11 is a timing chart showing a relation among the scan signals Gn+1 out to Gn+4 out supplied to the scan lines Gn+1 to Gn+4, a shift pulse (signal column) SDI outputted to the shift register SR and the output control signals OE1 to OE3, both of which correspond to the above-described scan signals, and a clock signal DCPV driving the shift registers SR. Note that, in FIG. 11, the portions where the potentials rise for the precharge among the scan signals Gn+1 out to Gn+4 out are also represented by solid lines.

As shown in the drawing, a time width from rise to fall of the shift pulse SDI is equal to four cycles of the clock signal DCPV. This shift pulse SDI moves to the next shift register SR for one cycle of the clock signal DCPV synchronously with the rise of the clock signal DCPV. Therefore, by providing, to the shift pulse SDI, the time width for the four cycles of the clock signal DCPV, as shown in the drawing, the four scan lines G, that is, the scan lines Gn+1 to Gn+4 can be simultaneously selected. Note that one cycle of the clock signal DCPV is equal to one horizontal scan period. Accordingly, the time width of the shift pulse SDI is four times the horizontal scan period.

It is conceived that four systems of the output control lines OE are required for simultaneously selecting the four scan lines Gn+1 to Gn+4. However, in this first embodiment, the output control signals OE1 to OE3 as shown in FIG. 11 are employed, and thus, by the three systems of the output control lines OE, four scan lines G can be simultaneously selected. Specifically, this first embodiment adopts the charge and precharge method as shown by the matrix of FIG. 10. In the matrix of FIG. 10, the selection/non-selection of the scan lines G(n+1) and G(n+4), which are indicated in the rows represented by the codes g(n+1) and g(n+4), are the same at any timing of A and B. Specifically, the output control signal to be supplied to the buffer B connected to the scan line Gn+1 and the output control signal to be supplied to the buffer B connected to the scan line Gn+4 can be made the same signal. Similarly, also to the buffers B connected to the scan lines Gn+2 and Gn+5, Gn+3 and Gn+6 . . . , the same output control signals can be supplied, respectively. Accordingly, the three systems of the output control lines OE are sufficient.

As described above, in this first embodiment, while the conditions necessary for the precharge being satisfied, the charge and precharge for the pixel electrodes having the multiplexed pixel structure can be carried out, and thus the highly defined liquid crystal display device 1 can be driven accurately.

Moreover, in this precharge method, the pixel electrode A12 in the different column is precharged when the pixel electrode B11 is charged. As described above, among the pixel electrodes including those in the columns different from that of the pixel electrode to be charged, the pixel electrodes meeting the above-described conditions A and B are selected. Thus, in comparison with the case of selecting the pixel electrodes meeting the above-described conditions A and B only among the pixel electrodes located in the same column, the selection range is expanded. Accordingly, the interval between the column where the pixel electrode to be charged is present and the column where the pixel electrode to be precharged simultaneously therewith can be narrowed. Thus, the time interval from the precharge to the charge can be shortened to make it possible to minimize an influence thereof to pixels other than the display pixels.

In addition, in this first embodiment, the shift pulse SDI having the time width for the four cycles of the clock signals DCPV (four times the horizontal scan period) can be controlled by the three systems of the output control lines OE. Specifically, since the selection control for the four scan lines G can be made by the three systems of the out-put control lines OE, which is smaller in number, the selection control for the scan lines G can be carried out by the control signals smaller in number than the scan lines G to be simultaneously controlled. Thus, the number of the output control lines OE can be reduced, thus making it possible to achieve a cost reduction and facilitation of circuitry design.

Figure 12:
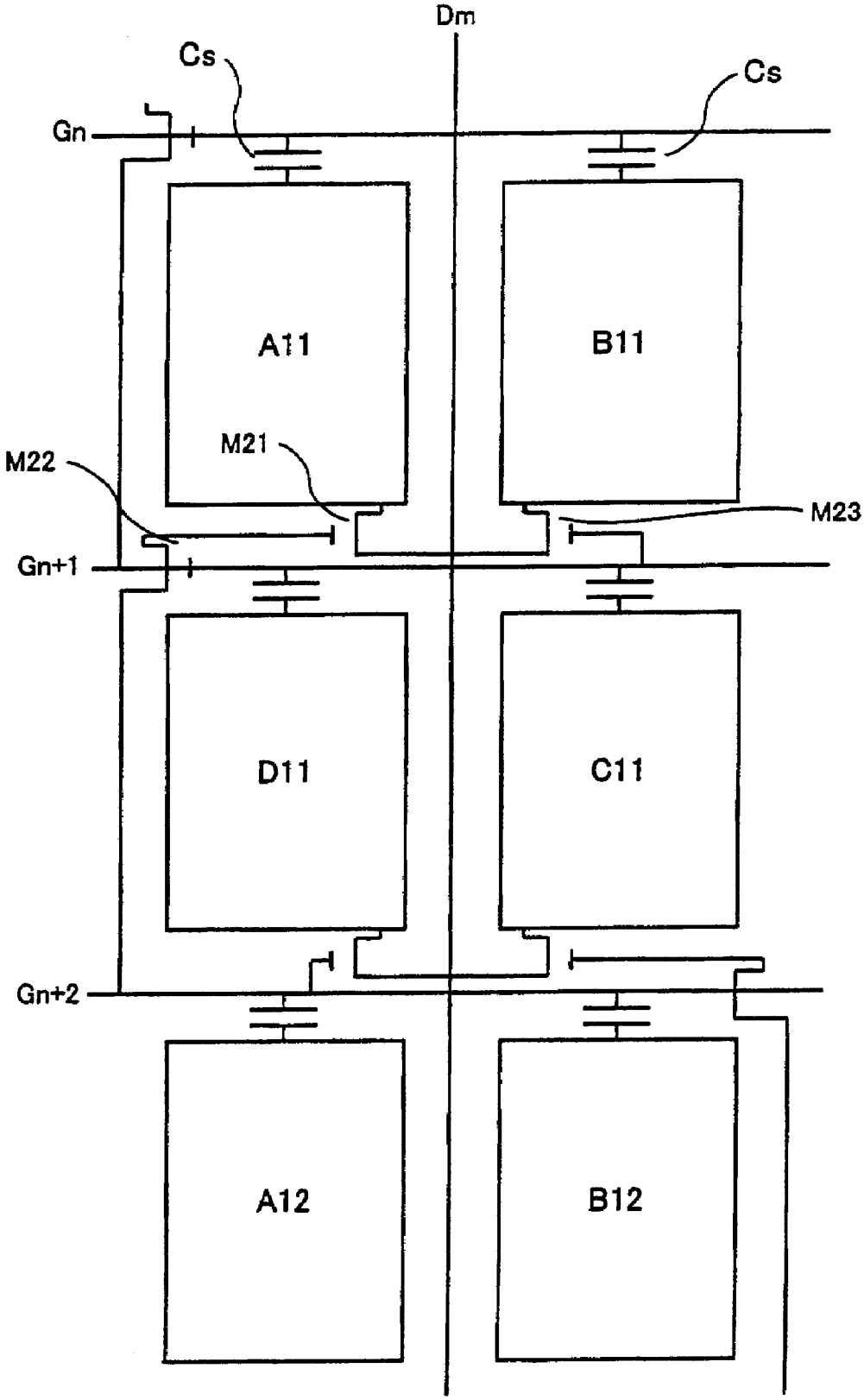
FIG. 12 is a view showing another circuit configuration of the array substrate of the first embodiment of the present invention.

Note that, though the array substrate A is configured as shown in FIG. 3 in this first embodiment, a circuit configuration as shown in FIG. 12 can be employed instead thereof.

SECOND EMBODIMENT

Next, description will be made for a second embodiment of the present invention.

Since the entire configuration of a liquid crystal display device 1 in this second embodiment is similar to that of the first embodiment, here, description thereof will be omitted, and description will be mainly made for points different from those of the first embodiment.

The different point of this second embodiment from that of the first embodiment is a point regarding the circuit configuration of an array substrate and a point regarding the pixel drive method.

Figure 13:
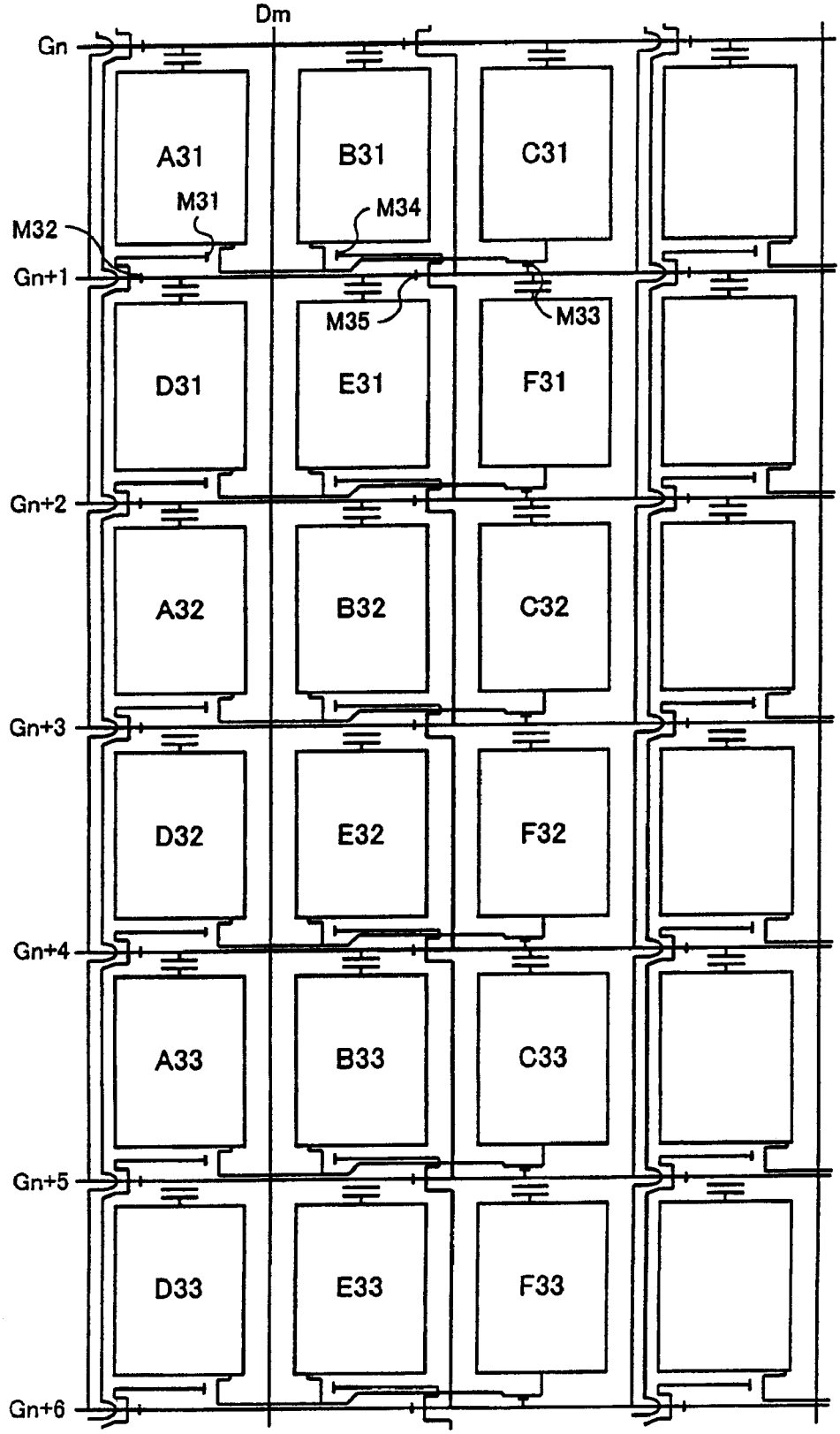
FIG. 13 is a view of a circuit configuration of an array substrate, schematically showing a second embodiment of the present invention.

FIG. 13 is a view showing a configuration of the array substrate in the second embodiment of the present invention.

While two pixels share one signal line Dm in the first embodiment, three pixels share the one signal line Dm in this second embodiment.

Specifically, as shown in FIG. 13, in the array substrate of the liquid crystal display device 1 of this second embodiment, the signal line Dm is shared by three pixels, that is, a pixel electrode A31 (pixel electrode D31 . . . ), a pixel electrode B31 (pixel electrode E31 . . . ) and a pixel electrode C31 (pixel electrode F31 . . . ). Then, a data potential of the signal line Dm is supplied to the pixel electrode A31 when both of the scan lines Gn+1 and Gn+3 are set at the selection potential. In addition, the data potential of the signal line Dm is supplied to the pixel electrode B31 when the scan lines Gn+1 and Gn+2 are set at the selection potential. Moreover, the data potential of the signal line Dm is supplied to the pixel electrode C31 when the scan line Gn+1 is set at the selection potential.

In order to perform operations as described above, in this second embodiment, first TFT M31 to fifth TFT M35 as switching elements are arranged as will be described below. Specifically, as shown in FIG. 13, with regard to the first TFT M31, one of source/drain electrodes is connected to the pixel electrode A31, and the other of the source/drain electrodes is connected to the signal line Dm. In addition, a gate electrode of the first TFT M31 is connected to one of source/drain electrodes of the second TFT M32.

One of source/drain electrodes of the second TFT M32 is connected to the scan line Gn+3, and the other of the source/drain electrodes is connected to the gate electrode of the first TFT M31. Accordingly, the gate electrode of the first TFT M31 is connected through the second TFT M32 to the scan line Gn+3. In addition, a gate electrode of the second TFT M32 is connected to the scan line Gn+1. Accordingly, only during a period while the two scan lines Gn+1 and Gn+3 are simultaneously set at the selection potential, the first TFT M31 is turned on, and the potential of the signal line Dm is supplied to the pixel electrode A31. This indicates that the second TFT M32 is a switching element for controlling ON/OFF of the first TFT M31.

One of source/drain electrodes of a third TFT M33 is connected to the signal line Dm, and the other of the source/drain electrodes is connected to the pixel electrode C31. In addition, a gate electrode of the third TFT M33 is connected to the scan line Gn+1.

With regard to the fourth TFT M34, one of source/drain electrodes is connected to the signal line Dm, and the other of the source/drain electrodes is connected to the pixel electrode B31. In addition, a gate electrode of the fourth TFT M34 is connected to one of source/drain electrodes of the fifth TFT M35.

Moreover, with regard to the fifth TFT M35, one of source/drain electrodes is connected to the scan line Gn+2, and the other of the source/drain electrodes is connected to a gate electrode of the fourth TFT M34. Accordingly, the gate electrode of the fourth TFT M34 is connected through the fifth TFT M35 to the scan line Gn+2. In addition, a gate electrode of the fifth TFT M35 is connected to the scan line Gn+1. Accordingly, only during the period while the scan lines Gn+1 and Gn+2 are simultaneously being set at the selection potential, the fourth TFT M34 is turned on, and the potential of the signal line Dm is supplied to the pixel electrode B31. This indicates that the fifth TFT M35 is a switching element for controlling ON/OFF of the fourth TFT M34.

Although description has been made above for the circuit configuration of the array substrate seen from the first to fifth TFTs M31 to M35, description will be now made for the circuit configuration of the liquid crystal display device 1 seen from the pixel electrodes A31 to C31.

The pixel electrodes A31 to C31 are supplied with display signals from the single signal line Dm. Specifically, the signal line Dm is a common signal line to the pixel electrodes A31 to C31. To the pixel electrode A31, the first TFT M31 and the second TFT M32 are connected. Moreover, the first TFT M31 is connected to the signal line Dm and the second TFT M32. The gate electrode of the second TFT M32 is connected to the scan line Gn+1 of its own, and one of the source/drain electrodes of the second TFT M32 is connected to the scan line Gn+3 on a later stage. Here, in order to supply the potential of the signal line Dm to the pixel electrode A31, it is necessary to turn on the first TFT M31. Moreover, the gate electrode of the first TFT M31 is connected to one of the source/drain electrodes of the second TFT M32, the gate electrode of the second TFT M32 is connected to the scan line Gn+1 on a later stage than the pixel electrodes A31 and B31, and the other of the source/drain electrodes thereof is connected to the scan line Gn+3 on the later stage than the scan line Gn+1. Therefore, it is necessary to turn on the second TFT M32 in order to turn on the first TFT M31. In order to turn on the second TFT M32, it is necessary that both of the scan line Gn+1 and the scan line Gn+3 on the later stage be set at the selection potential.

As described above, the pixel electrode A31 is driven based on the scan signal from the scan line Gn+1 and the scan signal from the scan line Gn+3 to receive the potential from the signal line Dm.

To the pixel electrode B31, the fourth TFT M34 and the fifth TFT M35 are connected. The fourth TFT M34 is connected to the signal line Dm and the fifth TFT M35. The gate electrode of the fifth TFT M35 is connected to the scan line Gn+1, and one of the source/drain electrodes of the fifth TFT M35 is connected to the scan line Gn+2. Here, in order to supply the potential of the signal line Dm to the pixel electrode B31, it is necessary to turn on the fourth TFT M34. Then, the gate electrode of the fourth TFT M34 is connected to one of the source/drain electrodes of the fifth TFT M35, the gate electrode of the fifth TFT M35 is connected to the scan line Gn+1, and the other of the source/drain electrodes thereof is connected to the scan line Gn+2. Therefore, in order to turn on the fourth TFT M34, it is necessary to turn on the fifth TFT M35. In order to turn on the fifth TFT M35, it is necessary that the scan lines Gn+1 and Gn+2 be set at the selection potential. As described above, only during the period while the scan line Gn+1 located on a later stage than the pixel electrode B31 and the scan line Gn+2 on the much later stage are being at the selection potential, the potential is supplied from the signal line Dm to the pixel electrode B31.

Moreover, to the pixel electrode C31, the third TFT M33 is connected, of which gate electrode is connected to the scan line Gn+1. Accordingly, when the scan line Gn+1 is selected, the pixel electrode C31 is supplied with the potential from the signal line Dm.

Although description has been made above for the pixel electrodes A31 to C31, similar configurations are also employed for pixel electrodes D31 to F31 and after.

Figure 14:
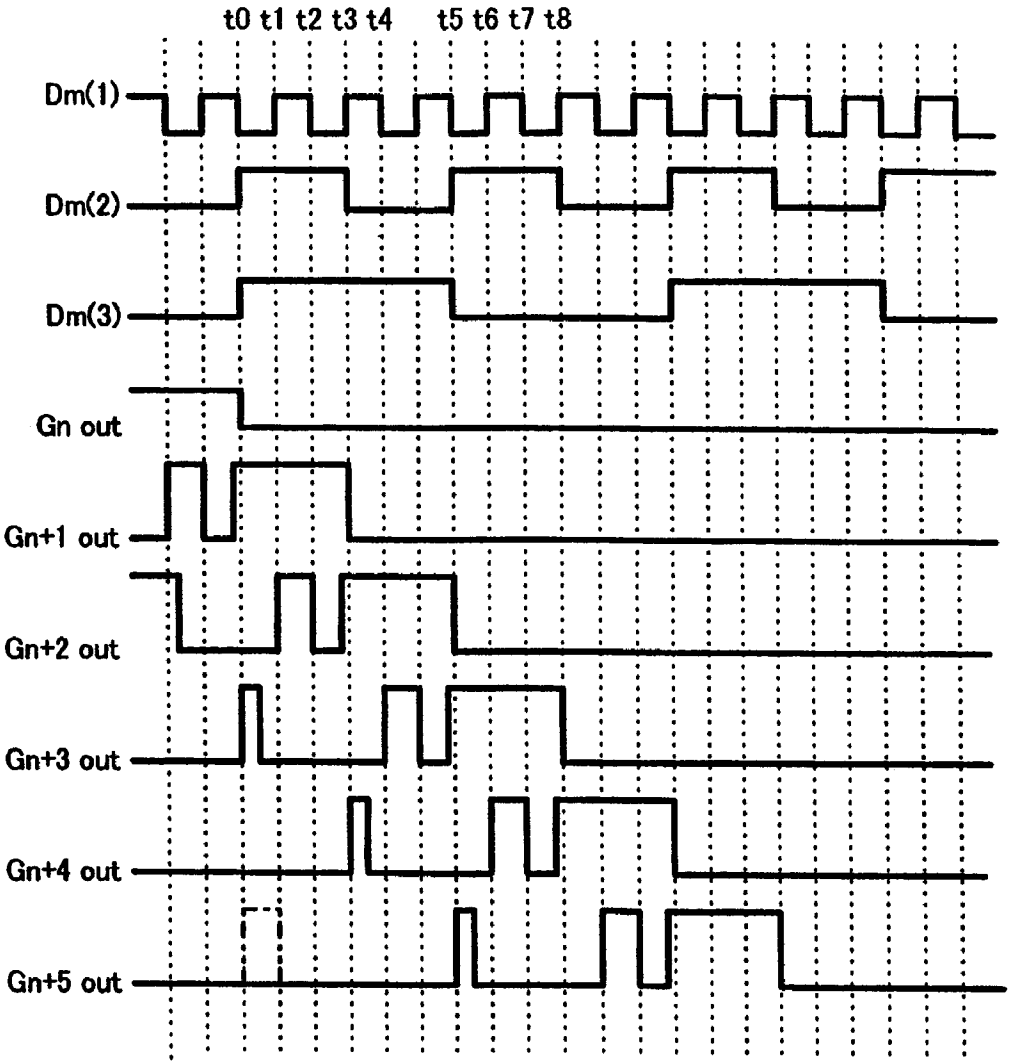
FIG. 14 is a timing chart of display signals and scan signals of the second embodiment of the present invention.
Figure 15:
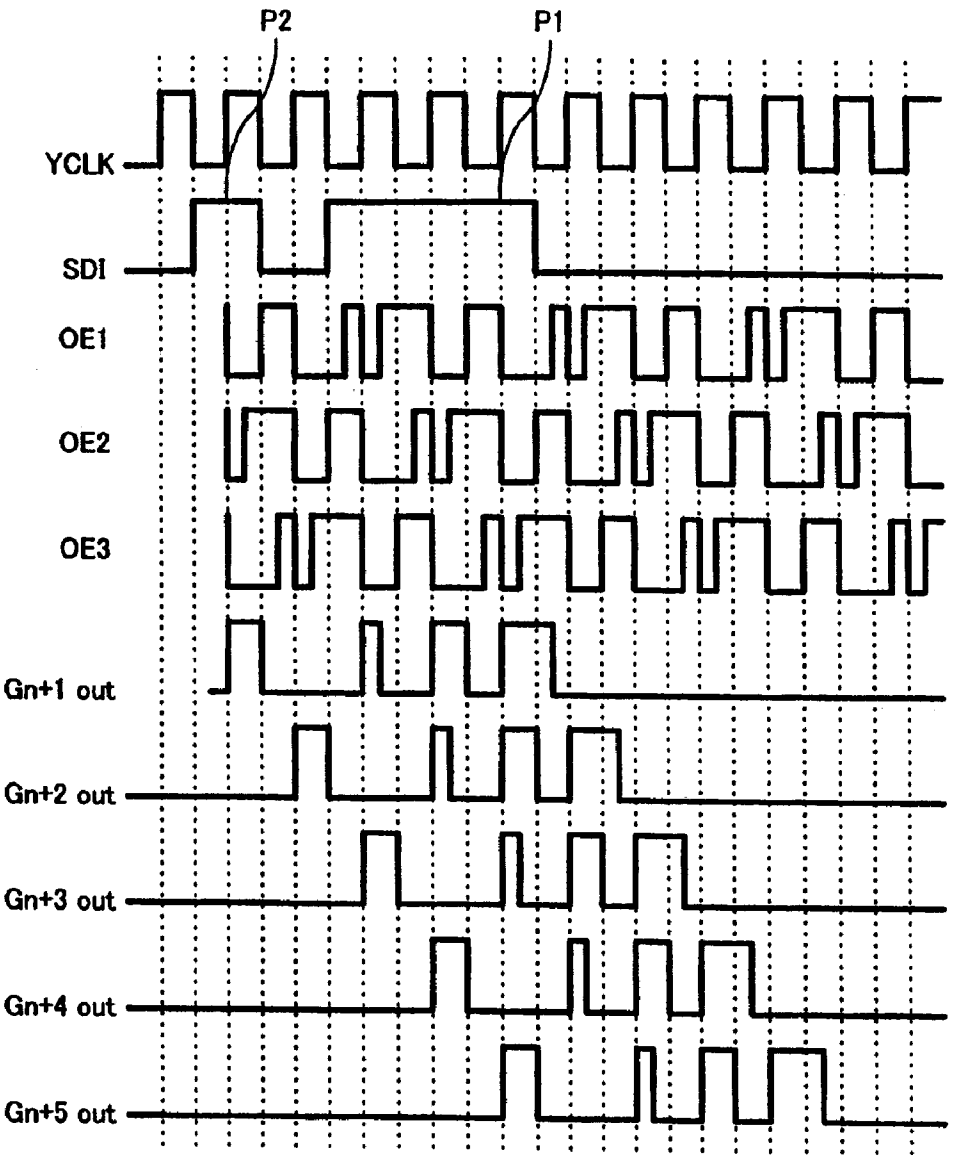
FIG. 15 is a timing chart of a clock signal, shift pulses and the scan signals of the second embodiment of the present invention.
Figure 16:
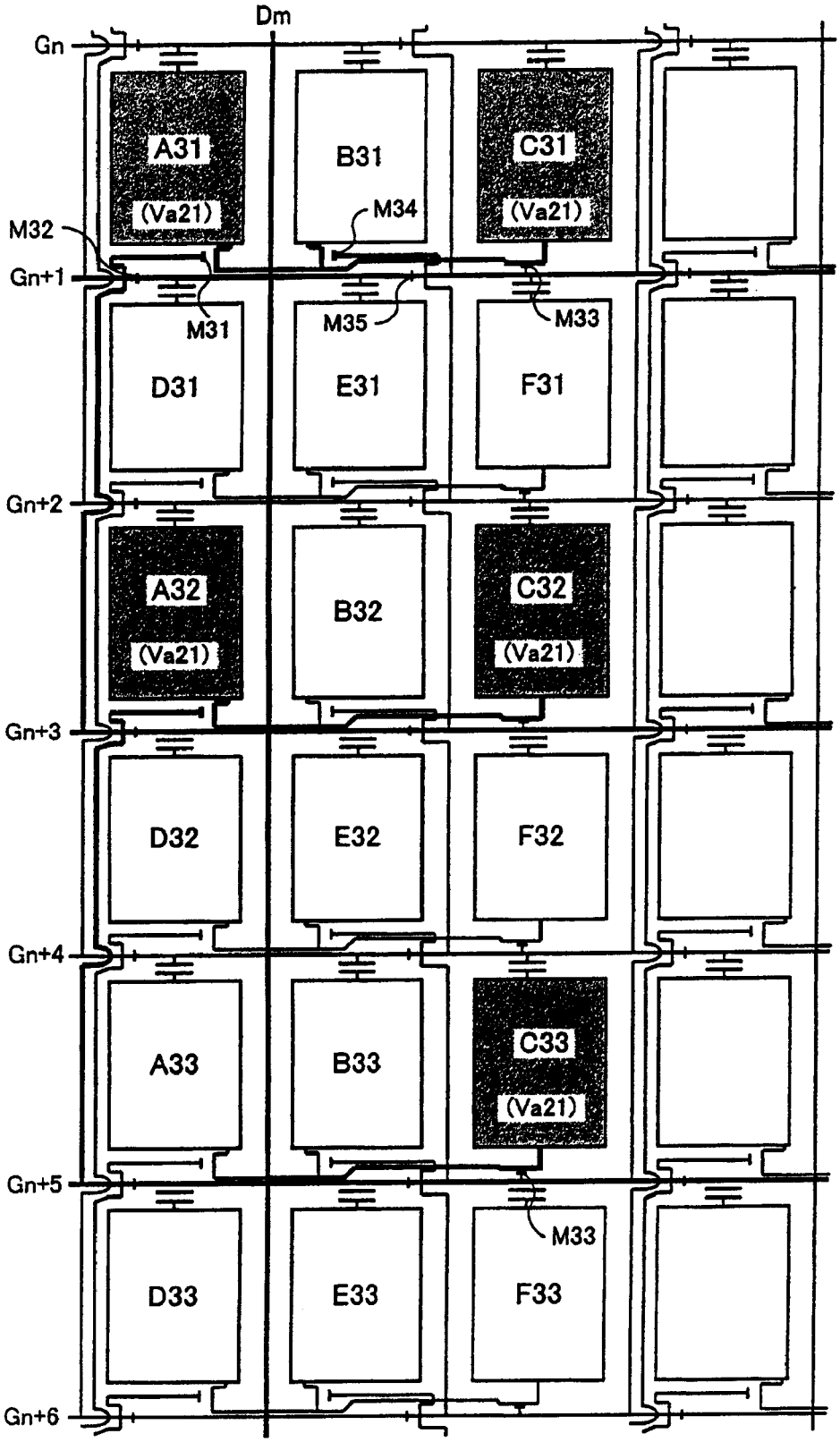
FIG. 16 is a view showing an operation of a circuit of the liquid crystal display device of the second embodiment of the present invention.
Figure 17:
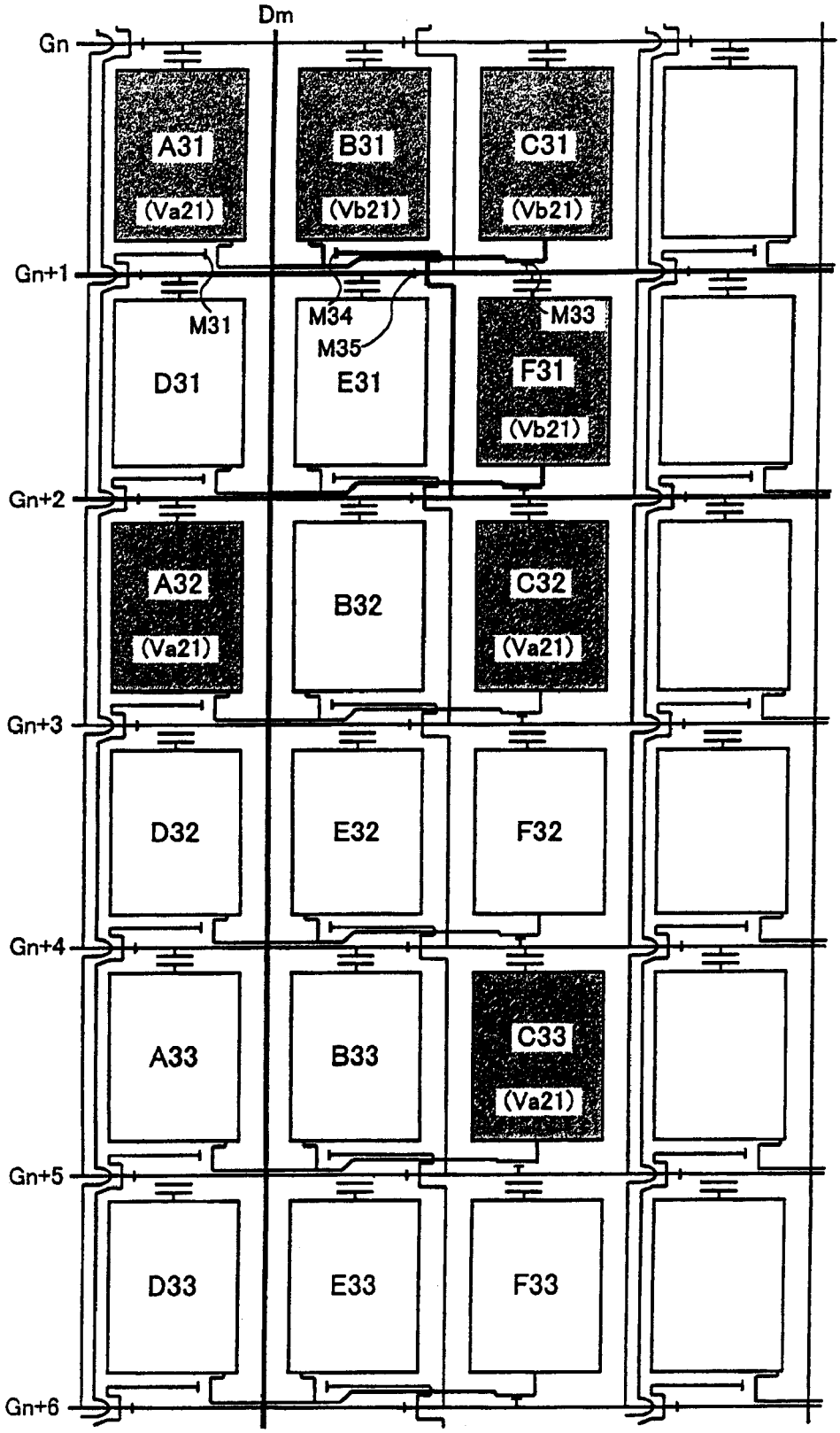
FIG. 17 is a view showing an operation of the circuit of the liquid crystal display device of the second embodiment of the present invention, showing a next step of FIG. 16.
Figure 18:
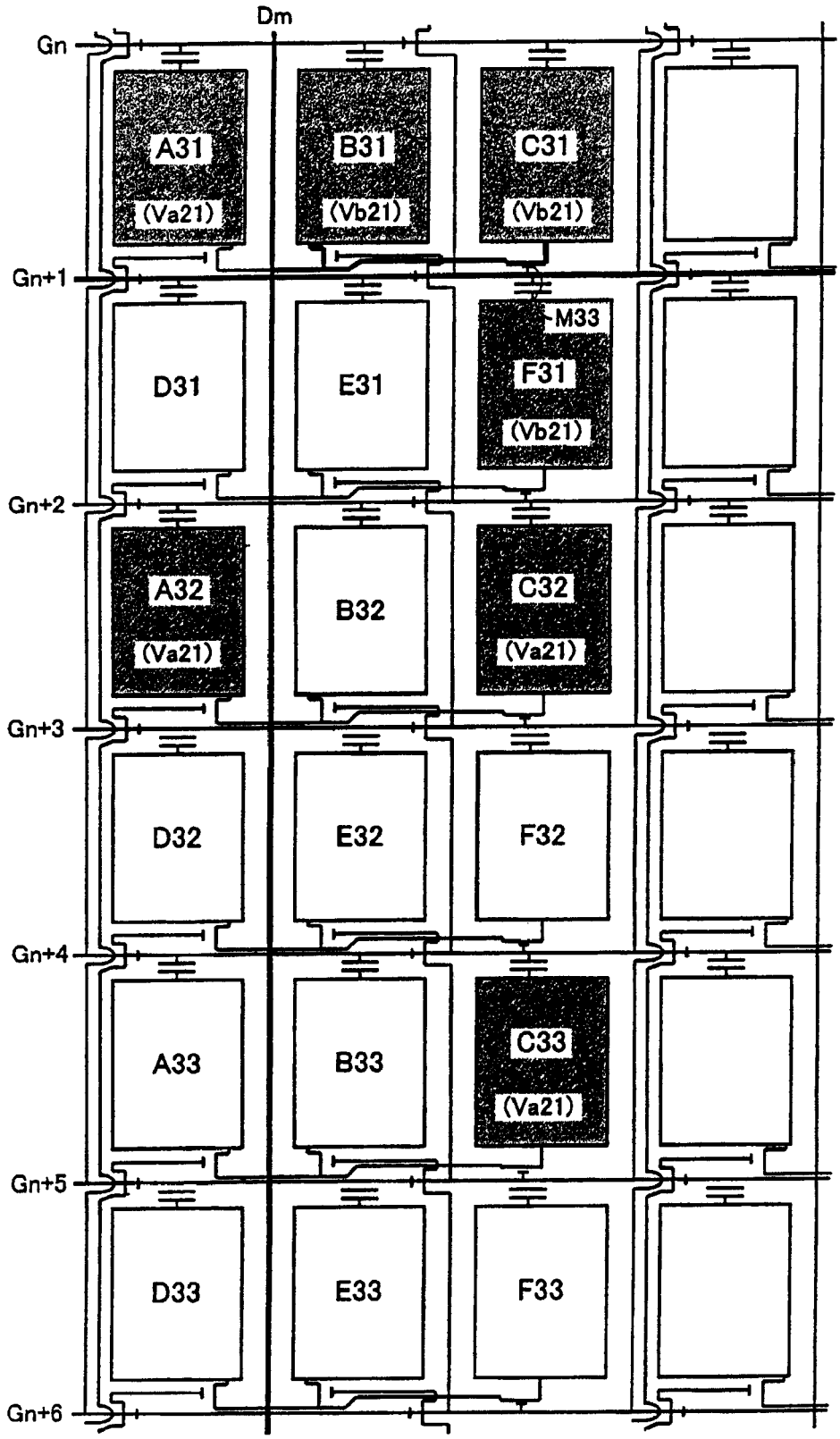
FIG. 18 is a view showing an operation of the circuit of the liquid crystal display device of the second embodiment of the present invention, showing a next step of FIG. 17.

Next, description will be made for an operation of the liquid crystal display device 1 of this second embodiment with reference to a timing chart of scan signals, which is shown in FIG. 14, a timing chart of clock signals, shift pulses and output control signals, which is shown in FIG. 15, circuit diagrams of FIGS. 16 to 18, and a pixel drive matrix shown in FIG. 19.

Note that, also in this second embodiment, the precharge method is employed, in which, before a display signal voltage to be maintained by a pixel during one horizontal scan period of a screen is written to the pixel, another display signal voltage is preliminarily written thereto.

In FIG. 14, diagrams Gn out to Gn+5 out represent waveforms of scan signals outputted to the scan lines Gn to Gn+5, which are generated by shift pulses propagating to the shift registers SR. Specifically, at timing when a portion represented by each solid line or chain line in these diagrams rises, the relevant scan line G is selected, and at timing when the portion does not rise, the relevant scan line G is not selected. Note that, among the rising portions of these diagrams, the portions represented by the solid lines indicate timing when the display signal voltages to be maintained in one horizontal scan period by pixel electrodes are charged thereto. Moreover, the portions represented by the chain lines indicate timing when display signal voltages are preliminarily written to the pixel electrodes in order to precharge the pixel electrodes in addition to the selection control for charging the pixel electrodes.

Moreover, Dm(2) shown in FIG. 14 indicates a potential of a data signal supplied from the signal line Dm, which indicates timing when the data signal is changed. The data signal Dm(2) shown here includes a change in polarity. As will be described later, the pixel electrode A31 is set at the same polarity as that of the pixel electrodes B31 and C31 by the data signal Dm(2), and is driven in a polarity different from that of the pixel electrodes D31, E31 and F31.

Furthermore, FIG. 15 is a timing chart showing a relation among the scan signals Gn+1 out to Gn+5 out supplied to the scan lines Gn+1 to Gn+5, a shift pulse SDI outputted to the shift register SR and the output control signals OE1 to OE3, both of which correspond to the above-described scan signals, and a clock signal YCLK driving the shift registers SR. Note that, in FIG. 15, the portions where the potentials rise for the precharge among the scan signals Gn+1 out to Gn+5 out are also represented by solid lines.

In order to drive pixels in this liquid crystal display device 1, first, the shift pulse SDI is outputted from the pulse generation unit 9 of the control circuit 6 to the gate driver 5 (see FIG. 15).

As shown in FIG. 15, the shift pulse SDI is a signal row composed of a first pulse P1 with a time width from rise to fall for three cycles of the clock signal YCLK and a second pulse P2 with a time width from rise to fall for one cycle of the clock signal YCLK. Here, one cycle of the clock signal YCLK is equal to one horizontal scan period of the screen. Specifically, the shift pulse SDI is a signal row having a time width for five horizontal scan periods in total, in which the first pulse P1 has the time width for three horizontal scan periods, and the second pulse P2 with the time width for one horizontal scan period is continuous with the first pulse P1 with an interval for one horizontal scan period spaced therefrom.

In the shift register unit 12 of the gate driver 5, this shift pulse SDI moves to the next shift register SR for one cycle of the clock signal YCLK synchronously with the rise of the clock signal YCLK. Therefore, by providing, to the shift pulse SDI, the time width for five horizontal scan periods, the shift pulse SDI sequentially moves while existing in three adjacent shift registers SR and one shift register SR spaced therefrom by an interval for one register. Here, by supplying the output control signals OE1 to OE3 as shown in FIG. 15 to the buffers B adjacent from one another, the buffers B connected to five shift registers SR are controlled simultaneously, and thus five scan lines G can be selected and controlled simultaneously. In addition, here, since the buffers B are turned on when values of the output control signals OE inputted thereto are "0", and turned off when the values are "1", the scan signals Gn+1 out to Gn+5 out will be as shown in a lower part of FIG. 15.

Next, description will be made for a procedure for charging a pixel electrode.

As shown in FIG. 14, when the scan signals Gn+1 out to Gn+3 out are generated and supplied to the scan lines Gn+1 to Gn+3 (first group of scan lines), if attention is paid to portions represented by the solid lines among the scan signals Gn+1 out to Gn+3 out, that is, timing when the display signal voltages are written to the pixel electrodes, then both of the scan lines Gn+1 and Gn+3 are selected during a period from time t0 to time t1 (first timing). Therefore, as shown in FIG. 16, the first to third TFTs M31 to M33 are turned on. Thus, a potential Va21 to be applied to the pixel electrode A31 from the signal line Dm is supplied to the pixel electrodes A31, C31 and C32. Thus, the potential Va21 of the pixel electrode A31 is determined. Note that, in FIG. 16, the selected scan lines G are represented by bold lines.

Meanwhile, during the following period from time t1 to time t2 (second timing), the potential supplied from the signal line Dm is changed to a potential Vb21 to be applied to the pixel electrode B31. Here, as shown in FIG. 14, the scan lines Gn+1 and Gn+2 are selected, and thus, as shown in FIG. 17, the second TFT M32 is turned off. Moreover, the potential of the scan line Gn+3 (OFF potential) is supplied to the gate electrode of the first TFT M31, and thus the first TFT M31 is turned off. In addition, the third to fifth TFTs M33 to M35 are turned on. Accordingly, the potential Vb21 is applied to the pixel electrodes B31, C31 and F31. Consequently, the potential Vb21 of the pixel electrode B31 is determined.

Furthermore, during the following period from time t2 to time t3 (third timing), the potential supplied from the signal line Dm is changed to a potential Vc21 to be applied to the pixel electrode C31. Here, during the period from time t2 to time t3, as shown in FIG. 14, only the scan line Gn+1 is set at the selection potential. Then, as shown in FIG. 18, the potential Vc21 of the signal line Dm is applied to the pixel electrode C31 through the third TFT M33, and thus the potential Vc21 of the pixel electrode C31 is determined.

Note that a period from time t0 to time t3 corresponds to one horizontal scan period (first horizontal scan period). The pixel drive as described above is carried out during this period, and thus the potential of the signal line Dm can be supplied to the pixel electrodes A31, B31 and C31 (first group of pixel electrodes) by time division.

After the scan line Gn+1 is set at the non-selection potential, the polarity of the potential of the signal line Dm is inverted, and the potential is changed to a potential Vd21 to be applied to the pixel electrode D31. By iterating a procedure similar to the above, the potentials of the pixel electrodes D31 to F31 are determined by time division.

In this case, the potentials Va21 to Vc21 supplied to the pixel electrodes A31 to C31 are reverse in polarity to the potentials Vd21 to Vf21 supplied to the pixel electrodes D31 to F31. Accordingly, the liquid crystal display device 1 is driven as a display device of a line inversion drive, in which the polarity is inverted for every row.

Next, description will be made for the precharge method of a pixel.

As described above, it is desirable that the pixel electrode Y precharged simultaneously when the certain pixel electrode X is charged have relations as the following A and B to the pixel electrode X.

A: During a period from precharge to charge of the pixel electrode Y, the pixel electrode Y is not charged simultaneously while other pixel electrodes than the pixel electrodes X and Y are being charged; and B: The charged pixel electrodes Y and X have the same polarity, and selection timings (charged timings) thereof are proximate to each other.

Accordingly, in this second embodiment, as a precharge method meeting the above conditions A and B, for example, a mode is employed, in which the pixel electrode A32 at the second later stage is selected when the pixel electrode A31 is charged. Specifically, as shown by the chain line in FIG. 14, during the period from time t0 to time t1 (first timing), the potentials of the scan signals Gn+3 out and Gn+5 out are raised. Thus, the scan lines Gn+3 and Gn+5 (specified scan lines) selecting the pixel electrode A32 are selected as shown in FIG. 16, and the first and second TFTs M31 and M32 controlling the supply of the display signal to the pixel electrode A32 are turned on. Accordingly, the same display signal as the display signal supplied to the pixel electrode A31 is supplied from the signal line Dm to the pixel electrode A32, to which the potential Va21 is applied. Therefore, the pixel electrode A32 is precharged in the same polarity as that of the pixel electrode A31.

Note that, in this case, the scan line Gn+5 is selected, and thus the third TFT M33 controlling the supply of the display signal from the signal line Dm to the pixel electrode C33 is turned on. Accordingly, the potential Va21 is also applied to the pixel electrode C33.

Thereafter, during the period from time t1 to time t2 and the period from time t2 to time t3, any of the scan lines G is not selected for the precharge. Accordingly, as shown in FIGS. 17 and 18, the potential Va21 is maintained in the pixel electrode A32. Here, since the drive polarity of the pixels is inverted for every row, the potential Va21 precharged to the pixel electrode A32 and a potential to be actually charged to the pixel electrode A32 are at the same polarity. Thereafter, as shown in FIG. 14, in the period from time t5 to time t8 (second horizontal scan period) while the pixel electrodes A32, B32 and C32 (second group of pixel electrodes) are sequentially driven, during the period from time t5 to time t6 (first time of second timing), the scan lines Gn+3 and Gn+5 are simultaneously selected. Thus, before the pixel electrode A32 is charged, at least one of the scan signals Gn+3 out and Gn+5 out is not selected. Specifically, signals different from those during the charge are outputted to the scan lines Gn+3 and Gn+5. Therefore, the pixel electrode A32 is not precharged again during the period from the precharge to the charge. Accordingly, the precharge method of this second embodiment meets the above-described conditions A and B.

Furthermore, similarly to the above, when the pixel electrodes D31, A32 . . . are charged, the pixel electrodes D32, A33 . . . at the second later stage are precharged, and thus the precharge meeting the above-described conditions A and B can be carried out.

Such precharge method is shown in matrix in FIG. 19. In the matrix of FIG. 19, columns denoted by codes A, B and C indicate timing when the pixel electrodes A31, A32 . . . , B31, B32 . . . , and C31, C32 . . . are driven, respectively. In addition, rows denoted by codes g(n+1), g(n+2) . . . represent the scan lines G(n+1), G(n+2) . . . . Moreover, items of the matrix indicate, by the presence of hatchings, as to whether or not the scan lines G(n+1), G(n+2) . . . are selected at timing when the pixel electrodes A31, A32 . . . , B31, B32 . . . , and C31, C32 . . . are driven. For example, a hatching at row 1 column 1 of this matrix indicates that the scan line G(n+1) is selected at the timing when the pixel electrode A31 is selected.

In addition, a letter of A, B or C displayed in each item of the matrix indicates that any of the pixel electrodes A31, A32 . . . , B31, B32 . . . , and C31, C32 . . . is driven by selecting one corresponding to the item from the scan lines G(n+1), G(n+2) . . . . For example, the letters "A" are displayed in row 1 column 1 and in row 3 column 1 in the matrix. Thus, indicated is that the pixel electrodes A31, A32 . . . and the like are driven by simultaneously selecting the scan lines G(n+1) and G(n+3) at the timing when the pixel electrodes A31, A32 . . . are driven. In addition, letters of "PA" displayed on the items indicate that the pixel electrodes A31, A32 . . . and the like are precharged by selecting the scan lines G(n+1), G(n+2) . . . corresponding to the items. For example, the display of "PA" on row 3 column 1 and on row 5 column 1 of the matrix indicates that the pixel electrodes A31, A32 . . . are precharged and driven by selecting the scan lines G(n+3) and G(n+5) simultaneously at timing when the pixel electrodes A31, A32 . . . are to be driven. Here, a display of "A/PA" made in row 3 column 1 of the matrix indicates that the scan line G(n+3) is selected for both purposes of charging the pixel electrode A31 and of precharging the pixel electrode A32 at the timing corresponding to the item.

As described above, in this second embodiment, while the conditions necessary for the precharge being satisfied, the charge and precharge for the pixel electrodes having the multiplexed pixel structure can be carried out, and thus the highly defined liquid crystal display device 1 can be driven accurately.

Moreover, in the precharge method of this second embodiment, for example, during the period from time t0 to time t1, the scan lines G(n+1) and G(n+3) are selected in order to charge the pixel electrode A31, and the scan lines G(n+3) and G(n+5) are selected in order to precharge the pixel electrode A32 simultaneously when the pixel electrode A31 is charged. Specifically, the selection control line for the pixel electrode to be charged and the selection control line for the pixel electrode to be precharged duplicate. By employing such configuration, the interval between the row where the pixel electrode to be charged is present and the row where the pixel electrode to be precharged simultaneously therewith is present can be narrowed. Thus, the time interval from the precharge to the charge can be shortened to make it possible to minimize an influence thereof to pixels other than the display pixels.

Note that, in the above second embodiment, the pixel electrode B31 may be charged with the potential Va21 by selecting the scan line Gn+2 during the drive of the pixel electrode A31. Thus, the pixel electrode B31 can be charged before the actual drive thereof, thus making it possible to prevent the shortage of write to the pixel electrode B31.

THIRD EMBODIMENT

Next, description will be made for a third embodiment of the present invention.

In this third embodiment, since the entire configuration of a liquid crystal display device 1, the circuit configuration of an array substrate and the circuit configuration of a gate driver 5 are common to those of the second embodiment, here, description of the configurations common to those of the second embodiment will be omitted, and description will be mainly made for points different from those of the second embodiment.

The different point of this third embodiment from that of the second embodiment is a point regarding the operation of the liquid crystal display device 1. Hereinafter, description will be made for the operation of the liquid crystal display device 1.

Note that, also in this third embodiment, the precharge method is employed, in which, before a display signal voltage to be maintained by a pixel during one horizontal scan period of a screen is written to the pixel, another display signal voltage is preliminarily written thereto.

Figure 20:
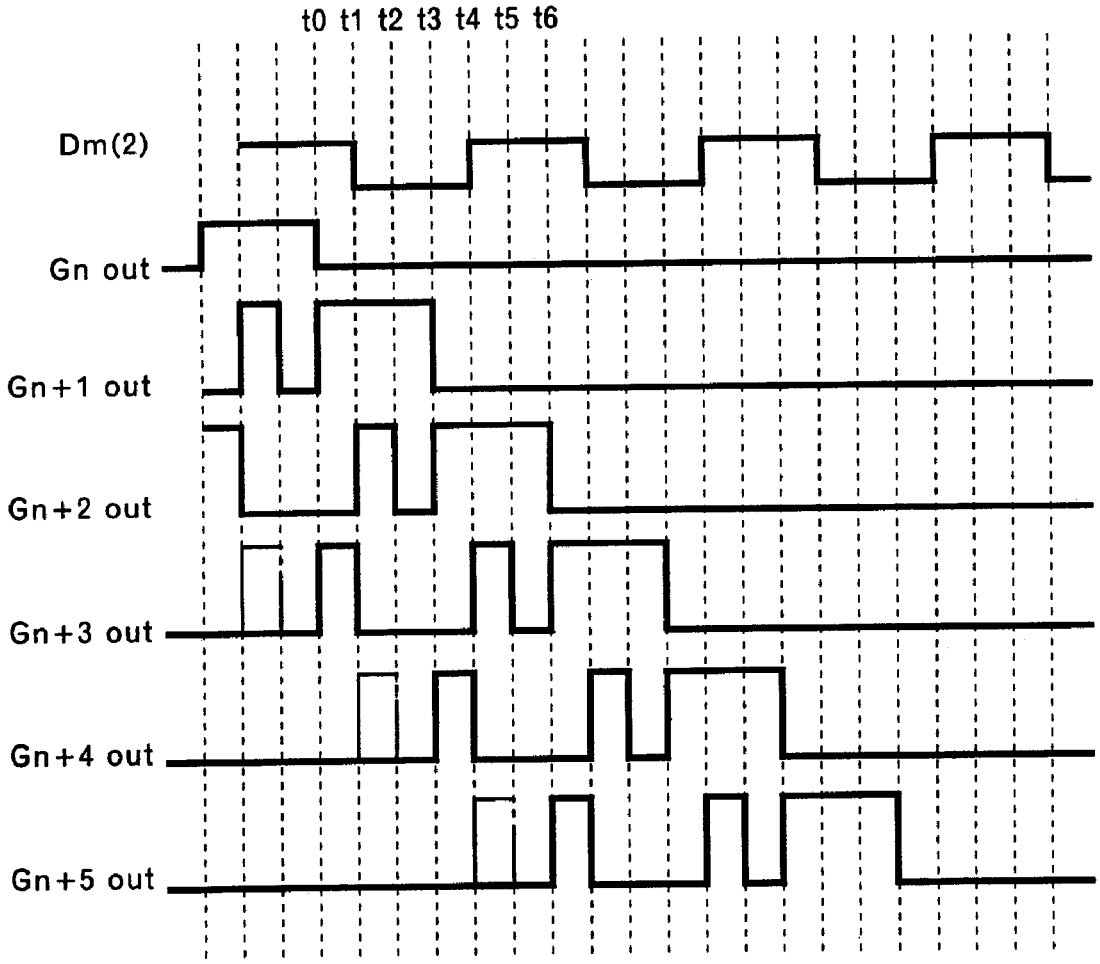
FIG. 20 is a timing chart of a display signal and scan signals, schematically showing a third embodiment of the present invention.

In FIG. 20, diagrams Gn out to Gn+5 out represent waveforms of scan signals outputted to the scan lines Gn to Gn+5, which are generated by shift pulses propagating to the shift registers SR. Specifically, at timing when a portion represented by each solid line or chain line in these diagrams rises, the relevant scan line G is selected, and at timing when the portion does not rise, the relevant scan line G is not selected. Note that, among the rising portions of these diagrams, the portions represented by the solid lines indicate timing when the display signal voltages to be maintained in one horizontal scan period by pixel electrodes are charged thereto. Moreover, the portions represented by the chain lines indicate timing when display signal voltages are written to the pixel electrodes in order to precharge the pixel electrodes in addition to the selection control of scan lines G for charging the pixel electrodes.

Moreover, Dm(2) shown in FIG. 20 indicates a potential of a data signal supplied from the signal line Dm, which indicates timing when the data signal is changed. The data signal Dm(2) shown here includes a change in polarity. As will be described later, the pixel electrode A31 is driven at the same polarity as that of the pixel electrodes E31 and F31 by the data signal Dm(2), and the pixel electrode B31 is driven at a polarity different from that of the pixel electrodes C31 and D31.

First, description will be made for a procedure for charging a pixel electrode.

Figure 21:
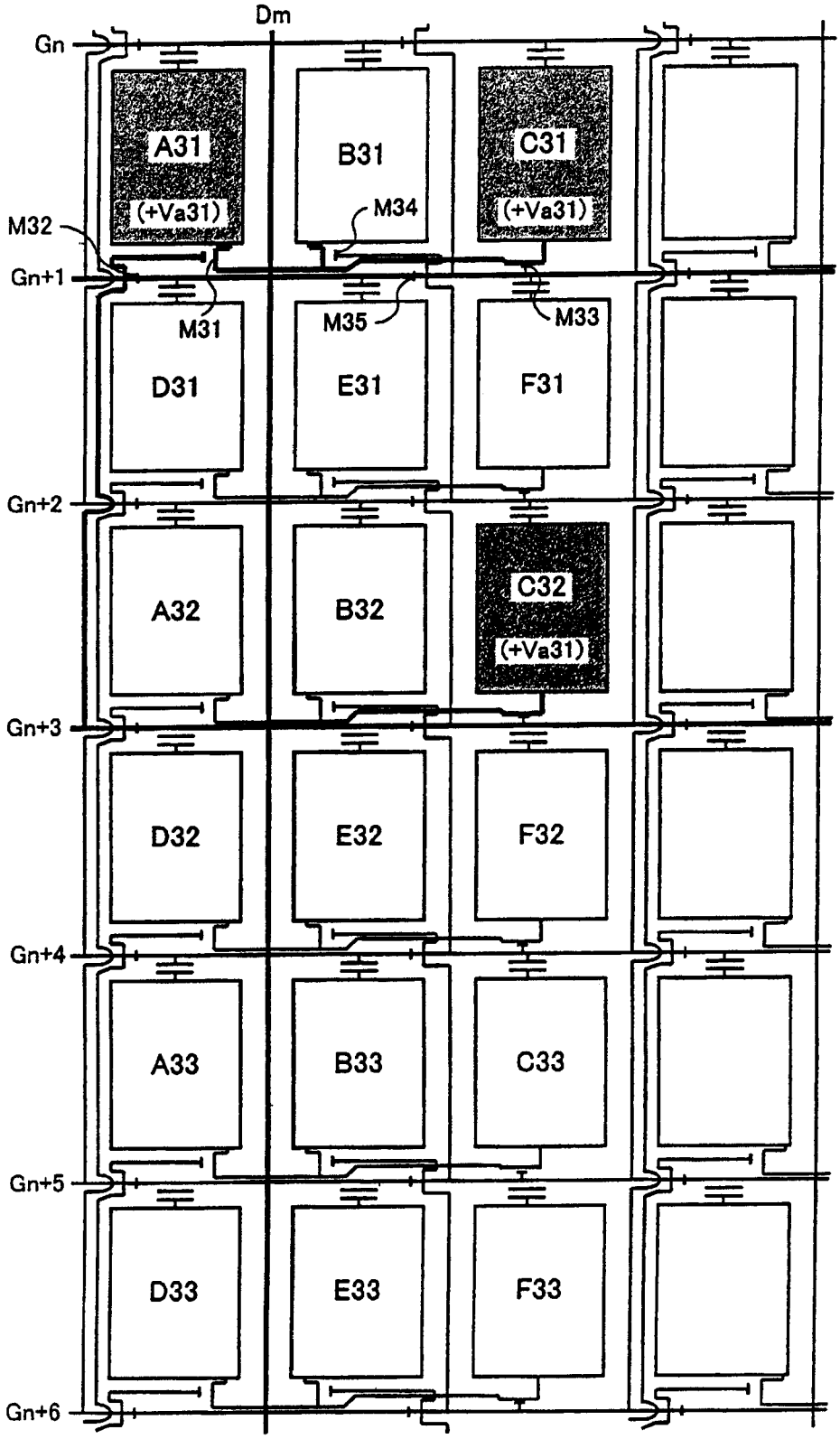
FIG. 21 is a view showing an operation of a circuit of the liquid crystal display device of the third embodiment of the present invention.

As shown in FIG. 20, when the scan signals Gn+1 out to Gn+3 out are generated and supplied to the scan lines Gn+1 to Gn+3 (first group of scan lines), if attention is paid to portions represented by the solid lines among the scan signals Gn+1 out to Gn+3 out, that is, timing when the display signal voltages are written to the pixel electrodes, then both of the scan lines Gn+1 and Gn+3 are selected during a period from time t0 to time t1 (first timing). Therefore, as shown in FIG. 21, the first to third TFTs M31 to M33 are turned on. Thus, a potential Va31 to be applied to the pixel electrode A31 from the signal line Dm is supplied to the pixel electrodes A31, C31 and C32 that is connected to the scan line Gn+3 through the third TFT M33. Thus, the potential Va31 of the pixel electrode A31 is determined. Note that, in FIG. 21, the selected scan lines G are represented by bold lines. In addition, here, the potential Va31 is assumed to be a positive potential, and in FIG. 21, that the potential Va31 applied to the pixel electrode A31 or the like is a positive potential is denoted by a code "+". Hereinafter, also in FIGS. 22 to 26, the polarity of the potential applied to the pixel electrode is denoted by the code "+" or "−" similarly.

Figure 22:
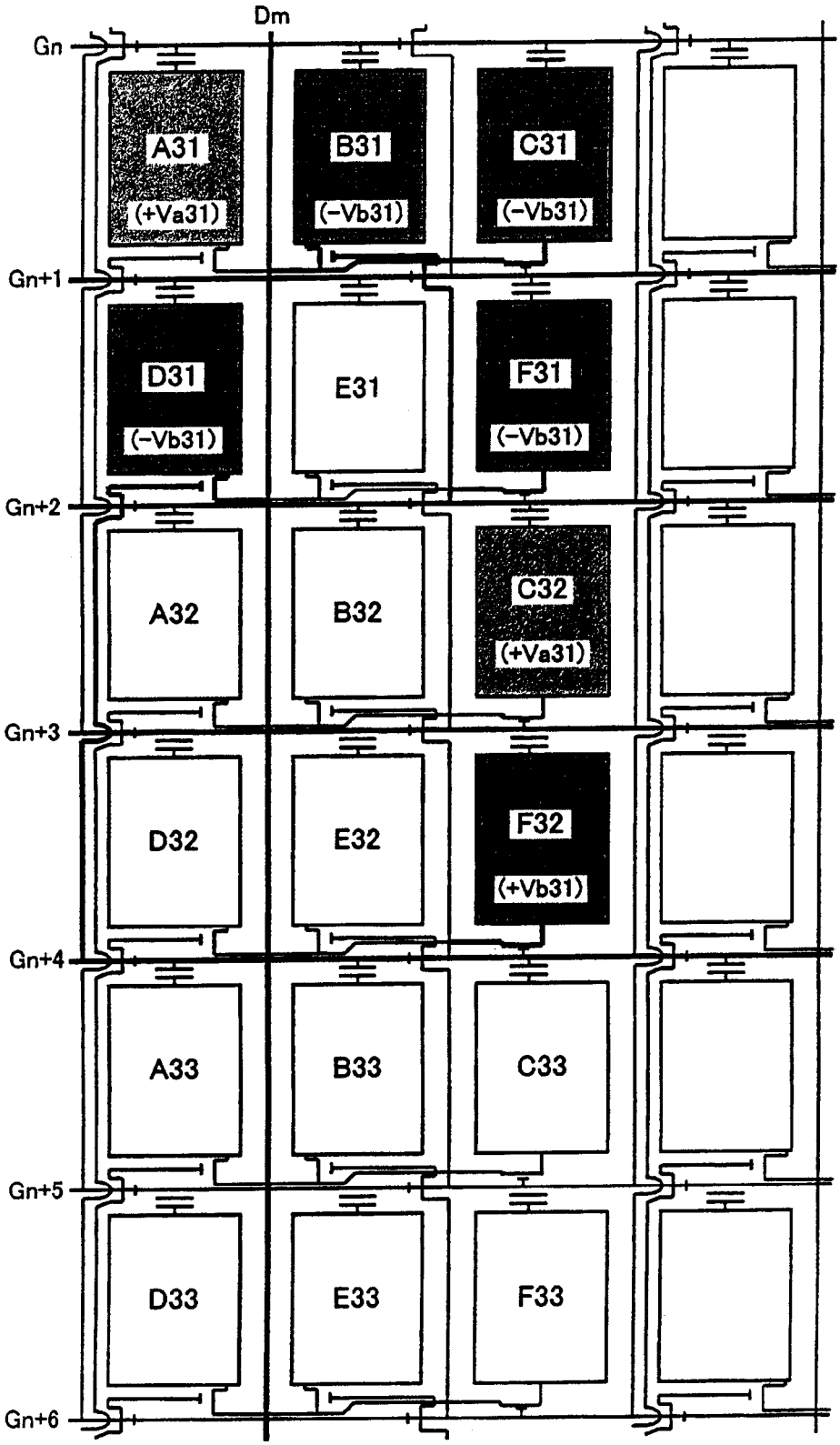
FIG. 22 is a view showing an operation of the circuit of the liquid crystal display device of the third embodiment of the present invention, showing a next step of FIG. 21.

Next, during the period from time t1 to time t2 (second timing), the potential supplied from the signal line Dm is changed to a potential Vb31 to be applied to the pixel electrode B31, and the polarity thereof is inverted into a negative potential. Here, as shown in FIG. 20, the scan lines Gn+1 and Gn+2 are selected, and the scan line Gn+3 is not selected. Thus, as shown in FIG. 22, the second TFT M32 is turned off. Moreover, the potential of the scan line Gn+3 (OFF potential) is supplied to the gate electrode of the first TFT M31, and thus the first TFT M31 is turned off. In addition, the third to fifth TFTs M33 to M35 are turned on. Accordingly, the potential Vb31 is applied to the pixel electrodes B31, C31 and F31. Consequently, the potential Vb31 of the pixel electrode B31 is determined.

Figure 23:
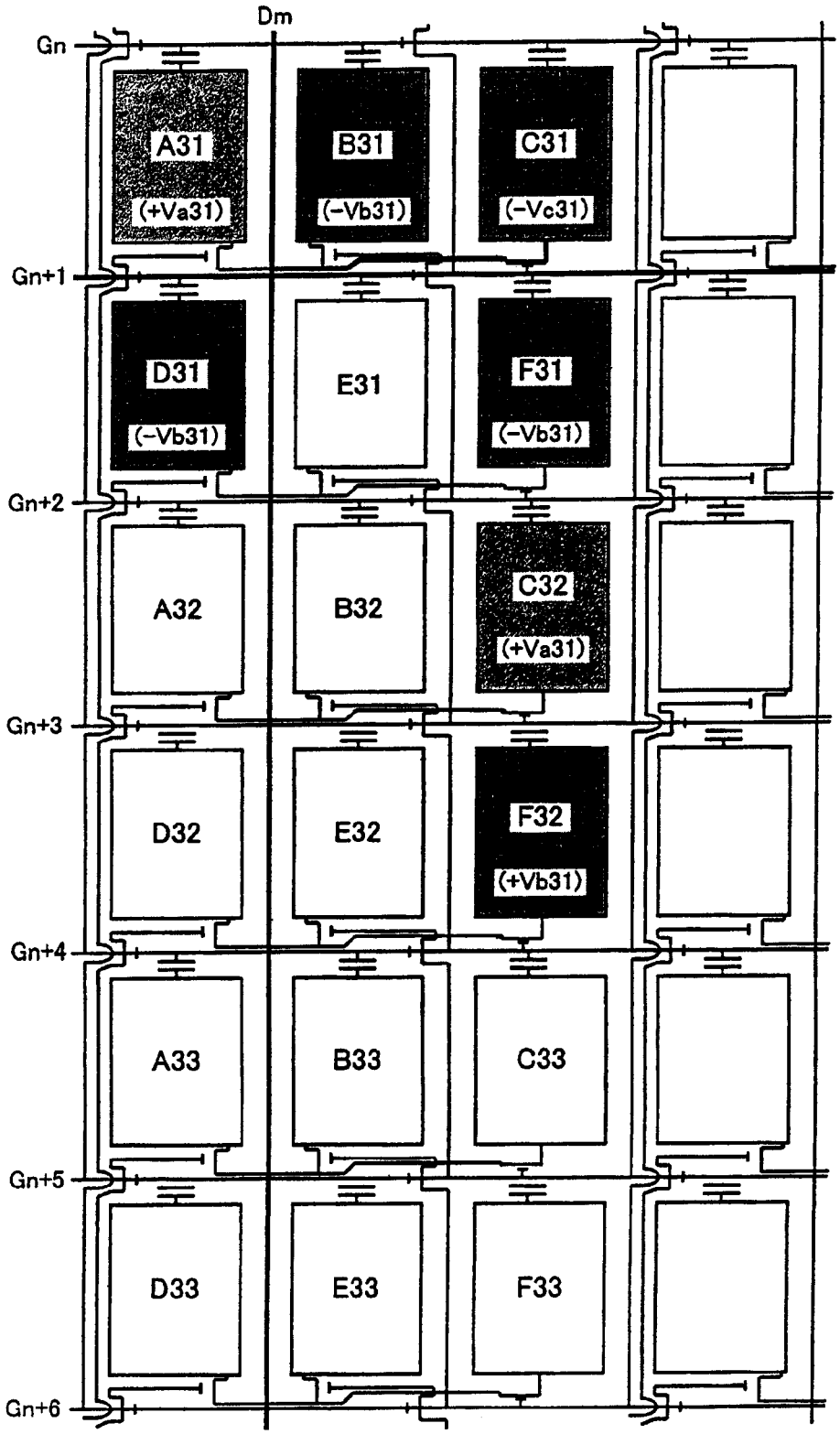
FIG. 23 is a view showing an operation of the circuit of the liquid crystal display device of the third embodiment of the present invention, showing a next step of FIG. 22.

Furthermore, during the following period from time t2 to time t3 (third timing), the potential supplied from the signal line Dm is changed to a potential Vc31 to be applied to the pixel electrode C31. Here, during the period from time t2 to time t3, as shown in FIG. 20, only the scan line Gn+1 is set at the selection potential. Then, as shown in FIG. 23, the third TFT M33 is turned on, and the potential Vc31 of the signal line Dm is applied to the pixel electrode C31 through the third TFT M33. Thus, the potential Vc31 of the pixel electrode C31 is determined.

Note that the period from time t0 to time t3 corresponds to one horizontal scan period (first horizontal scan period). The pixel drive as described above is carried out during this period, and thus the potential of the signal line Dm can be supplied to the pixel electrodes A31, B31 and C31 (first group of pixel electrodes) by time division.

Figure 24:
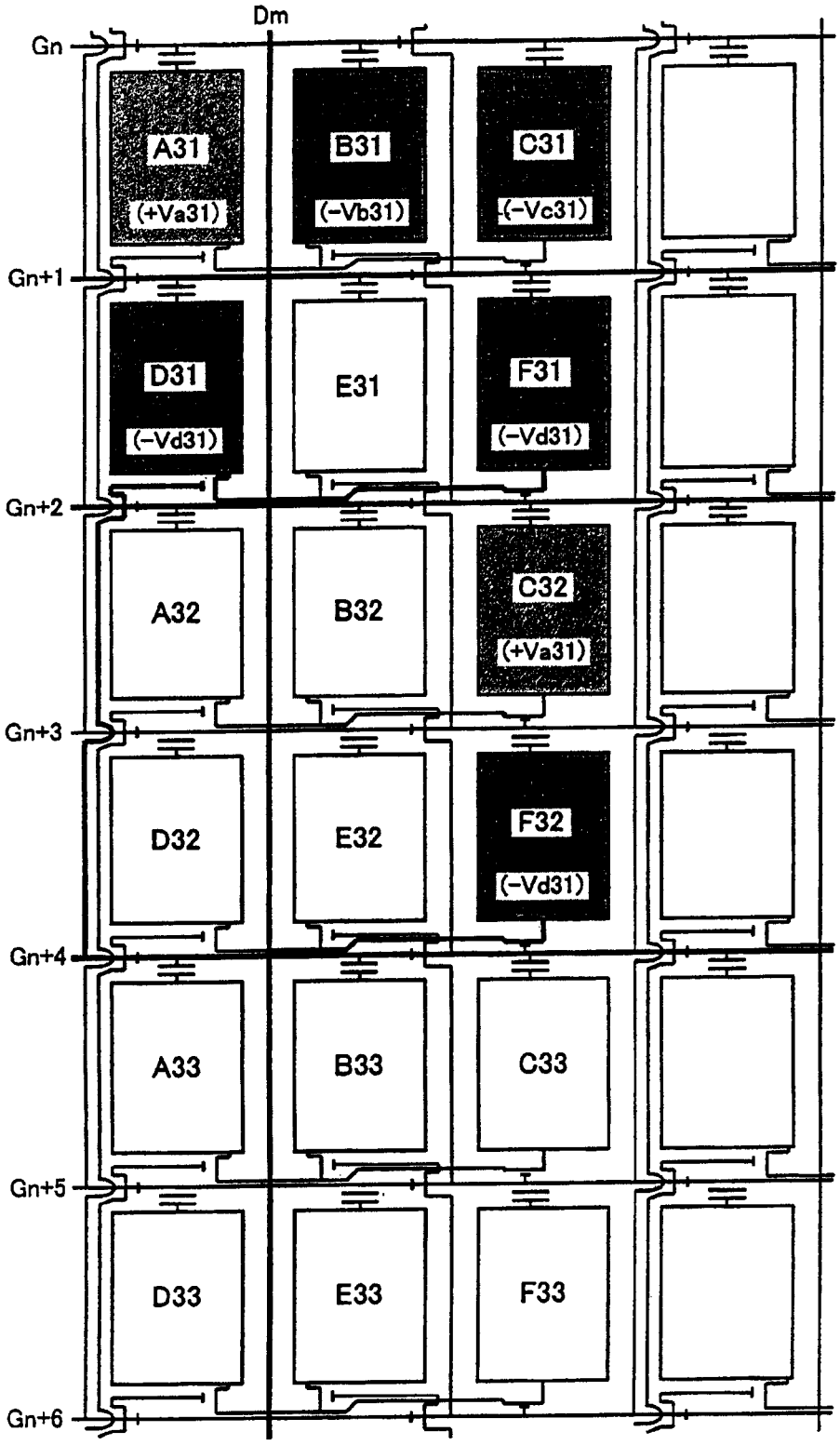
FIG. 24 is a view showing an operation of the circuit of the liquid crystal display device of the third embodiment of the present invention, showing a next step of FIG. 23.

Then, during the following period from time t3 to time t4, after the scan line Gn+1 is set at a non-selection potential, the potential of the signal line Dm is changed to the potential Vd31 to be applied to the pixel electrode D31. Then, as shown in FIG. 20, the scan lines Gn+2 and Gn+4 are set at the selection potential. Thus, as shown in FIG. 24, the first and second TFTs M31 and M32 connected to the scan lines Gn+2 and Gn+4 are turned on, and the potential Vd31 is applied to the pixel electrode D31. Moreover, in this case, since the third TFT M33 connected to the scan lines Gn+2 and Gn+4 is turned on, the potential Vd31 is supplied to the pixel electrodes F31 and F32.

Figure 25:
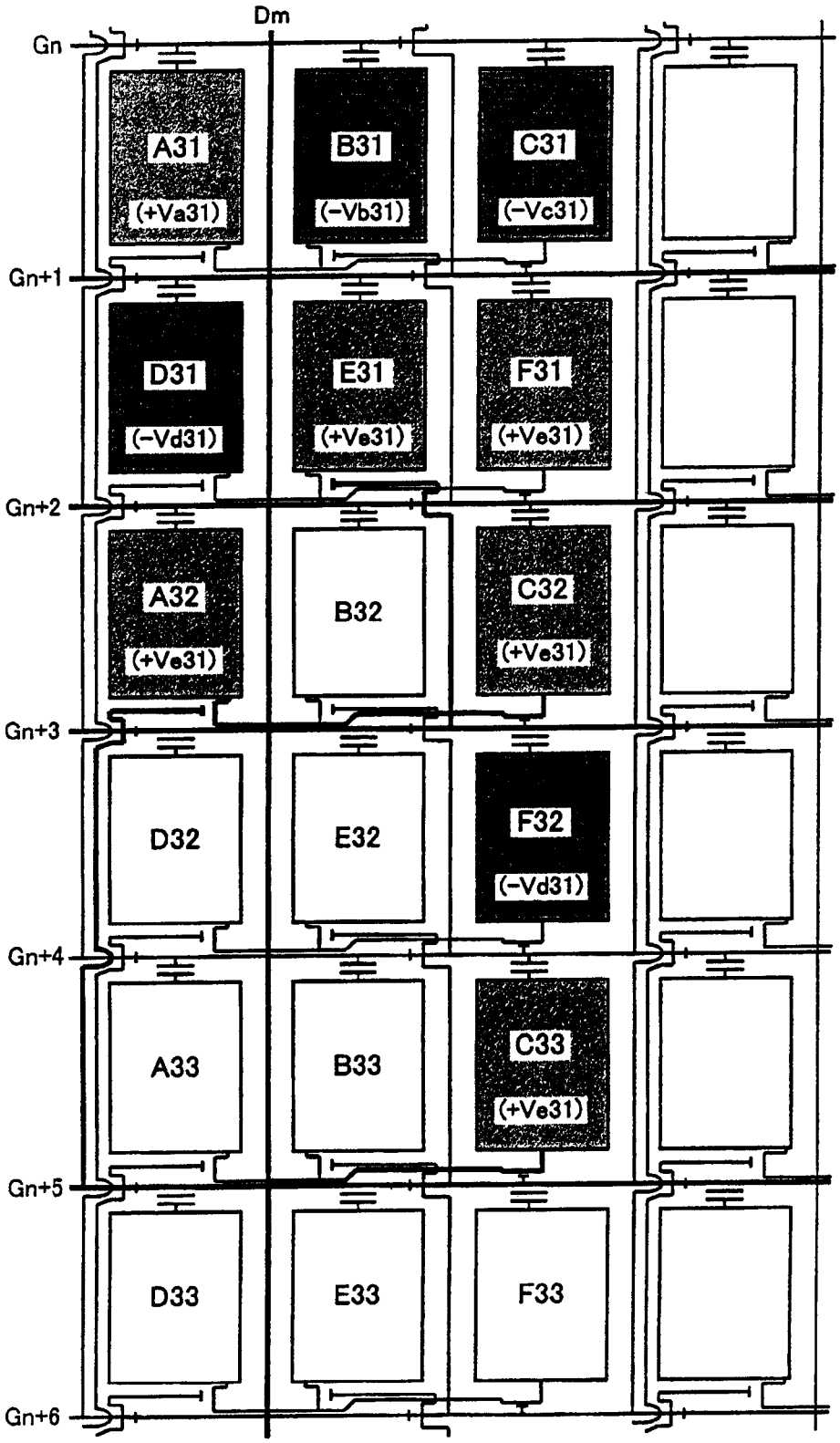
FIG. 25 is a view showing an operation of the circuit of the liquid crystal display device of the third embodiment of the present invention, showing a next step of FIG. 24.

Furthermore, during the following period from time t4 to time t5, as shown in FIG. 20, the scan line Gn+4 is set at the non-selection potential, and the polarity of the potential of the signal line Dm is inverted again to be positive, and the potential is changed to the potential Ve31 to be applied to the pixel electrode E31. Then, as shown in FIG. 25, the scan lines Gn+2 and Gn+3 are set at the selection potential, and thus the fifth TFT M35 connected to the scan line Gn+2 is turned on. Moreover, the potential of the scan line Gn+3 is supplied to the fourth TFT M34, and thus the fourth TFT M34 is turned on. Consequently, the potential Ve31 is applied to the pixel electrode E31. In addition, in this case, since the third TFT M33 connected to the scan lines Gn+2 and Gn+4 is turned on, the potential Ve31 is supplied to the pixel electrodes F31 and C32.

Figure 26:
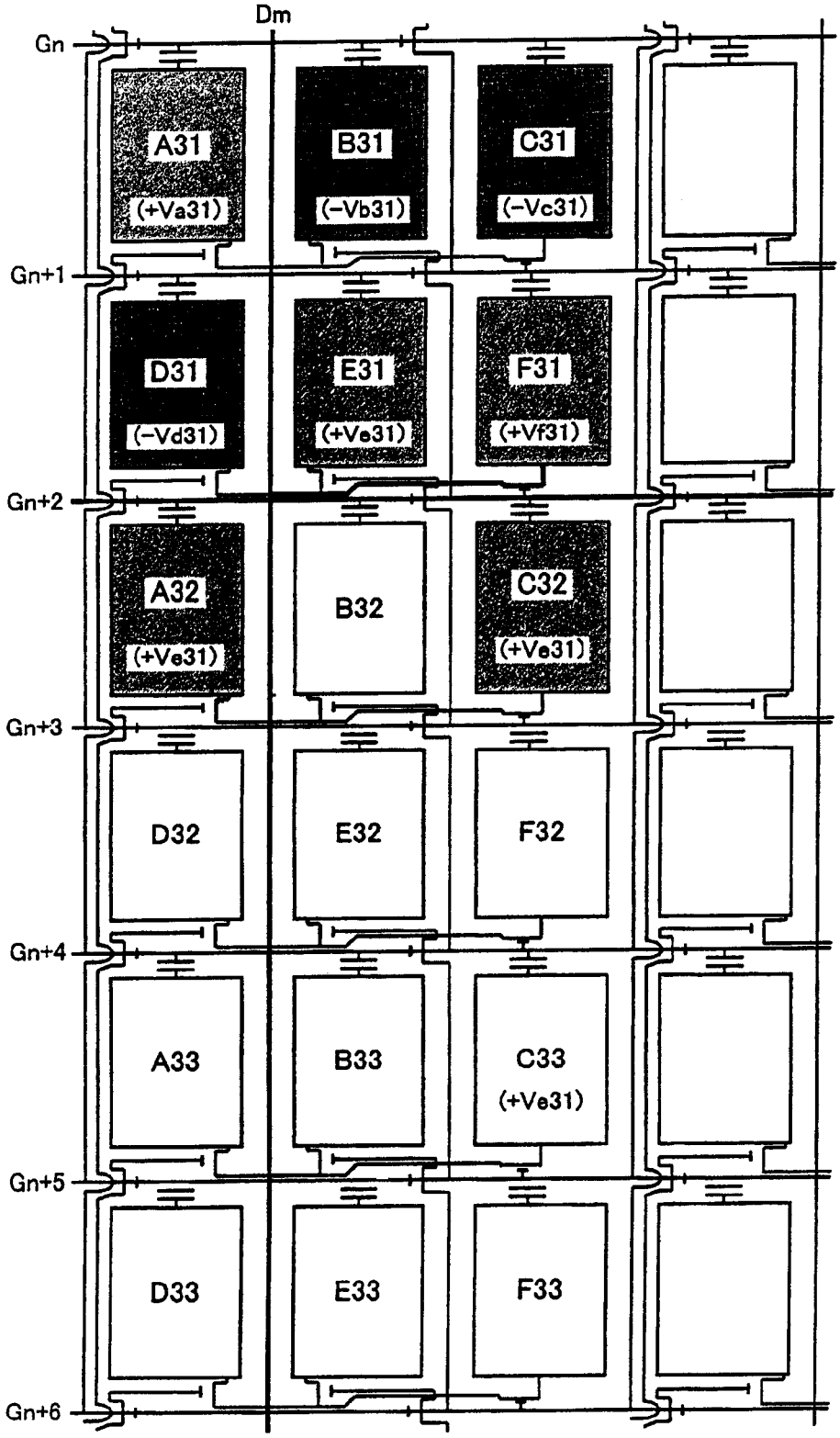
FIG. 26 is a view showing an operation of the circuit of the liquid crystal display device of the third embodiment of the present invention, showing a next step of FIG. 25.

Moreover, during the following period from time t5 to time t6, as shown in FIG. 20, the scan line Gn+3 is set at the non-selection potential, and the potential of the signal line Dm is changed to the potential Vf31 to be applied to the pixel electrode F31. Then, in this case, since only the scan line Gn+2 is set at the selection potential, as shown in FIG. 26, the third TFT M33 connected to the scan line Gn+2 is turned on, and the potential Vf31 is supplied to the pixel electrode F31.

In such a manner, during one horizontal scan period (period from time t3 to time t6), the potentials Vd31, Ve31 and Vf31 can be supplied to the pixel electrodes D31, E31 and F31, respectively, by time division.

By iterating a procedure similar to the above, the potentials of the pixel electrodes including the pixel electrodes A32 to C32 are determined by time division.

Consequently, each pixel is driven in a state where the potential Va31 supplied to the pixel electrode A31 and the potentials Vb31 and Vc31 supplied to the pixel electrodes B31 and C31 are made reverse in polarity, and in a state where the potential Vd31 supplied to the pixel electrode D31 and the potential Ve31 and Vf31 supplied to the pixel electrodes E31 and F31 are made reverse in polarity. Moreover, the pixel electrodes A31 and D31 are reverse from each other in polarity, and the pixel electrodes B31 and C31 and the pixel electrodes E31 and F31 are reverse from each other in polarity. Therefore, the line inversion drive is realized, in which the polarity is inverted for every row.

Next, description will be made for the precharge method of a pixel.

In this third embodiment, for example, when the pixel electrode B31 is charged, the pixel electrode D31 (specified pixel electrode) located at the first later stage is selected. Specifically, as shown by chain lines in FIG. 20, during the period from time t1 to time t2 (second time of first timing), in addition to the scan signals Gn+1 out and Gn+2 out, the potential of the scan signal Gn+4 out is raised. Thus, as shown in FIG. 22, the scan lines Gn+2 and Gn+4 (specified scan lines, second group of scan lines) selecting the pixel electrode D31 are selected, and the first and second TFTs M31 and M32 controlling the supply of the display signal to the pixel electrode D31 are turned on. Accordingly, the same display signal as the display signal supplied to the pixel electrode B31 is supplied from the signal line Dm to the pixel electrode D31, to which the potential Vb31 is applied. Therefore, the pixel electrode D31 is precharged in the same polarity as that of the pixel electrode B31.

Note that, in this case, the scan line Gn+4 is selected, and thus the third TFT M33 controlling the supply of the display signal from the signal line Dm to the pixel electrode F32 is turned on. Accordingly, the potential Vb31 is also applied to the pixel electrode F32.

Thereafter, during the period from time t2 to time t3, any of the scan lines G is not selected for the precharge. Accordingly, as shown in FIG. 23, the potential Vb31 is maintained in the pixel electrode D31. Here, since the drive polarity of the pixels is inverted for every row, the potential to be actually charged to the pixel electrode D31 is reverse from the pixel electrode A31 in polarity. Moreover, since the pixel electrode A31 and the pixel electrode B31 are driven at the polarities reverse from each other, the potential Vb31 precharged to the pixel electrode D31 and the potential to be actually charged to the pixel electrode D31 are at the same polarity. Thereafter, in the period from time t3 to time t6 (second horizontal scan period) while the pixel electrodes A32, B32 and C32 (second group of pixel electrodes) are sequentially driven, during the period from time t3 to time t4 (first time of second timing), the scan lines Gn+2 and Gn+4 are simultaneously selected, and the pixel electrode D31 is charged. Therefore, the pixel electrode D31 is not precharged again during the period from the precharge to the charge. In addition, the same is established when the pixel electrode A32 is precharged. Accordingly, the precharge method of this third embodiment meets the following two conditions A and B.

A: During a period from precharge to charge of the pixel electrode Y, the pixel electrode Y is not precharged simultaneously while other pixel electrodes than the pixel electrodes X and Y are being charged; and B: The charged pixel electrodes Y and X have the same polarity, and selection timings (charged timings) thereof are proximate to each other.

Such precharge method is shown in matrix in FIG. 27. In the matrix of FIG. 27, columns denoted by codes A, B and C indicate timing when the pixel electrodes A31, B31 and C31 are driven, respectively. In addition, rows denoted by codes g(n+1), g(n+2) . . . represent the scan lines G(n+1), G(n+2). . . . Moreover, items of the matrix indicate, by the presence of hatchings, as to whether or not the scan lines G(n+1), G(n+2) . . . are selected at timing when the pixel electrodes A31, B31 and C31 are driven. For example, a hatching at row 1 column 1 of this matrix indicates that the scan line G(n+1) is selected at the timing when the pixel electrode A31 is selected.

In addition, a letter of A, B or C . . . displayed in each item of the matrix indicates that any of the pixel electrodes A31, B31, and C31 . . . is driven by selecting one corresponding to the item from the scan lines G(n+1), G(n+2) . . . . For example, the letters "A" are displayed in row 1 column 1 and in row 3 column 1 in the matrix. Thus, indicated is that the pixel electrode A31 is driven by simultaneously selecting the scan lines G(n+1) and G(n+3) at the timing when the pixel electrodes A31, A32 . . . are to be driven. In addition, letters of "PD" displayed on the matrix indicate that the pixel electrode D31 is precharged by selecting the scan lines G(n+1), G(n+2) . . . corresponding to the items. For example, the display of "PD" on row 2 column 2 and on row 4 column 2 of the matrix indicates that the pixel electrode D31 is precharged and driven by selecting the scan lines G(n+2) and G(n+4) simultaneously at timing when the pixel electrode B31 is to be driven.

According to this matrix, it can be understood that the precharge of a pixel electrode (D31) is carried out at timing when a pixel electrode (B31) located in a different column is charged, and that a group of scan lines (Gn+2 and Gn+3) for carrying out the precharge and a group of scan lines (Gn+1 and Gn+2) for carrying out the charge duplicate.

As described above, in this third embodiment, while the conditions necessary for the precharge being satisfied, the charge and precharge for the pixel electrodes having the multiplexed pixel structure can be carried out, and thus the highly defined liquid crystal display device 1 can be driven accurately.

Moreover, in this third embodiment, for example, the pixel electrode D31 is precharged when the pixel electrode B31 is charged, and the pixel electrode A32 is precharged when the pixel electrode E32 is charged. In such a manner, among the pixel electrodes including those in the columns different from that of the pixel electrode to be charged, the pixel electrodes meeting the above-described conditions A and B are selected. Thus, in comparison with the case of selecting the pixel electrodes meeting the above-described conditions A and B only among the pixel electrodes located in the same column, the selection range is expanded. Accordingly, the interval between the row where the pixel electrode to be charged is present and the row where the pixel electrode to be precharged simultaneously therewith is present can be narrowed. Thus, the time interval from the precharge to the charge can be shortened to make it possible to minimize an influence thereof to pixels other than the display pixels.

In addition, in this third embodiment, scan lines G (Gn+1 and Gn+2) are selected in order to charge the pixel electrode B31, and scan lines G (Gn+2 and Gn+4) are selected in order to precharge the pixel electrode D32 simultaneously when the pixel electrode B31 is charged. As described above, the configuration is employed, in which the selection control line of the pixel electrode to be charged and the selection control line of the pixel electrode to be precharged duplicate. Thus, the interval between the row where the pixel electrode to be charged is present and the row where the pixel electrode to be precharged simultaneously therewith can be narrowed, thus enabling the above-described effect to be more remarkable.

FOURTH EMBODIMENT

Next, description will be made for a fourth embodiment of the present invention.

In this fourth embodiment, since the entire configuration of a liquid crystal display device 1 and the circuit configuration of an array substrate are common to those of the first embodiment, here, description of the configurations common to those of the first embodiment will be omitted, and description will be mainly made for points different from those of the first embodiment.

The different point of this fourth embodiment from that of the first embodiment is a point regarding the operation of the liquid crystal display device 1. Hereinafter, description will be made for the operation of the liquid crystal display device 1.

Figure 28:
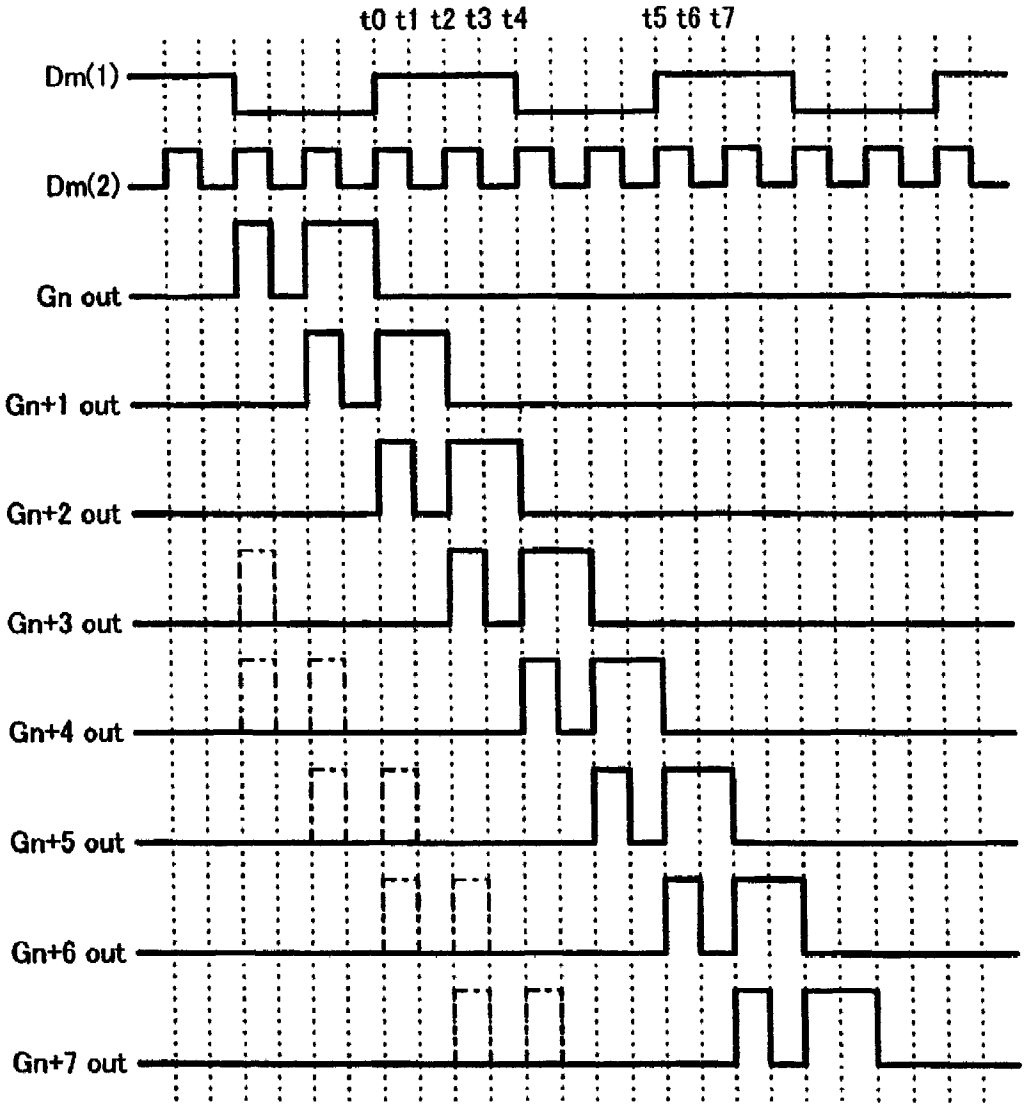
FIG. 28 is a timing chart of display signals and scan signals, schematically showing a fourth embodiment of the present invention.

In FIG. 28, diagrams Gn out to Gn+7 out represent waveforms of scan signals outputted to the scan lines Gn to Gn+7, which are generated by shift pulses propagating to the shift registers SR. Specifically, at timing when a portion represented by each solid line or chain line in these diagrams rises, the relevant scan line G is selected, and at timing when the portion does not rise, the relevant scan line G is not selected. Note that, among the rising portions of these diagrams, the portions represented by the solid lines indicate timing when the display signal voltages to be maintained in one horizontal scan period by pixel electrodes are written thereto. Moreover, the portions represented by the chain lines indicate timing when display signal voltages are preliminarily written to the pixel electrodes in order to compensate the shortage of the display signal voltages before the display signal voltages are written thereto. Specifically, the portions represented by the chain lines indicate the timing of precharge.

Moreover, Dm(1) shown in FIG. 28 indicates a potential of a data signal supplied from the signal line Dm, which indicates timing when the data signal is changed. Here, Dm(1) shown here includes a change in polarity. As will be described later, all of the pixel electrodes A11, B11, C11 and D11 are driven at the same polarity by the data signal Dm(1).

Figure 29:
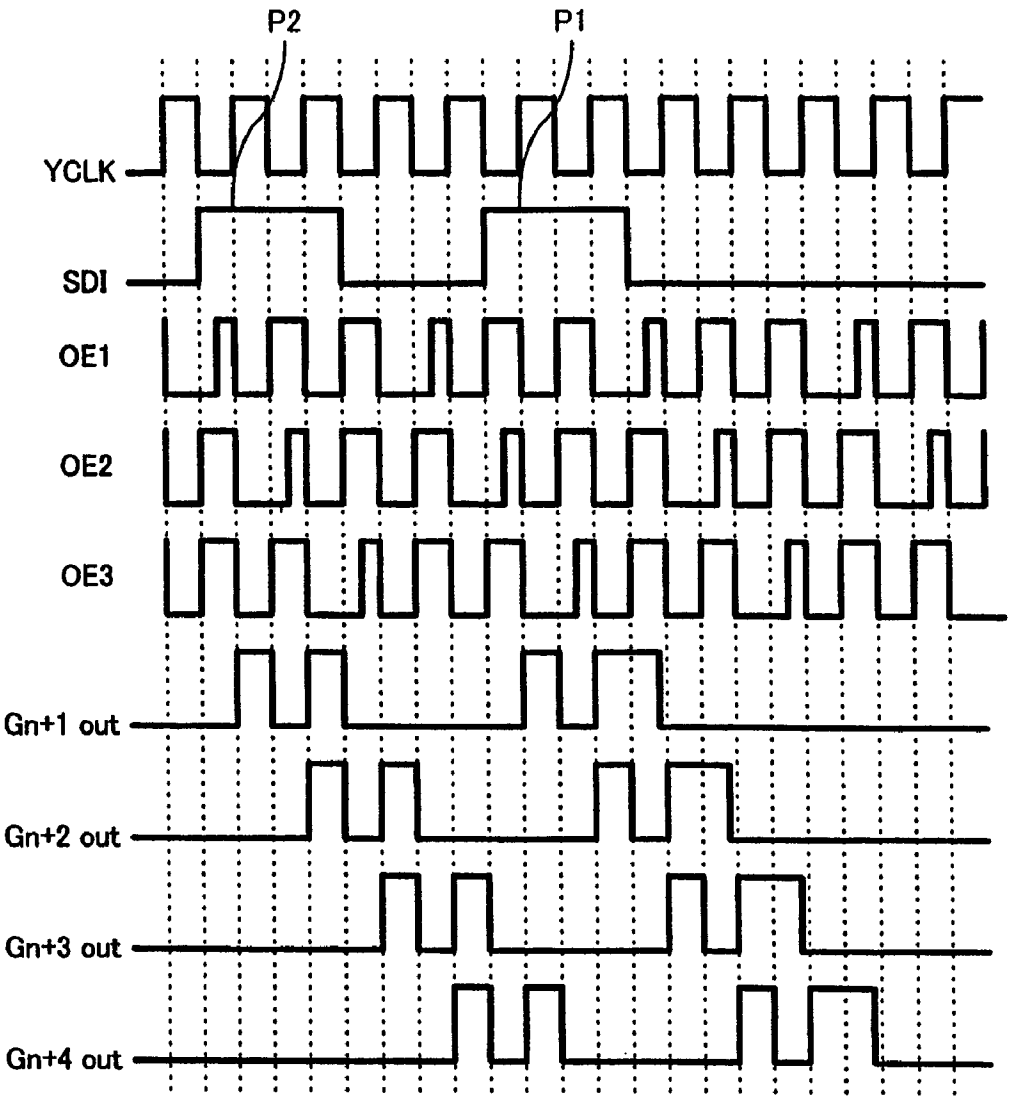
FIG. 29 is a timing chart of a clock signal, a shift pulse and scan signals of the fourth embodiment of the present invention.

Next, description will be made for the operation of the liquid crystal display device 1 of this fourth embodiment with reference to a timing chart of scan signals, which is shown in FIG. 28, a timing chart of clock signals, shift pulses and output control signals, which is shown in FIG. 29, and circuit diagrams of FIGS. 30 to 34.

Note that, also in this fourth embodiment, the precharge method is employed, in which, before a display signal voltage to be maintained by a pixel during one horizontal scan period of a screen is written to the pixel, another display signal voltage is preliminarily written thereto.

Moreover, FIG. 29 is a timing chart showing a relation among the scan signals Gn+1 out to Gn+4 out supplied to the scan lines Gn+1 to Gn+4, a shift pulse SDI outputted to the shift registers SR and the output control signals OE1 to OE3, both of which correspond to the abovedescribed scan signals, and a clock signal YCLK driving the shift registers SR. Note that, in the scan signals Gn+1 out to Gn+4 out shown in FIG. 29, the portions where the potentials rise for the precharge are also represented by solid lines.

In order to drive pixels in this liquid crystal display device 1, first, the shift pulse SDI is outputted from the pulse generation unit 9 of the control circuit 6 to the gate driver 5 (see FIG. 29).

As shown in FIG. 29, the shift pulse SDI is a signal row composed of a first pulse P1 with a time width from rise to fall for two cycles of the clock signal YCLK and a second pulse P2 with a time width from rise to fall for two cycles of the clock signal YCLK. Here, one cycle of the clock signal YCLK is equal to one horizontal scan period of the screen. Specifically, the shift pulse SDI is a signal row having a time width for six horizontal scan periods in total, in which the first pulse P1 has the time width for two horizontal scan periods, and the second pulse P2 with the time width for one horizontal scan period is continuous with the first pulse P1 with an interval for two horizontal scan periods spaced therefrom.

In the shift register unit 12 of the gate driver 5, the shift pulse SDI moves to the next shift register SR for one cycle of the clock signal YCLK synchronously with the rise of the clock signal YCLK. Therefore, by providing, to the shift pulse SDI, the time width for six horizontal scan periods, the shift pulse SDI sequentially moves while existing in two adjacent shift registers SR and two shift registers SR spaced therefrom by an interval for two registers. Here, by supplying the output control signals OE1 to OE3 as shown in FIG. 29 to the buffers B adjacent from one another, the buffers B connected to six shift registers SR are controlled simultaneously, and thus six scan lines G can be selected and controlled simultaneously. In addition, here, since the buffers B are turned on when values of the output control signals OE inputted thereto are "0", and turned off when the values are "1", the scan signals Gn+1 out to Gn+4 out will be as shown in a lower part of FIG. 29.

Next, description will be made for a procedure for charging a pixel electrode.

Figure 30:
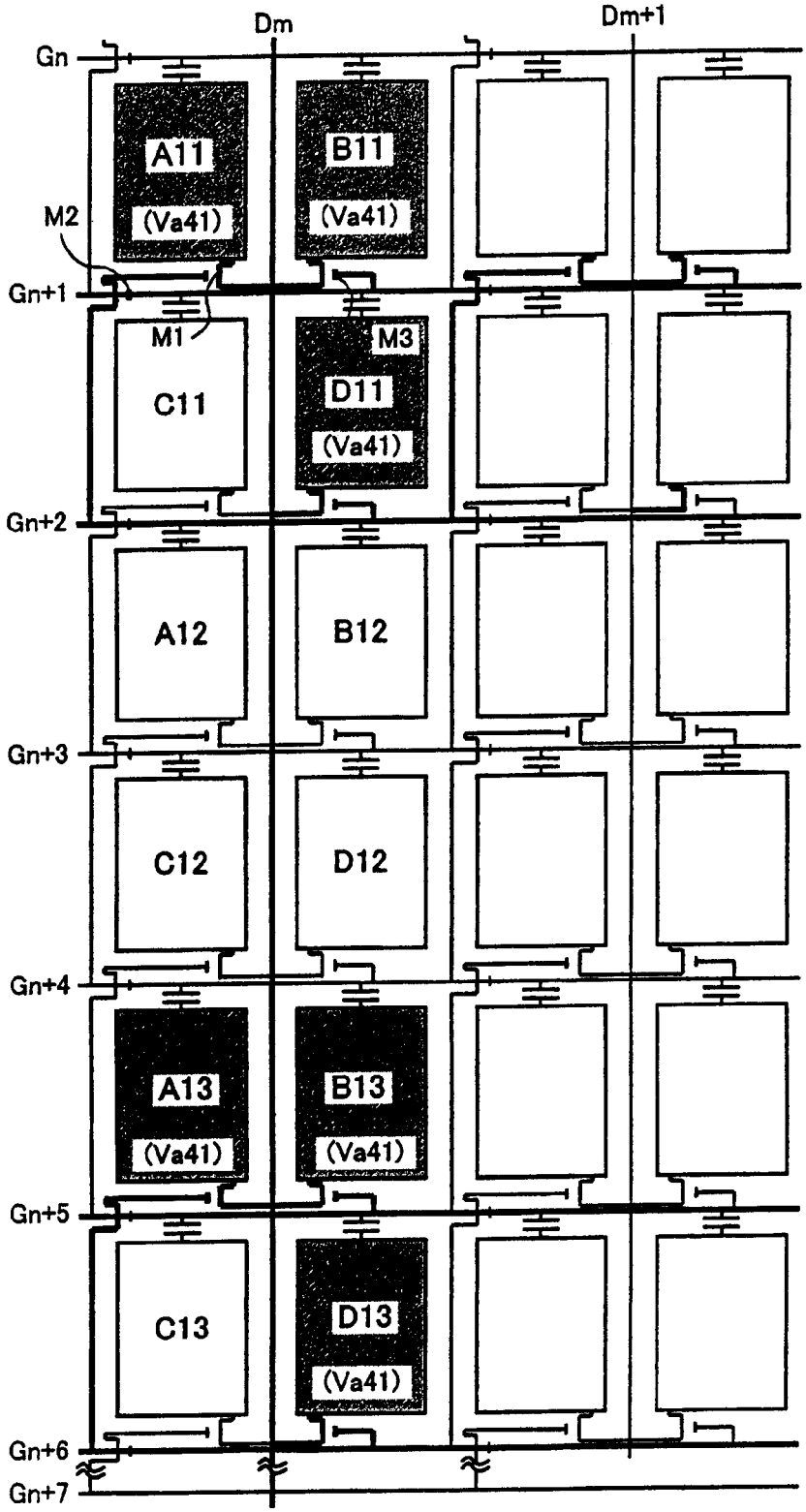
FIG. 30 is a view showing an operation of a circuit of a liquid crystal display device of the fourth embodiment of the present invention.

OAs shown in FIG. 28, when the scan signals Gn+1 out and Gn+2 out are generated and supplied to the scan lines Gn+1 and Gn+2 (first group of scan lines), if attention is paid to portions represented by the solid lines among the scan signals Gn+1 out and Gn+2 out, that is, timing when the display signal voltages are written to the pixel electrodes, then both of the scan lines Gn+1 and Gn+2 are selected during a period from time t0 to time t1 (first timing). Therefore, as shown in FIG. 30, the first to third TFTs M1 to M3 are turned on. Thus, a potential Va41 to be applied to the pixel electrode A11 from the signal line Dm is supplied to the pixel electrodes A11, B11 and D11. Thus, the potential Va41 of the pixel electrode A11 is determined. Note that, in FIG. 30, the selected scan lines Gn+1 and Gn+2 are represented by bold lines.

Figure 31:
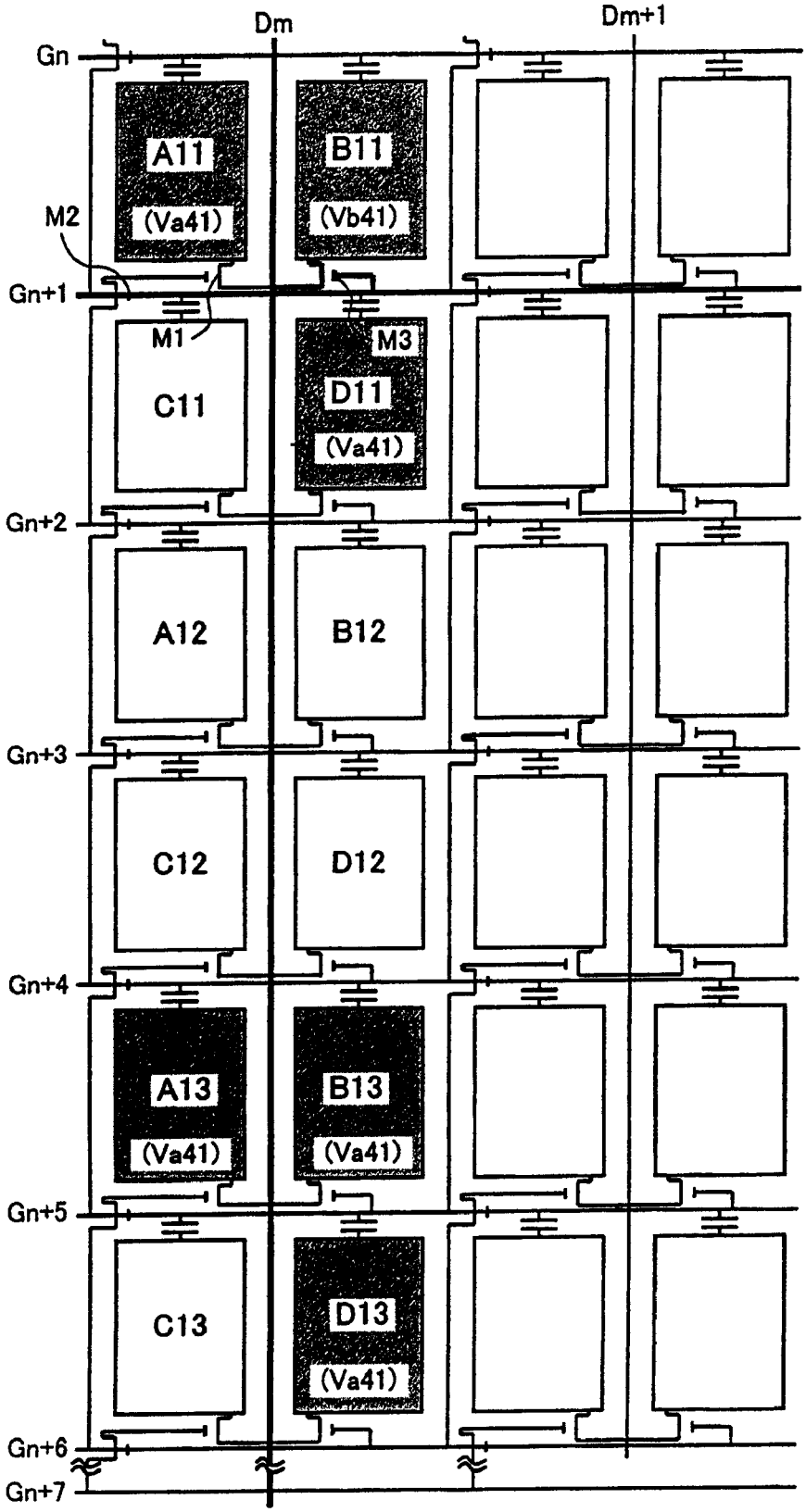
FIG. 31 is a view showing an operation of the circuit of the liquid crystal display device of the fourth embodiment of the present invention, showing a next step of FIG. 30.

Meanwhile, during the following period from time t1 to time t2 (second timing), the scan line Gn+2 is set at the non-selection potential, and only the scan line Gn+1 is selected. Accordingly, as shown in FIG. 31, only the third TFT M3 is turned on. Here, the potential supplied from the signal line Dm is changed to a potential Vb41 to be applied to the pixel electrode B11, and thus the potential Vb41 is supplied to the pixel electrode B11 to determine the potential of the pixel electrode B11. Note that the period from time t0 to time t2 corresponds to one horizontal scan period (first horizontal scan period). The pixel drive as described above is carried out during this period, and thus the potential of the signal line Dm can be supplied to the pixel electrodes A11 and B11 (first group of pixel electrodes) by time division.

After the scan line Gn+1 is set at the non-selection potential, the potential of the signal line Dm is changed to a potential Vc41 to be applied to the pixel electrode C11.

Figure 32:
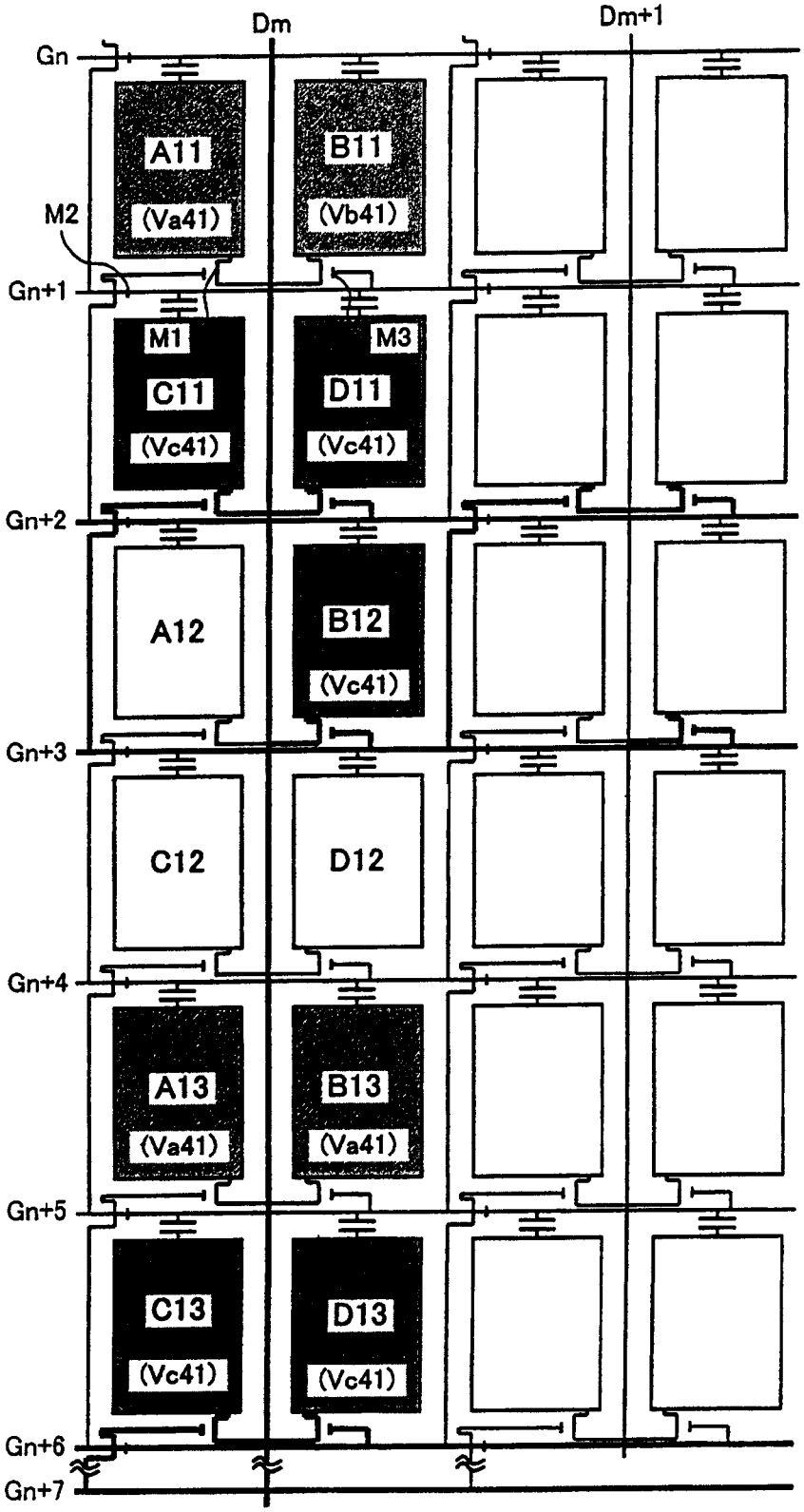
FIG. 32 is a view showing an operation of the circuit of the liquid crystal display device of the fourth embodiment of the present invention, showing a next step of FIG. 31.

Here, in FIG. 28, when attention is paid to the scan signals Gn+2 out and Gn+3 out, both of the scan lines Gn+2 and Gn+3 are selected during the period from time t2 to time t3. Thus, as shown in FIG. 32, the potential Vc41 to be applied from the signal line Dm to the pixel electrode C11 is supplied to the pixel electrodes C11, D11 and B12, and the potential Vc41 of the pixel electrode C11 is determined.

Figure 33:
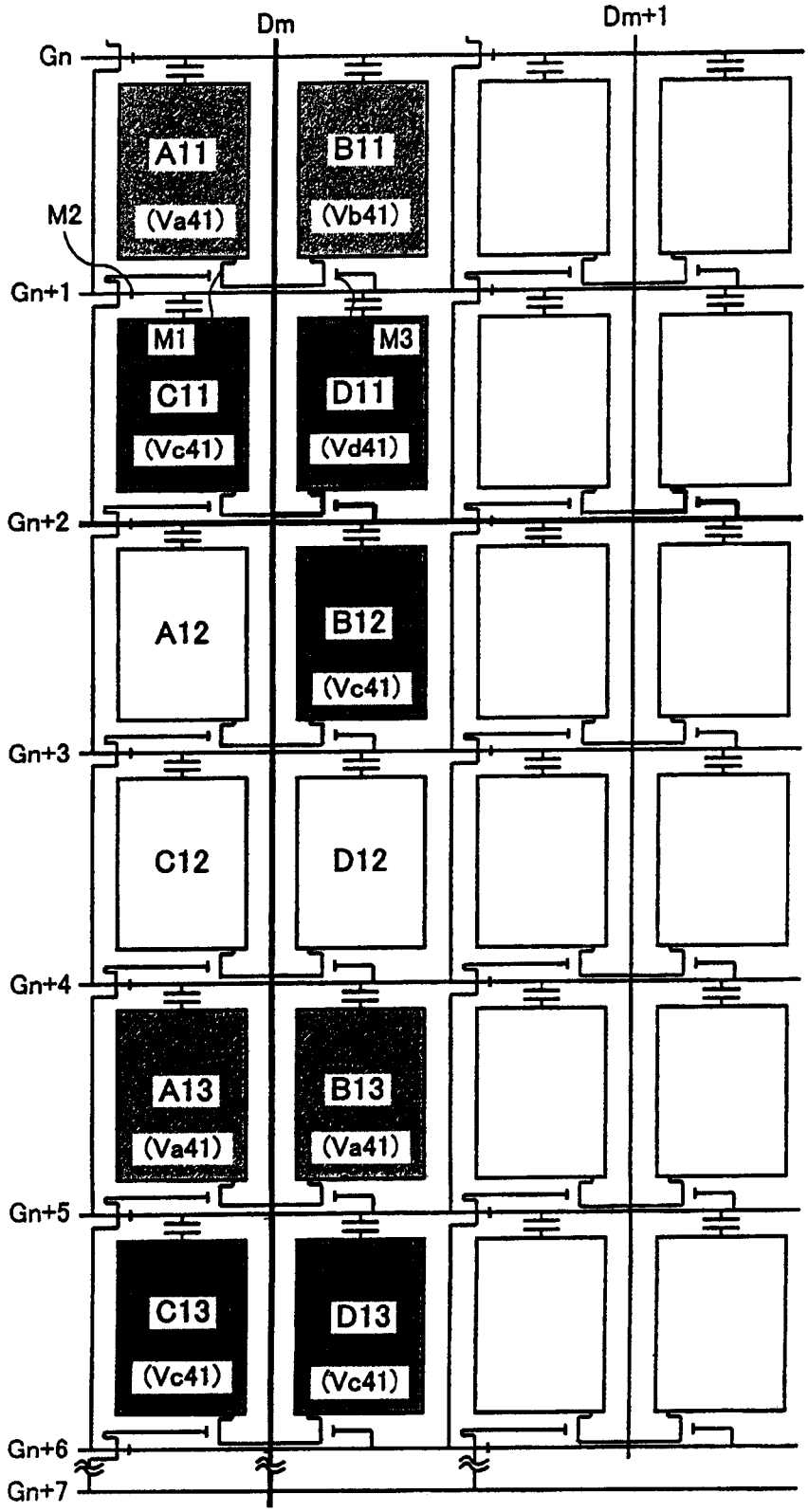
FIG. 33 is a view showing an operation of the circuit of the liquid crystal display device of the fourth embodiment of the present invention, showing a next step of FIG. 32.

In addition, during the following period from time t3 to time t4, the scan line Gn+3 is set at the non-selection potential, and only the scan line Gn+2 is selected. Therefore, as shown in FIG. 33, the potential supplied from the signal line Dm is changed to a potential Vd41 to be applied to the pixel electrode D11, and thus the potential Vd41 is supplied to the pixel electrode D11 to determine the potential of the pixel electrode D11.

Furthermore, after the time t4, as shown in FIG. 28, the polarity of the scan signal Dm(1) is inverted.

Then, after the time t4, the potentials Va42, Vb42, Vc42 and Vd42 are supplied to pixel electrodes A12, B12, C12 and D12 at a lower stage than the pixel electrodes A11, B11, C11 and D11 in a similar procedure. Thereafter, the potentials to be supplied to the pixel electrodes are supplied thereto while inverting the polarity for every two rows. Accordingly, the liquid crystal display device 1 is driven as a display device of a two-line inversion drive, in which the polarity is inverted for every two rows.

Next, description will be made for the precharge method of pixels.

In this fourth embodiment, for example, when the pixel electrode A11 is charged, a pixel electrode A13 (specified pixel electrode) at the fourth later stage than the pixel electrode A11 is selected as a pixel electrode meeting the above-described conditions A and B.

Specifically, as shown by the chain lines in FIG. 28, the potentials of the scan signals Gn+5 out and Gn+6 out are raised during the period from time t0 to time t1. Thus, as shown in FIG. 30, the scan lines Gn+5 and Gn+6 (second group of scan lines, specified scan lines) selecting the pixel electrode A13 are selected and controlled, and the first and second TFTs M1 and M2 controlling the supply of the display signal to the pixel electrode A13 are turned on. Accordingly, the same display signal as the display signal supplied to the pixel electrode A11 is supplied from the signal line Dm to the pixel electrode A13, to which the potential Va41 is applied. Therefore, the pixel electrode A13 is precharged in the same polarity as that of the pixel electrode A11.

Note that, in this case, the scan line Gn+5 is selected, and thus the third TFT M3 controlling the supply of the display signal from the signal line Dm to the pixel electrode B13 is turned on. In addition, a scan line Gn+6 is selected, and thus a third TFT M3 controlling a supply of a display signal from the signal line Dm to a pixel electrode D13 is turned on. Accordingly, the potential Va41 is also applied to these pixel electrodes B13 and D13. Thereafter, during the period from time t1 to time t2, as shown in FIG. 28, any of the scan lines G is not selected for the precharge. Accordingly, as shown in FIG. 31, the potential Va41 is still maintained in the pixel electrodes A13, B13 and D13.

Next, during the period from time t2 to time t3 while the pixel electrode C11 is being charged, as shown by chain lines in FIG. 28, potentials of scan signals Gn+6 out and Gn+7 out rise, and thus scan signal lines Gn+6 and Gn+7 are selected and controlled. Thus, the first and second TFTs M1 and M2 controlling a supply of display signals to the pixel electrodes C13 and D13 are turned on. Then, as shown in FIG. 32, the display signal is supplied from the signal line Dm to the pixel electrode C13, and thus a potential Vc41 that is the same as that of the pixel electrode C11 is applied to the pixel electrode C13. Accordingly, the pixel electrode C13 can be precharged with the potential of the same polarity as that of the pixel electrode C11. Note that, in this case, the scan line Gn+6 is selected, and thus the third TFT M3 controlling the supply of the display signal from the signal line Dm to the pixel electrode D13 is turned on. Accordingly, the potential Vc41 is also applied to the pixel electrode D13.

Furthermore, during the following period from time t3 to time t4, as shown in FIG. 28, any of the scan lines G is not selected for the precharge. Accordingly, as shown in FIG. 33, the pixel electrodes A13 and B13 maintain the potential Va41, and the pixel electrodes C13 and D13 maintain the potential Vc41.

In a similar procedure to the above, the precharge is carried out for the pixel electrodes at a later stage than the pixel electrodes to be charged.

Incidentally, as described above, it is desirable that a pixel electrode Y precharged simultaneously when a certain pixel electrode X is charged have relations as the following A and B to the pixel electrode X.

A: During a period from precharge to charge of the pixel electrode Y, the pixel electrode Y is not precharged simultaneously while other pixel electrodes than the pixel electrodes X and Y are being charged; and B: The charged pixel electrodes Y and X have the same polarity, and selection timings (charged timings) thereof are proximate to each other.

In this precharge method of the fourth embodiment, for example, attention is paid to the scan signals Gn+5 out and Gn+6 out shown in FIG. 28. Then, during the period from time t0 to time t1 (first timing), the pixel electrode A13 (specified pixel electrode) is precharged by selecting the scan lines Gn+5 and Gn+6 (specified scan lines). Thereafter, before both of the scan lines Gn+5 and Gn+6 (second group of scan lines) are selected during the period from time t5 to time t6 (see FIG. 1, first time of the second timing) in the period during time t5 to time t7 (second horizontal scan period) while the pixel electrodes A12 and B12 (second group of pixel electrodes) are being sequentially driven to charge the pixel electrode A13, at least any one of the scan lines Gn+5 and Gn+6 is not selected during the drive of other pixel electrodes. Specifically, signals different from those during the charge are outputted to the scan lines Gn+5 and Gn+6. Accordingly, the pixel electrode A13 is not precharged again until being charged during the period from time t5 to time t6 after being precharged during the period from time t0 to time t1. Accordingly, the precharge is carried out as described above to meet the above-described condition A. Specifically, during the period from the precharge to the charge of the pixel electrode Y, the pixel electrode Y is not precharged simultaneously while other pixel electrodes than the pixel electrodes X and Y are being charged. The same is established also for the other pixel electrodes arrayed on the same column as that of the pixel electrodes C13 and A13.

Such precharge method is shown in matrix in FIG. 34. In the matrix of FIG. 34, columns denoted by codes A and B indicate timing when the pixel electrodes A11, B11 and C11 are driven, respectively. In addition, rows denoted by codes g(n+1), g(n+2) . . . represent the scan lines G(n+1), G(n+2) . . . . Moreover, items of the matrix indicate, by the presence of hatchings, as to whether or not the scan lines G(n+1), G(n+2) . . . are selected at timing when the pixel electrodes A11 and B11 are driven. For example, a hatching at row 1 column 1 of this matrix indicates that the scan line G(n+1) is selected at the timing when the pixel electrode A31 is driven.

In addition, a letter of A or B displayed in each item of the matrix indicates that any of the pixel electrodes A11, B11 . . . is driven by selecting one corresponding to the item from the scan lines G(n+1), G(n+2). . . . For example, the letters "A" are displayed in row 1 column 1 and in row 3 column 1 in the matrix. Thus, indicated is that the pixel electrode A11 is driven by simultaneously selecting the scan lines G(n+1) and G(n+2) at the timing when the pixel electrode A11 is to be driven. In addition, letters of "PA" displayed on the matrix indicate that the pixel electrodes A11, A12 . . . are precharged by selecting the scan lines G(n+1), G(n+2) . . . corresponding to the items. For example, the display of "PA" on row 5 column 1 and on row 6 column 1 of the matrix indicates that any of the pixel electrodes A11, A12 . . . (here, pixel electrode A13) is precharged and driven by selecting the scan lines G(n+5) and G(n+6) simultaneously at timing when the pixel electrode A11 is to be driven.

According to this matrix, it is understood that the precharge of a pixel electrode (A13) is carried out at timing when a pixel electrode (A11) located in the same column is charged, and that a group of scan lines (Gn+5 and Gn+6) for carrying out the precharge and a group of scan lines (Gn+1 and Gn+2) for carrying out the charge do not duplicate.

As described above, in this fourth embodiment, while the conditions necessary for the precharge being satisfied, the charge and precharge for the pixel electrodes having the multiplexed pixel structure can be carried out, and thus the highly defined liquid crystal display device 1 can be driven accurately.

FIFTH EMBODIMENT

Next, description will be made for a fifth embodiment of the present invention.

In this fifth embodiment, since the entire configuration of a liquid crystal display device 1 and the circuit configuration of an array substrate are common to those of the first embodiment, here, description of the configurations common to those of the first embodiment will be omitted, and description will be mainly made for points different from those of the first embodiment.

The different points of this fifth embodiment from those of the first embodiment are a point regarding structures of a control circuit 6' and a gate driver 5' and the operation of the liquid crystal display device 1.

Figure 35:
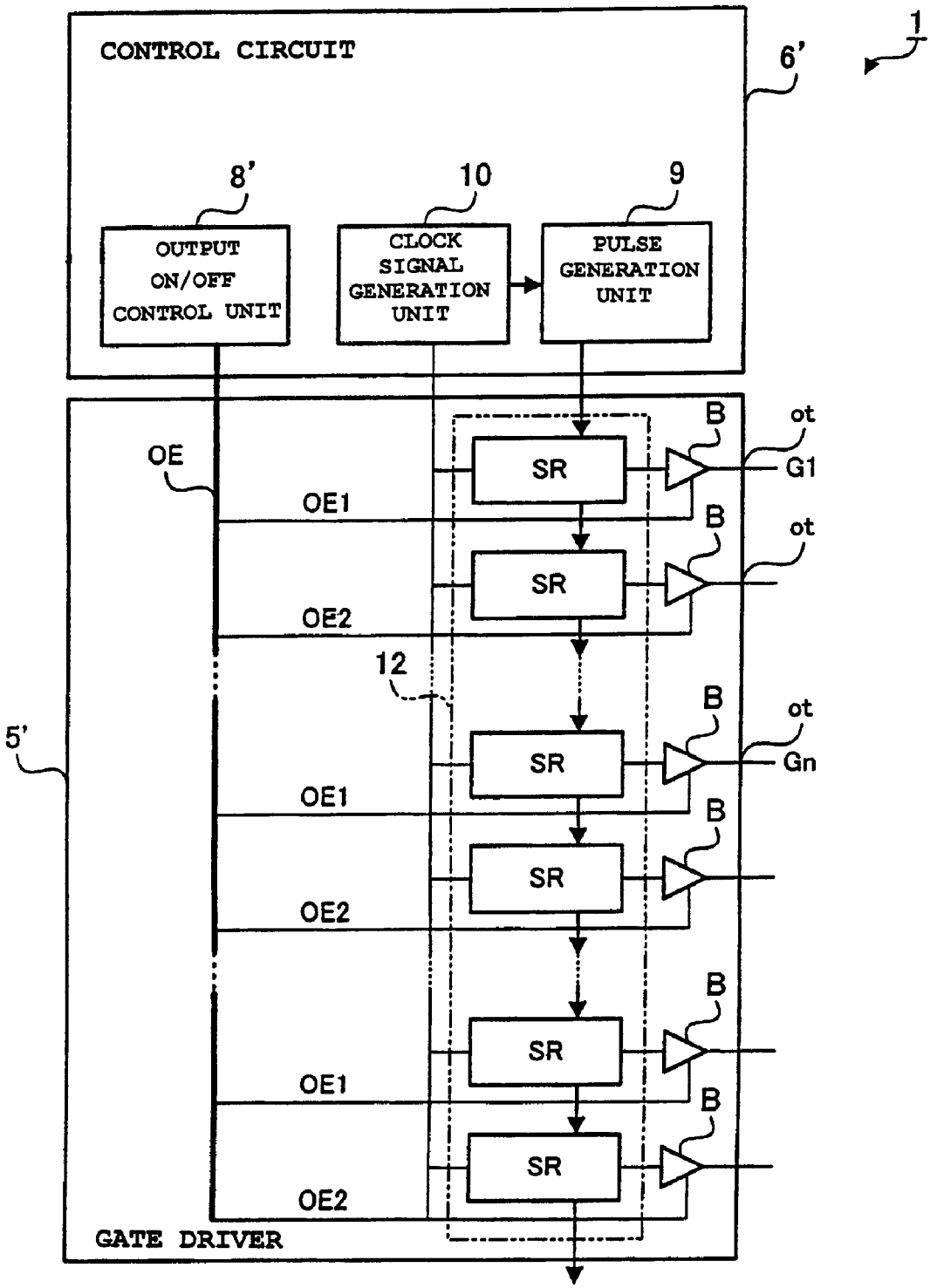
FIG. 35 is a view of configurations of a control circuit and a gate driver, schematically showing a fifth embodiment of the present invention.

First, description will be made for the control circuit 6' and the gate driver 5' in this fifth embodiment with reference to FIG. 35.

The different point of the control circuit 6' of the fifth embodiment from that of the control circuit 6 of the first embodiment is that an output on/off control unit 8' provided in the control circuit 6' outputs output control signals OE to two systems of output control lines OE1 and OE2. These two systems of output control lines OE1 and OE2 are allocated and connected to every two buffers B adjacent to each other of the gate driver 5'. Accordingly, the output on/off control unit 8' outputs output control signals different from each other to these output control lines OE1 and OE2, thus making it possible to individually control the two buffers B adjacent to each other.

Next, description will be made for the operation of the liquid crystal display device 1 in this fifth embodiment with reference to timing charts of FIGS. 36 and 37 and circuit diagrams of FIGS. 38 to 41.

Note that, in this fifth embodiment, the precharge of pixels is not carried out.

Figure 36:
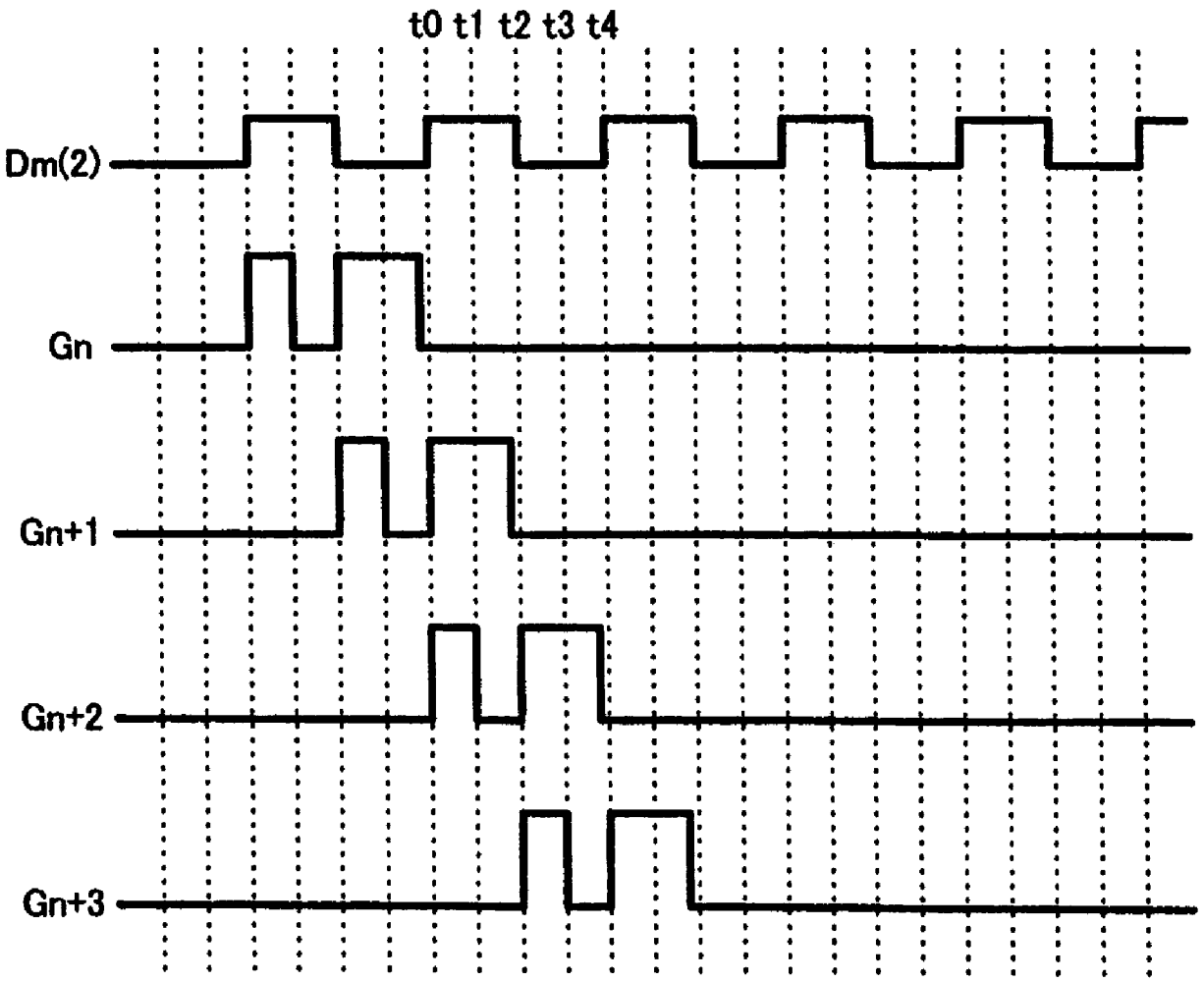
FIG. 36 is a timing chart of a display signal and scan signals of the fifth embodiment of the present invention.

In FIG. 36, diagrams Gn out to Gn+3 out represent waveforms of scan signals outputted to the scan lines Gn to Gn+3, which are generated by shift pulses propagating to the shift registers SR. Specifically, at timing when a portion of these diagrams rises, the relevant scan line G is selected, and at timing when the portion does not rise, the relevant scan line G is not selected.

Moreover, Dm(2) shown in FIG. 36 indicates a potential of a data signal supplied from the signal line Dm, which indicates timing when the data signal is changed. Here, Dm shown here includes a change in polarity. As will be described later, in accordance with the operation of the data signal Dm(2), the pixel electrode A11 is driven at the same polarity as that of the pixel electrode B11 and at a different polarity from that of the pixel electrodes C11 and D11.

Figure 37:
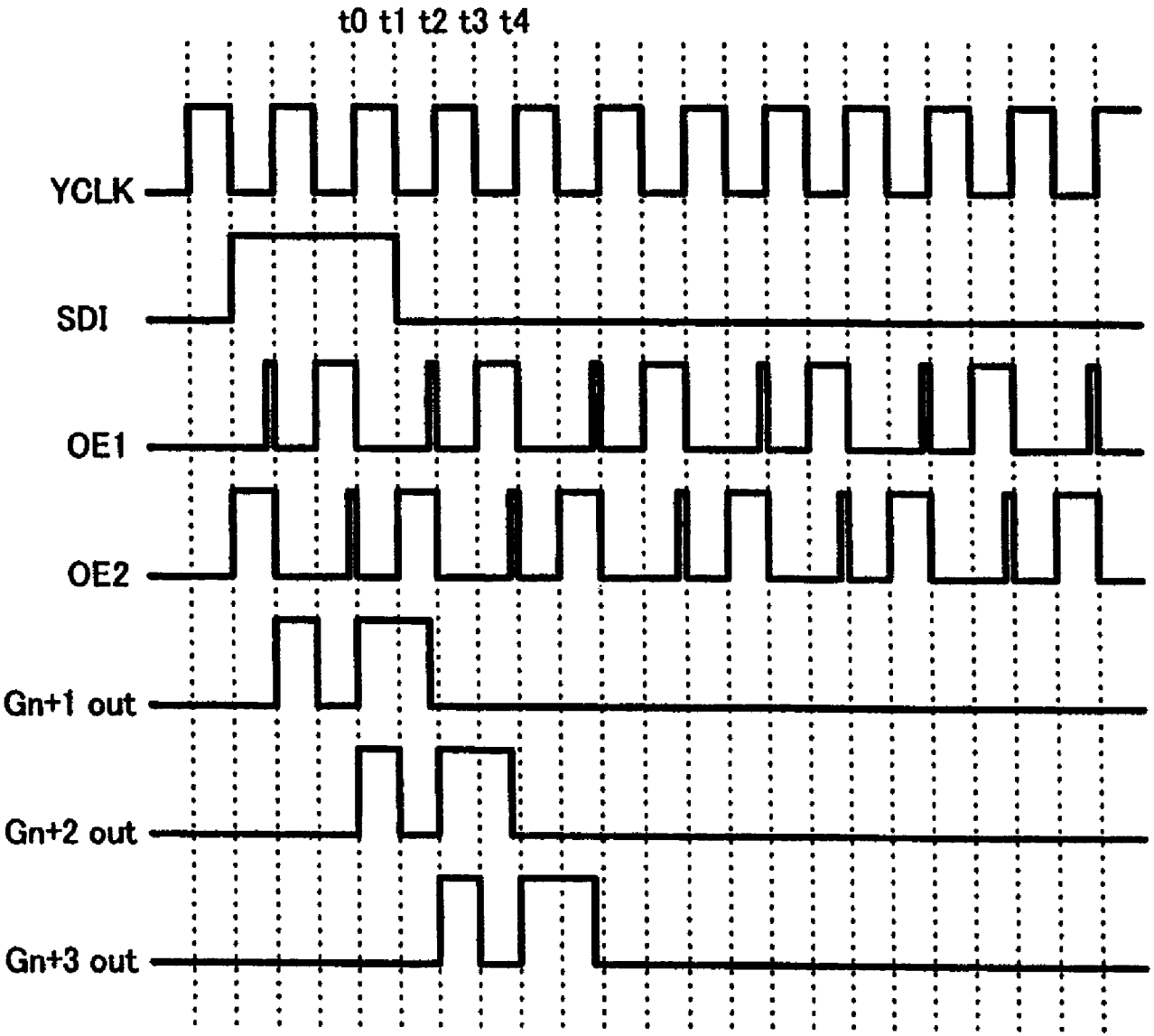
FIG. 37 is a timing chart of a clock signal, a shift pulse and scan signals of the fifth embodiment of the present invention.

Furthermore, FIG. 37 is a timing chart showing a relation among the scan signals Gn+1 out to Gn+3 out supplied to the scan lines Gn+1 to Gn+3, a shift pulse SDI outputted to the shift register SR and the output control signals OE1 and OE2, both of which correspond to the above-described scan signals, and a clock signal YCLK driving the shift registers SR.

In order to drive pixels in this liquid crystal display device 1, first, the shift pulse SDI is outputted from the pulse generation unit 9 of the control circuit 6' to the gate driver 5' (see FIG. 37).

As shown in FIG. 37, the shift pulse SDI has a time width from rise to fall for two cycles of the clock signal YCLK. Here, one cycle of the clock signal YCLK is equal to one horizontal scan period of the screen. Specifically, the shift pulse SDI has a time width for two horizontal scan periods.

In the shift register unit 12 of the gate driver 5', the shift pulse SDI moves to the next shift register SR for one cycle of the clock signal YCLK synchronously with the rise of the clock signal YCLK. Therefore, by providing, to the shift pulse SDI, the time width for two cycles of the clock signal YCLK, the shift pulse SDI sequentially moves while existing in two adjacent shift registers SR. Accordingly, by supplying the output control signals OE1 and OE2 as shown in FIG. 37 to the buffers B adjacent to each other, the buffers B connected to two shift registers SR are controlled simultaneously, and thus two scan lines G can be selected and controlled simultaneously.

The concrete operation of the gate driver 5' will be described as below. Note that the output control signal OE1 shown in FIG. 37 is supplied to the buffer B connected to each input end of the scan lines Gn+1, Gn+3 . . . . Meanwhile, the output control signal OE2 is supplied to the buffer B connected to each input end of the scan lines Gn+2, Gn+1 . . . .

At timing from time t0 to time t2 shown in FIG. 37, the shift pulse SDI is present in each of the shift registers SR connected to the scan lines Gn+1 and Gn+2. Here, during the period from time t0 to time t1, since both of the output control signals OE1 and OE2 supplied to the buffers B corresponding to the scan lines Gn+1 and Gn+2 have values "0", both of the buffers B connected to input ends of the scan lines Gn+1 and Gn+2 are turned on. Thus, data of the shift pulses SDI present in the shift registers SR is outputted as the scan signals Gn+1 out and Gn+2 out to the scan lines Gn+1 and Gn+2. Accordingly, during the period from time t0 to time t1, both of the scan lines Gn+1 and Gn+2 can be selected and controlled.

Moreover, during the following period from time t1 to time t2, the value of the output control signal OE1 is set at "0", but the value of the output control signal OE2 is set at "1". Therefore, only the buffer B connected to the input end of the scan line Gn+1 is turned on. Thus, only the data of the shift pulse SDI present in the shift register SR corresponding to the scan line Gn+1 is outputted to the scan line Gn+1. Accordingly, the scan signals Gn+1 out and Gn+2 out become as shown in FIG. 37, and thus only the scan line Gn+1 is selected.

Furthermore, at the following timing from time t2 to time t4, the shift register SR is operated in synchronization with the clock signal YCLK, and thus the shift pulse SDI moves to each of the shift registers SR connected to the scan lines Gn+2 and Gn+3. Here, during the period from time t2 to time t3, since both of the output control signals OE2 and OE1 supplied to the buffers B corresponding to the scan lines Gn+2 and Gn+3 have values "0", both of the buffers B connected to the input ends of the scan lines Gn+2 and Gn+3 are turned on. Thus, the data of the shift pulses SDI present in the shift registers SR is outputted as the scan signals Gn+2 out and Gn+3 out to the scan lines Gn+2 and Gn+3. Accordingly, during the period from time t2 to time t3, both of the scan lines Gn+2 and Gn+3 can be selected and controlled. Moreover, during the period from time t3 to time t4, the value of the output control signal OE2 is set at "0", but the value of the output control signal OE1 is set at "1". Therefore, only the buffer B connected to the input end of the scan line Gn+2 is turned on. Thus, only the data of the shift pulse SDI present in the shift register SR corresponding to the scan line Gn+2 is outputted to the scan line Gn+2. Accordingly, the scan signals Gn+2 out and Gn+3 out become as shown in FIG. 37, and thus only the scan line Gn+2 is selected.

Next, description will be made for a drive method of a pixel, which corresponds to such operation of the gate driver 5'.

Figure 38:
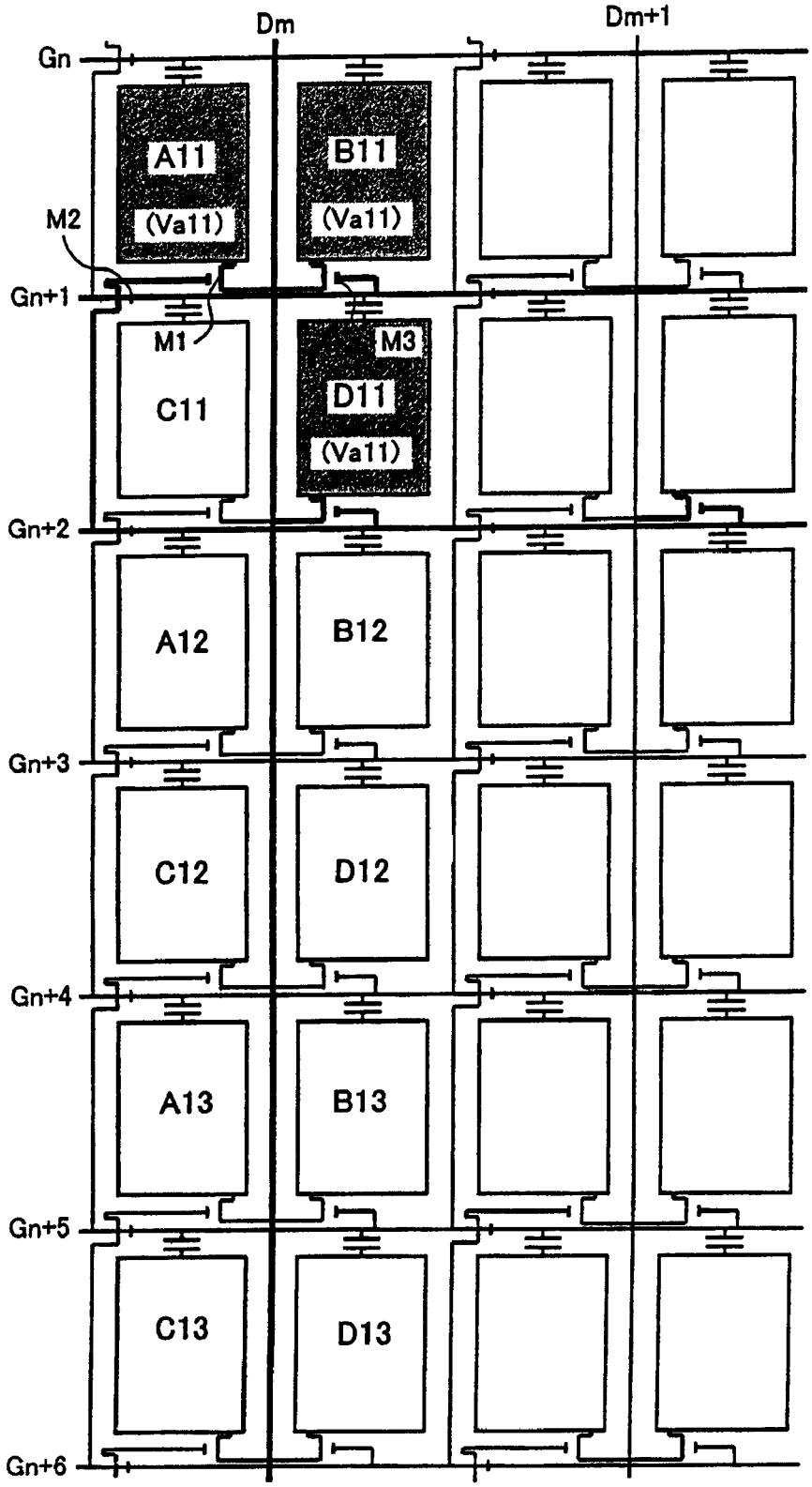
FIG. 38 is a view showing an operation of a circuit of the liquid crystal display device of the fifth embodiment of the present invention.

As shown in FIGS. 36 and 37, when the scan signals Gn+1 out and Gn+2 out are generated, if attention is paid to the scan signals Gn+1 out and Gn+2 out, then both of the scan lines Gn+1 and Gn+2 are selected during the period from time t0 to time t1. Therefore, as shown in FIG. 38, the first to third TFTs M1 to M3 are turned on. Thus, a potential Va11 to be applied to the pixel electrode A11 from the signal line Dm is supplied to the pixel electrodes A11, B11 and D11. Thus, the potential Va11 of the pixel electrode A11 is determined. Note that, in FIG. 38, the selected scan lines Gn+1 and Gn+2 are represented by bold lines.

Figure 39:
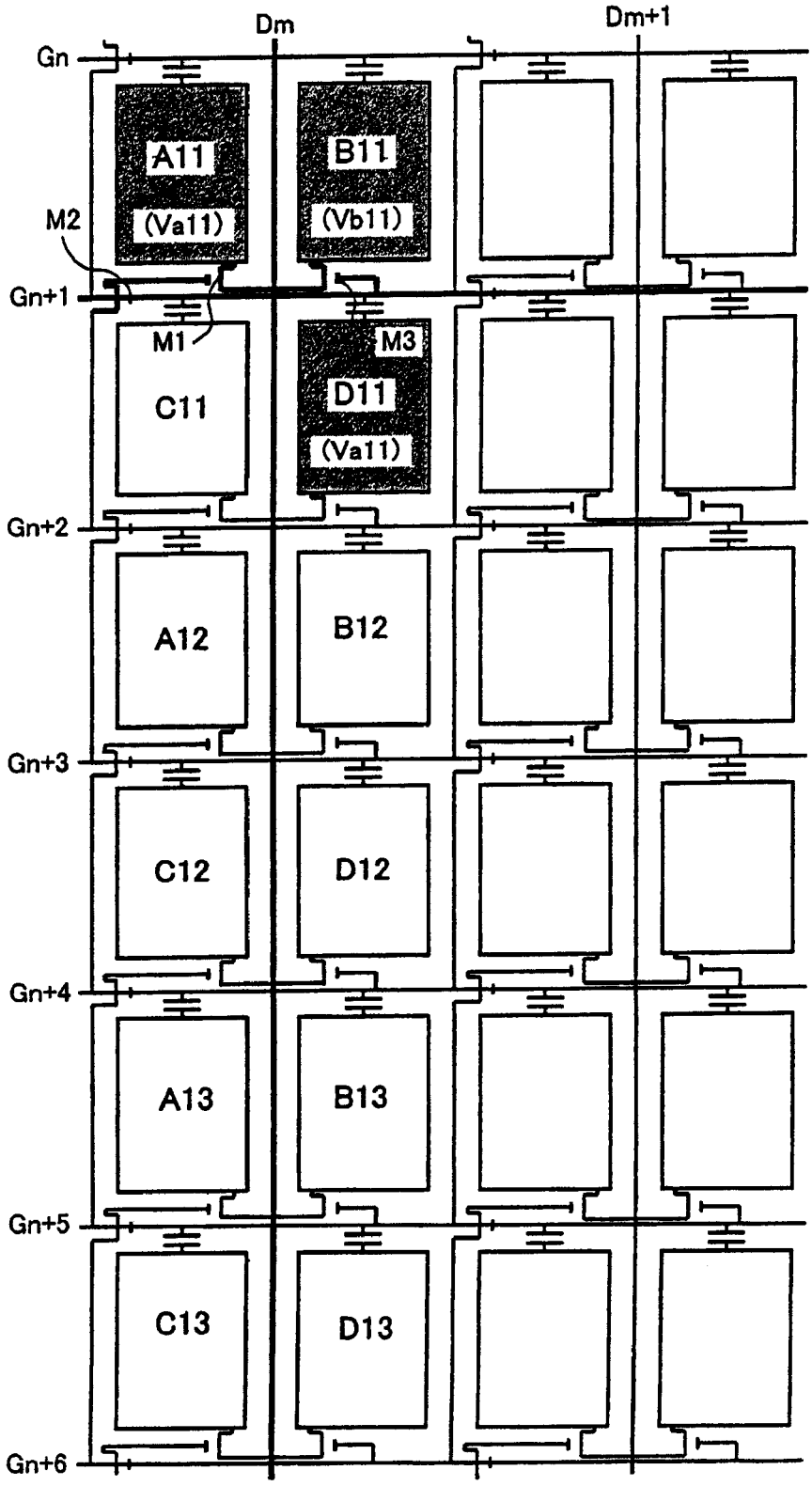
FIG. 39 is a view showing an operation of the circuit of the liquid crystal display device of the fifth embodiment of the present invention, showing a next step of FIG. 38.

Meanwhile, during the following period from time t1 to time t2, the scan line Gn+2 is set at the non-selection potential, and only the scan line Gn+1 is selected. Accordingly, as shown in FIG. 39, only the third TFT M3 is turned on. Here, the potential supplied from the signal line Dm is changed to a potential Vb11 to be applied to the pixel electrode B11, and thus the potential Vb11 is supplied to the pixel electrode B11 to determine the potential of the pixel electrode B11. As described above, the potential of the signal line Dm can be supplied to the pixel electrodes A11 and B11 by time division.

After the scan line Gn+1 is set at the non-selection potential, as shown in FIG. 36, the polarity of the potential of the signal line Dm is inverted, and the potential is changed to a potential Vc11 to be applied to the pixel electrode C11.

Figure 40:
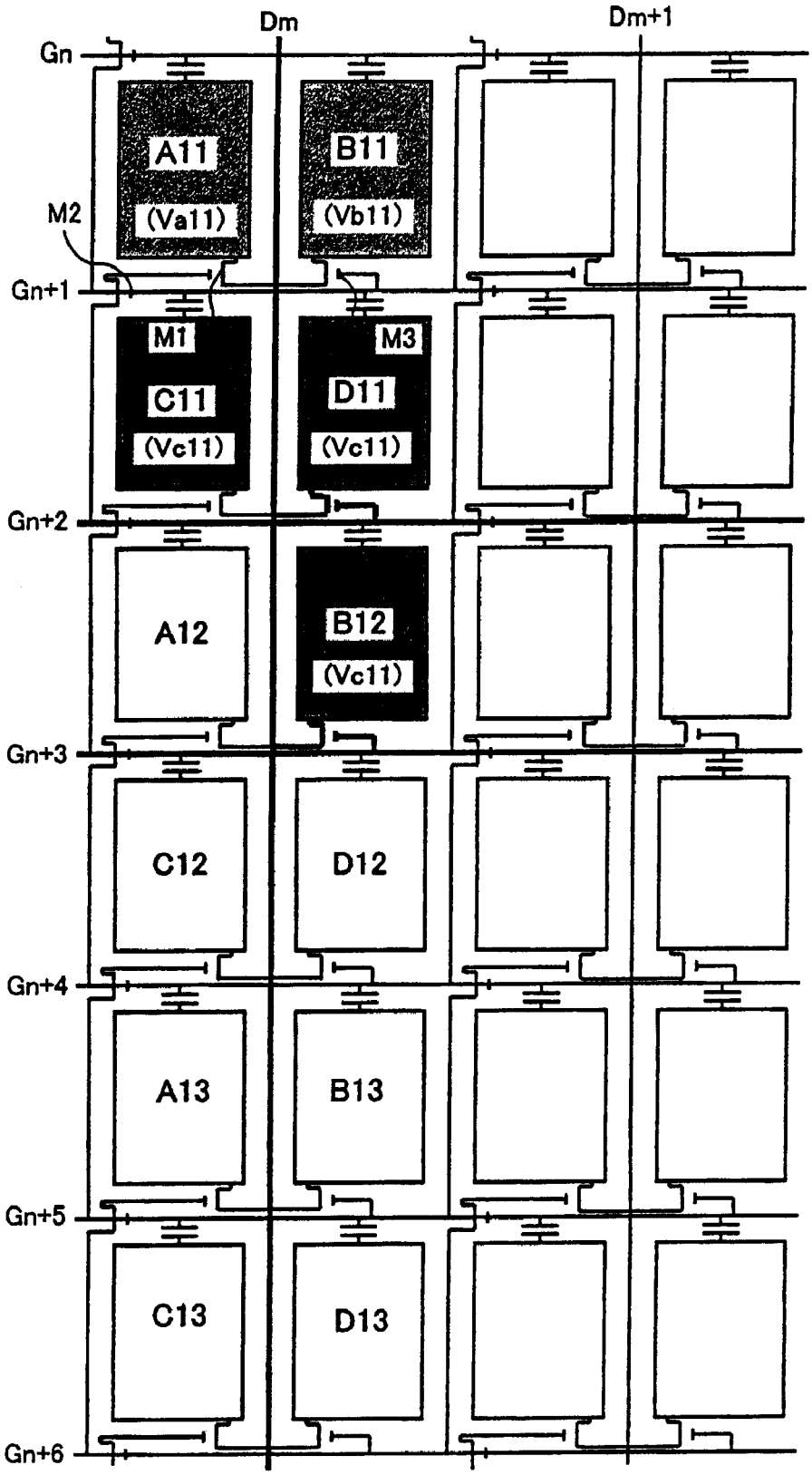
FIG. 40 is a view showing an operation of the circuit of the liquid crystal display device of the fifth embodiment of the present invention, showing a next step of FIG. 39.

Here, in FIG. 36, if attention is paid to the scan signals Gn+2 out and Gn+3 out, then both of the scan lines Gn+2 and Gn+3 are selected during the period from time t3 to time t4. Therefore, as shown in FIG. 40, the potential Vc11 to be applied to the pixel electrode C11 from the signal line Dm is supplied to the pixel electrodes C11, D11 and B12. Thus, the potential Vc11 of the pixel electrode C11 is determined.

Figure 41:
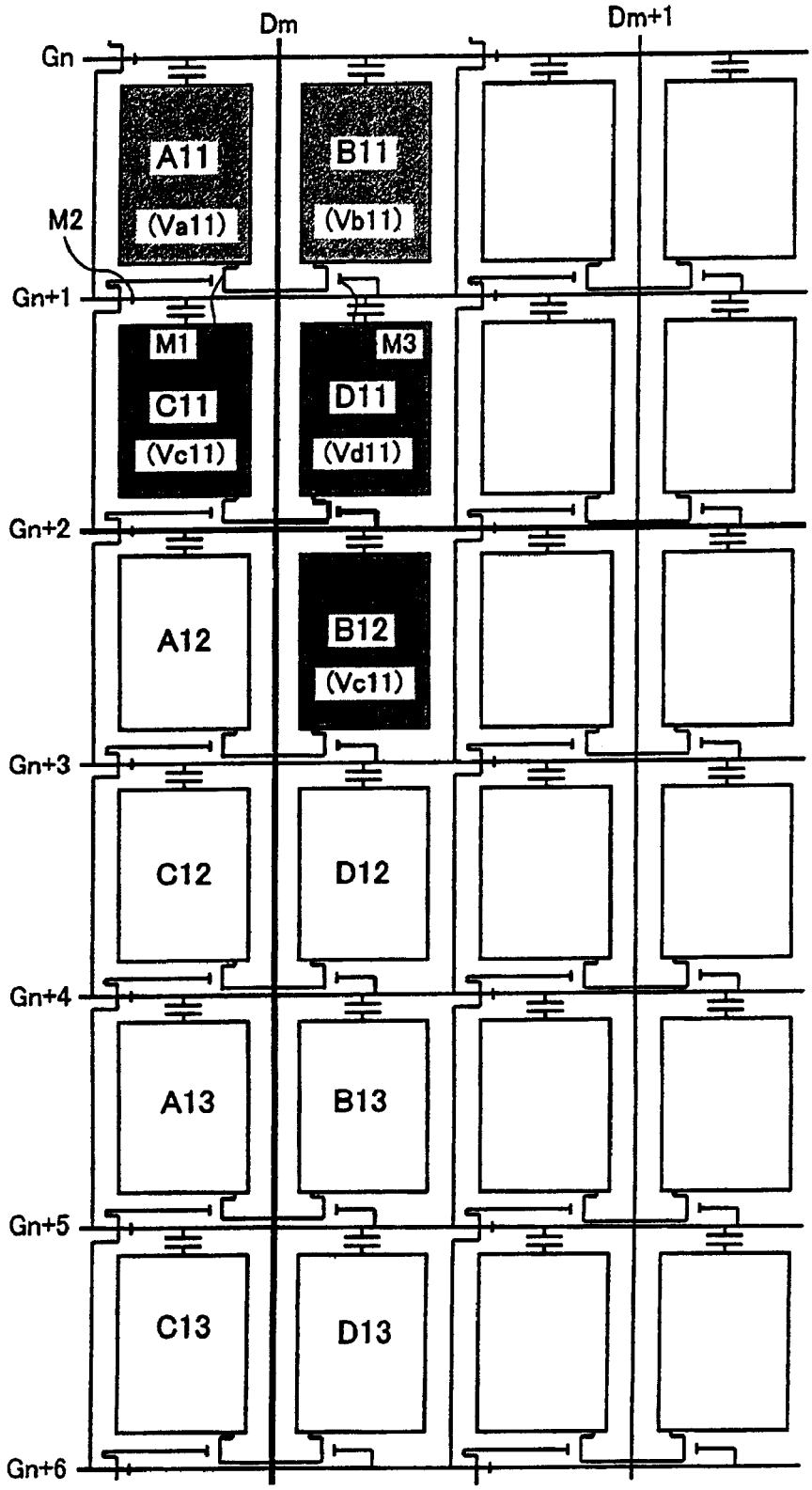
FIG. 41 is a view showing an operation of the circuit of the liquid crystal display device of the fifth embodiment of the present invention, showing a next step of FIG. 40.

Moreover, during the following period from time t4 to time t5, the scan line Gn+3 is set at the non-selection potential, and only the scan line Gn+2 is selected. Accordingly, as shown in FIG. 41, the potential supplied from the signal line Dm is changed to a potential Vd11 to be applied to the pixel electrode D11, and thus the potential Vd11 is supplied to the pixel electrode D11 to determine the potential of the pixel electrode D11.

In this case, the potentials Va11 and Vb11 supplied to the pixel electrodes A11 and B11 are reverse in polarity to the potentials Vc11 and Vd11 supplied to the pixel electrodes C11 and D11. Accordingly, the liquid crystal display device 1 is driven as a display device of a line inversion drive, in which the polarity is inverted for every row.

As described above, in this fifth embodiment, the shift pulse SDI having the time width of twice the clock signal YCLK can be driven favorably by the two systems of output control lines OE.

-425Note that, instead of the fifth embodiment, another embodiment may be adopted, in which a shift pulse SDI having a time width of m times (m: natural number of 2 or more) the clock signal YCLK is controlled by m systems of output control lines OE.

SIXTH EMBODIMENT

Next, description will be made for a sixth embodiment of the present invention.

In this sixth embodiment, since the entire configuration of a liquid crystal display device 1 and the circuit configuration of an array substrate are common to those of the first embodiment, and a pixel drive method is common to the fifth embodiment, here, description of the configurations common to those of the first and fifth embodiments will be omitted, and description will be mainly made for points different from those of the first and fifth embodiments.

The different points of this sixth embodiment from that of the first and fifth embodiments are points regarding operations of the control circuits 6 and 6' and the gate drivers 5 and 5' when the liquid crystal display device 1 is driven. Note that, also in this sixth embodiment, the precharge of pixels is not carried out.

First, description will be made for the control circuit 6' and the gate driver 5' in this sixth embodiment.

Figure 42:
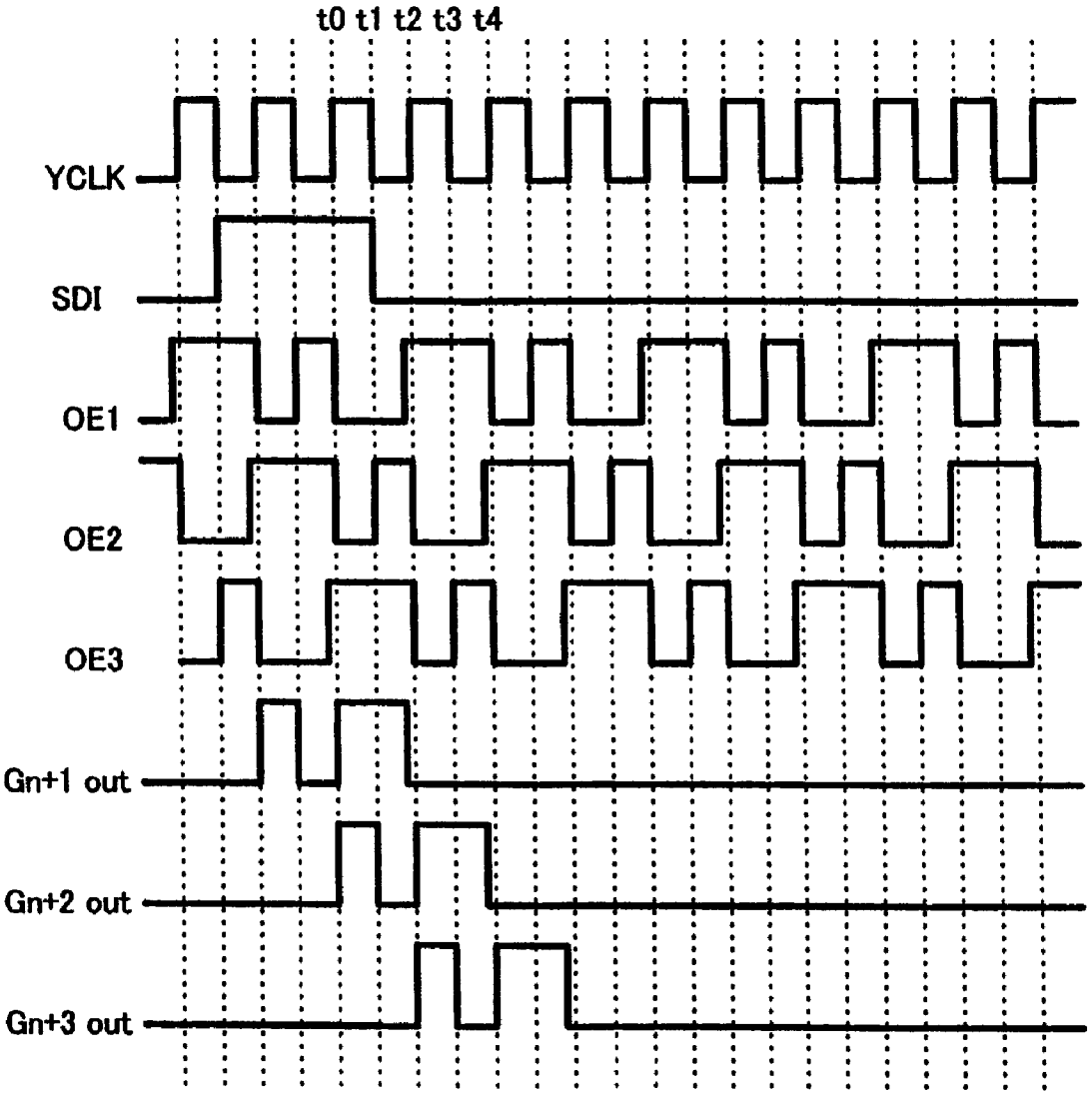
FIG. 42 is a timing chart of a clock signal, a shift pulse and scan signals, schematically showing a sixth embodiment of the present invention.

FIG. 42 is a timing chart showing a relation among the scan signals Gn+1 out to Gn+3 out supplied to the scan lines Gn+1 to Gn+3, a shift pulse SDI outputted to the shift register SR and the output control signals OE1 to OE3, both of which correspond to the above-described scan signals, and a clock signal YCLK driving the shift registers SR. Note that, in FIG. 42, portions where the potentials rise for the precharge among the scan signals Gn+1 out to Gn+4 out are also represented by solid lines.

In order to drive pixels in this sixth embodiment, first, the shift pulse SDI is outputted from the pulse generation unit 9 of the control circuit 6' to the gate driver 5' (see FIG. 42).

As shown in FIG. 42, the shift pulse SDI has a time width from rise to fall for two cycles of the clock signal YCLK. Here, one cycle of the clock signal YCLK is equal to one horizontal scan period of the screen. Specifically, the shift pulse SDI has a time width for two horizontal scan periods.

Here, in the shift register unit 12 of the gate driver 5', the shift pulse SDI moves to the next shift register SR for one cycle of the clock signal YCLK synchronously with the rise of the clock signal YCLK. As described above, by providing, to the shift pulse SDI, the time width for two cycles of the clock signal, the shift pulse SDI sequentially moves while existing in two adjacent shift registers SR.

Accordingly, by supplying the output control signals OE1 and OE2 or OE2 and OE3 as shown in FIG. 37 to the buffers B adjacent to each other, the buffers B connected to two adjacent shift registers SR are controlled simultaneously, and thus two scan lines G can be selected and controlled simultaneously.

The concrete operation of the gate driver 5' will be described as below. Note that the output control signal OE1 shown in FIG. 37 is supplied to the buffer B connected to each input end of the scan lines Gn+1, Gn+4 . . . . Meanwhile, the output control signal OE2 is supplied to the buffer B connected to each input end of the scan lines Gn+2, Gn+5 . . . , and the output control signal OE3 is supplied to the buffer B connected to each input end of the scan lines Gn+3, Gn+6 . . . .

At timing from time t0 to time t2 shown in FIG. 42, the shift pulse SDI is present in each of the shift registers SR connected to the scan lines Gn+1 and Gn+2. Here, first, during the period from time t0 to time t1, since both of the output control signals OE1 and OE2 supplied to the buffers B corresponding to the scan lines Gn+1 and Gn+2 have values "0", both of the buffers B connected to input ends of the scan lines Gn+1 and Gn+2 are turned on. Thus, data of the shift pulses SDI present in the shift registers SR is outputted as the scan signals Gn+1 out and Gn+2 out to the scan lines Gn+1 and Gn+2. Accordingly, during the period from time t0 to time t1, both of the scan lines Gn+1 and Gn+2 can be selected and controlled.

Moreover, at the following timing from time t1 to time t2, the value of the output control signal OE1 is set at "0", but the value of the output control signal OE2 is set at "1". Therefore, only the buffer B connected to the input end of the scan line Gn+1 is turned on. Thus, only the data of the shift pulse SDI present in the shift register SR corresponding to the scan line Gn+1 is outputted to the scan line Gn+1. Accordingly, the scan signals Gn+1 out and Gn+2 out become as shown in FIG. 42, and thus only the scan line Gn+1 is selected.

Furthermore, at the following timing from time t2 to time t4, the shift register SR is operated in synchronization with the clock signal YCLK, and thus the shift pulse SDI moves to each of the shift registers SR connected to the scan lines Gn+2 and Gn+3. Here, during the period from time t2 to time t3, since both of the output control signals OE2 and OE3 supplied to the buffers B corresponding to the scan lines Gn+2 and Gn+3 have values "0", both of the buffers B connected to the input ends of the scan lines Gn+2 and Gn+3 are turned on. Thus, the data of the shift pulses SDI present in the shift registers SR is outputted as the scan signals Gn+2 out and Gn+3 out to the scan lines Gn+2 and Gn+3. Accordingly, during the period from time t2 to time t3, both of the scan lines Gn+2 and Gn+3 can be selected and controlled. Moreover, during the period from time t3 to time t4, the value of the output control signal OE2 is set at "0", but the value of the output control signal OE3 is set at "1". Therefore, only the buffer B connected to the input end of the scan line Gn+2 is turned on. Thus, only the data of the shift pulse SDI present in the shift register SR corresponding to the scan line Gn+2 is outputted to the scan line Gn+2. Accordingly, the scan signals Gn+2 out and Gn+3 out become as shown in FIG. 42, and thus only the scan line Gn+2 is selected.

In such a manner as described above, the scan signals Gn+1 out, Gn+2 out, Gn+3 out . . . can be generated. Therefore, in this sixth embodiment, the pixels can be driven similarly to the fifth embodiment. Specifically, since both of the scan lines Gn+1 and Gn+2 are selected during the period from time t0 to time t1, the potential Va11 is supplied from the signal line Dm to the pixel electrode A11 as shown in FIG. 38. Moreover, only the scan line Gn+1 is selected during the period from time t1 to time t2, and thus the potential Vb11 is supplied from the signal line Dm to the pixel electrode B11 as shown in FIG. 39.

Furthermore, during the period from time t2 to time t3, both of the scan lines Gn+2 and Gn+3 are selected, and thus the potential Vc11 inverse to the potential Vb11 in polarity is supplied from the signal line Dm to the pixel electrode C11. Moreover, during the period from time t3 to time t4, only the scan line Gn+2 is selected, and thus the potential Vd11 is supplied from the signal line Dm to the pixel electrode D11. Accordingly, the liquid crystal display device 1 can be driven as a display device of a line inversion drive, in which the polarity is inverted for every row.

As described above, in this sixth embodiment, the shift pulse SDI having the time width of twice the clock signal YCLK can be driven favorably by the three systems of output control lines OE.

Note that, instead of the sixth embodiment, another embodiment may be adopted, in which a shift pulse SDI having a time width of m times (m: natural number of 2 or more) the clock signal YCLK is controlled by n systems of output control lines OE, the number n being larger than m.

As described above, according to the present invention, the selection signals can be supplied to the multiplexed pixels efficiently, and determination can be efficiently made the timing of precharge, and the drive waveforms and method of pixels.

The invention claimed is:

1. An image display device, comprising:

a plurality of signal lines for supplying display signals;

a first group of pixel electrodes sequentially selected during a first horizontal scan period, the first group of pixel electrodes being connected to a specified signal line;

a second group of pixel electrodes sequentially selected during a second horizontal scan period after the first horizontal scan period, the second group of pixel electrodes being connected to the specified signal line;

a first group of scan lines for supplying scan signals for driving the first group of pixel electrodes during the first horizontal scan period; and a second group of scan lines for supplying scan signals for driving the second group of pixel electrodes during the second horizontal scan period, wherein a specified group of scan lines among the second group of scan lines is selected during the first horizontal scan period to drive a specified pixel electrode among the second group of pixel electrodes, and any one scan line in the specified group of scan lines is not selected for a period from the selection of the specified group during the first horizontal scan period to the drive of the specified pixel electrode during the second horizontal scan period.

2. The image display device according to claim 1, wherein the specified pixel electrode is driven in a same polarity during the first and second horizontal scan periods.

3. The image display device according to claim 1, wherein the specified group of scan lines and the first group of scan lines share at least one scan line.

4. The image display device according to claim 1, wherein respective signal lines supply display signals of the same polarity during a same horizontal scan period, and signal lines adjacent to each other among the plurality of signal lines supply display signals of different polarities during the same horizontal scan period.

* * * * *